US005673983A

United States Patent [19]

Carlson et al.

[11] Patent Number: 5,673,983

[45] Date of Patent: Oct. 7, 1997

[54] CASSETTE ASSEMBLY AND UNIT DOSE MEDICATION CART USING THE CASSETTE ASSEMBLY

[75] Inventors: Bradley J. Carlson, Wilkes-Barre; David A. Reppert, Brodheadsville; Michael B. Burns; Jonathan M. Daugherty, both of Wilkes-Barre; Kenneth A. Stevens, Harleysville; Craig F. Orlove, Mountaintop, all of Pa.

[73] Assignee: Metro Industries, Inc., Reno, Nev.

[21] Appl. No.: 426,195

[22] Filed: Apr. 21, 1995

[51] Int. Cl.[6] ..... E05B 53/00

[52] U.S. Cl. ..... 312/218; 312/249.11; 312/219; 312/301

[58] Field of Search ..... 312/216, 218, 312/209, 249.11, 249.8, 217, 219, 107.5, 349, 350, 351, 308, 301, 222, 265.3, 270.3, 265.5, 234.3

[56] References Cited

U.S. PATENT DOCUMENTS

| | | | |
|---|---|---|---|
| D. 323,915 | 2/1992 | Welch . | |
| D. 361,631 | 8/1995 | King . | |
| 1,828,088 | 10/1931 | Robinson | 312/265 X |
| 1,943,282 | 1/1934 | Bellavia | 312/222 |
| 2,335,391 | 11/1943 | Cushing | 312/234.3 X |
| 3,424,111 | 1/1969 | Maslow . | |
| 3,462,110 | 8/1969 | Cheslock . | |
| 3,523,508 | 8/1970 | Maslow . | |
| 4,142,343 | 3/1979 | Trafton . | |
| 4,163,537 | 8/1979 | Mourgue . | |
| 4,616,890 | 10/1986 | Romic | 312/216 X |
| 5,003,741 | 4/1991 | Yeh . | |
| 5,016,948 | 5/1991 | Welch et al. . | |
| 5,139,321 | 8/1992 | Beardsley | 312/209 |
| 5,172,967 | 12/1992 | Pipe | 312/217 |
| 5,205,628 | 4/1993 | Swets et al. | 312/216 |
| 5,205,630 | 4/1993 | Welch et al. | 312/249.11 |
| 5,211,461 | 5/1993 | Teufel et al. . | |
| 5,259,668 | 11/1993 | Teufel et al. | 312/265.5 X |
| 5,415,302 | 5/1995 | Carlson et al. . | |

FOREIGN PATENT DOCUMENTS

| | | |
|---|---|---|
| 1130359 | 8/1982 | Canada . |
| 0226496 | 6/1987 | European Pat. Off. . |
| 0429825 | 6/1991 | European Pat. Off. . |
| 3405862 | 8/1985 | Germany . |
| 2061092 | 5/1981 | United Kingdom . |
| 2156206 | 10/1985 | United Kingdom . |
| WO8300804 | 3/1983 | WIPO . |

*Primary Examiner*—Peter M. Cuomo
*Assistant Examiner*—Janet M. Wilkens
*Attorney, Agent, or Firm*—Fitzpatrick, Cella, Harper & Scinto

[57] ABSTRACT

A medication cart features a frame assembly formed from a plurality of vertical support posts and wall panels secured to the posts. Each support post has a plurality of equally-spaced, radially extending flanges running the longitudinal length of the post. The medication cart contains, in addition to an array of drawers and bins, a multi-level cassette assembly. An internal locking mechanism secures the cassette assembly when it is positioned in the medication cart, and an external locking mechanism secures the cassette assembly outside of the medication cart.

70 Claims, 44 Drawing Sheets

CASSETTE ASSEMBLY AND UNIT DOSE MEDICATION CART USING THE CASSETTE ASSEMBLY

BACKGROUND OF THE INVENTION

1. Field of the Invention

The invention relates generally to a mobile cart for storing and transporting items, and more particularly to a medication cart featuring a cassette assembly ideally suited for storing and dispensing medication.

2. Description of the Prior Art

Mobile medication carts for storing medical and related patient supplies have been used for many years. Medication carts are typically used in hospitals or other health care facilities, and are wheeled from room to room transporting, for example, medication to be dispensed to patients.

Two well-known medication carts are manufactured by Drustar® and Artromick Int'l.®. Both medication carts use a cart frame supported on casters and are designed to receive an array of drawers, multi-level cassettes, shelves, etc. Each level of the cassette contains a plurality of pull-out bins, with the bins on different levels sometimes varying in size (i.e., width). Both medication carts also provide locking systems for securing the medication and other items in the cart.

In addition, Artromick Int'l.® offers a patented drawer slide module, which is the subject of U.S. Pat. No. 5,211,461, for use with their medication cart.

The assignee of the subject application also manufactures and sells medication carts. In one type of mobile cart, known as the METROFLEX® cart, two interlocking side/bottom panels are joined together to form the lateral sides and bottom of the cart and a back panel is secured to the side/bottom panels. A top portion is added to complete a 3-sided enclosed cart. The interior sides of the cart are corrugated to support an array of differently sized drawers and bins, and shelves or other accessories can be provided on the outer sides of the cart. The METROFLEX® cart is the subject of U.S. Pat. Nos. 5,016,948 and No. D 323,915.

However, further improvements in medication carts are desired. For example, there is a need for a medication cart with increased versatility and storage capacity as well as offering superior construction and features.

SUMMARY OF THE INVENTION

It is a principal object of the invention to provide an improved medication cart.

Accordingly, one object of the present invention is to provide a medication cart with superior functional and aesthetic design features.

In accordance with one aspect of the invention, a cart comprises an enclosed structure including a plurality of support posts, at least two side walls supported between the support posts, with each side wall have a corrugated interior surface, a bottom platform supporting the support posts and the side walls and a top platform fitting over the support posts and the side walls. In addition, locking means secures the enclosed structure, and a cassette assembly is removably supported in the enclosed structure. The cassette assembly includes frame means having side panels with a corrugated interior and ribbed outer surfaces which engage the corrugated interior surface of the side walls. At least one cassette tray is supported in the frame means, and at least one bin is received in the cassette tray. In addition, internal locking means secures the bins in the enclosed structure and external locking means secures the bins within the frame means.

Another object of the invention is to provide a controller for controlling operation of the locking means.

Another object of the invention is to provide a cassette assembly for use in the medication cart.

Yet another object of the invention is to provide a cassette assembly that can be secured when disposed in the medication cart and secured when removed from the medication cart.

In accordance with another aspect of the invention, a cassette assembly comprises frame means including side panels with corrugated interior surfaces and ribbed outer surfaces, at least one cassette tray slidably supported in the frame means, and at least one bin received in the cassette tray. Internal locking means secures the bin in an enclosed structure, and external locking means secures the bin within the frame means.

Still another object of the subject invention is to provide a medication cart using a platform system featuring flanged support posts and offset side panels.

In accordance with another aspect of the invention, each support post in the medication cart includes an elongated tubular post and a plurality of spaced flanges extending radially from the post and running in a longitudinal direction along the post. Each flange has a first portion extending radially from the post and a second portion extending from a terminal end of the first portion.

These and other objects, aspects, features and advantages of the present invention will become apparent from the following detailed description of the preferred embodiment taken in conjunction with the accompanying drawings.

DESCRIPTION OF THE PREFERRED EMBODIMENTS

Figure 1:
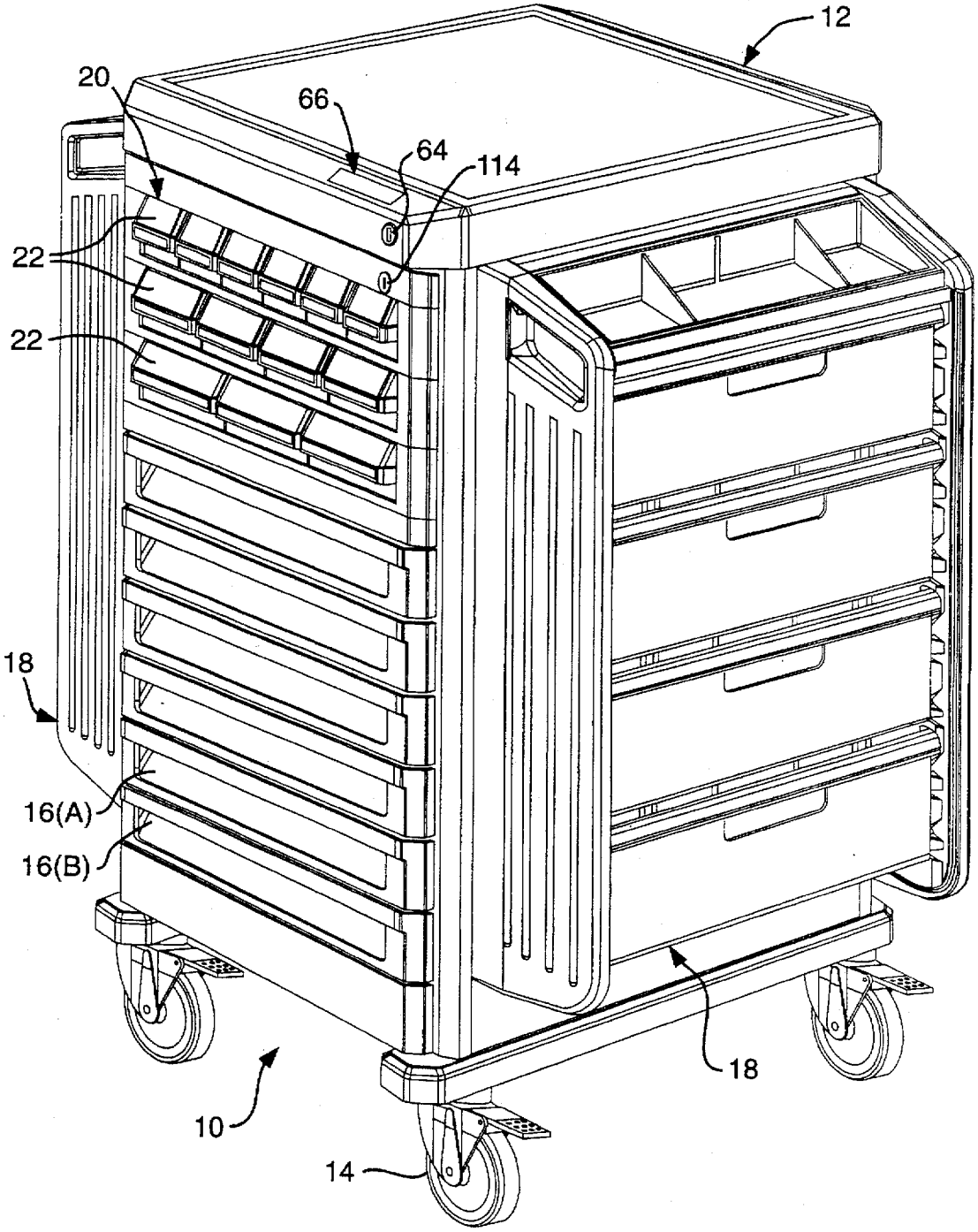
FIG. 1 is a perspective view of a medication cart in accordance with the present invention.

FIG. 1 illustrates a medication cart 10 in accordance with the present invention. Generally, the cart includes a frame assembly 12 supported on casters 14. A plurality of drawers 16 of various sizes (i.e., depths) are slidably supported in the frame assembly, and hinged side pods 18 are supported on the sides of the cart to swing out toward the front as discussed in detail below.

The medication cart features a cassette assembly 20 that includes a plurality of pull-out cassette bins provided on different levels. In accordance with the subject invention, the medication cart includes a security system for preventing unauthorized access to the drawers and the cassette bins, and the cassette assembly includes its own security system for securing the bins even when the cassette assembly is not in the cart.

Details of the frame assembly 12 are shown in FIGS. 2 through 8. The frame assembly is based on a platform system using a plurality of flanged support posts and side panels.

Figure 2:
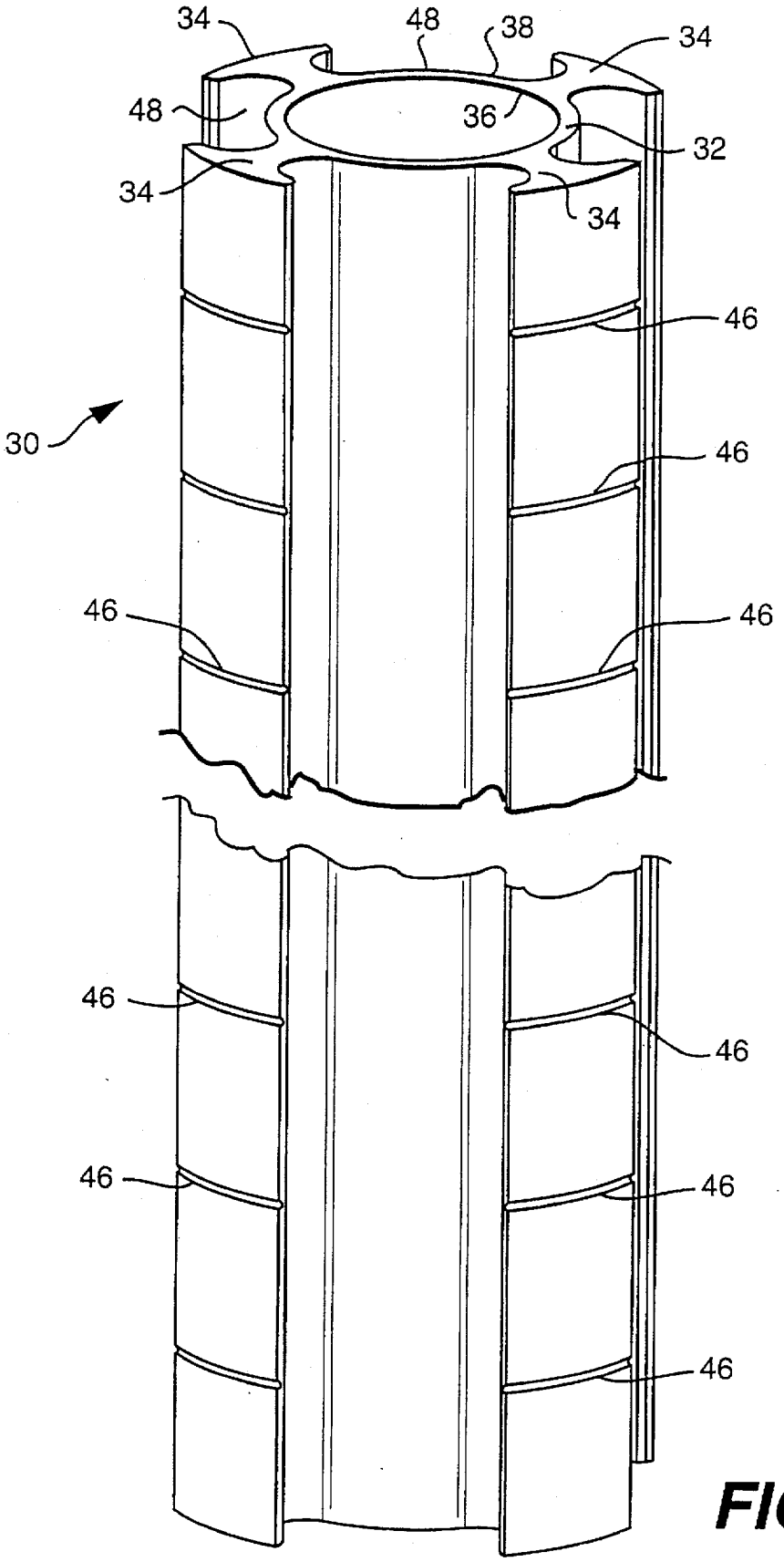
FIG. 2 is a perspective view of support post in accordance with the present invention.
Figure 3:
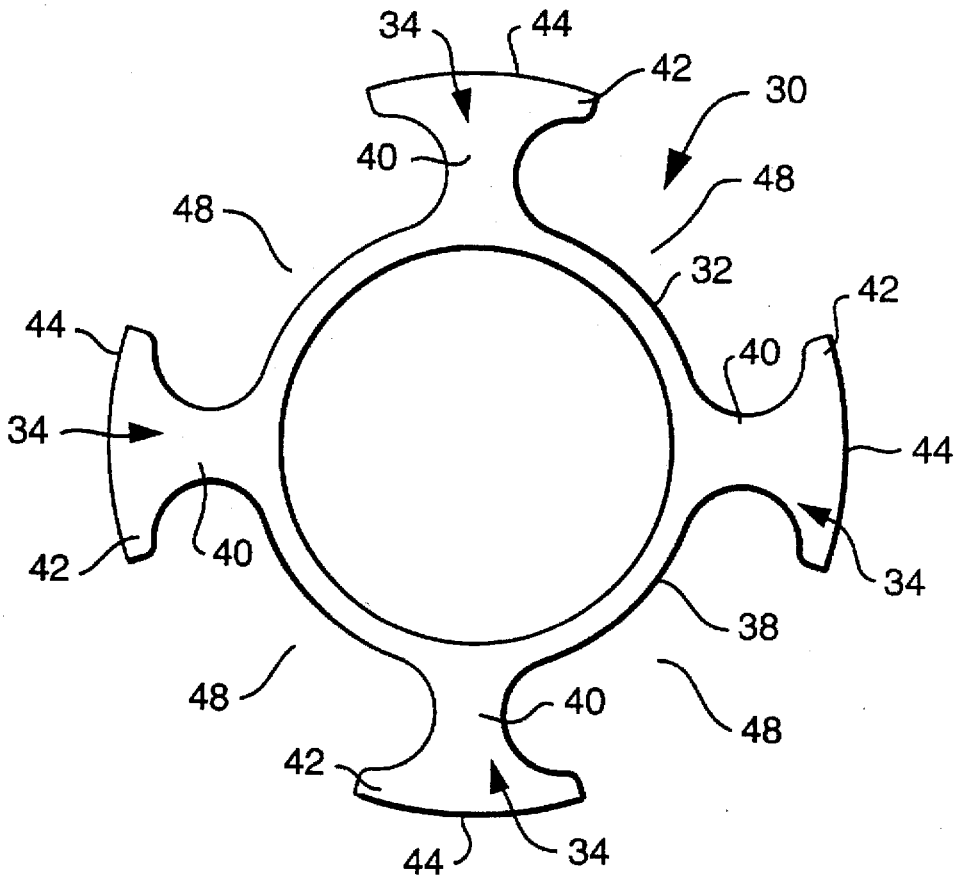
FIG. 3 is a top plan view of the support post shown in FIG. 2 in accordance with the present invention.
Figure 4:
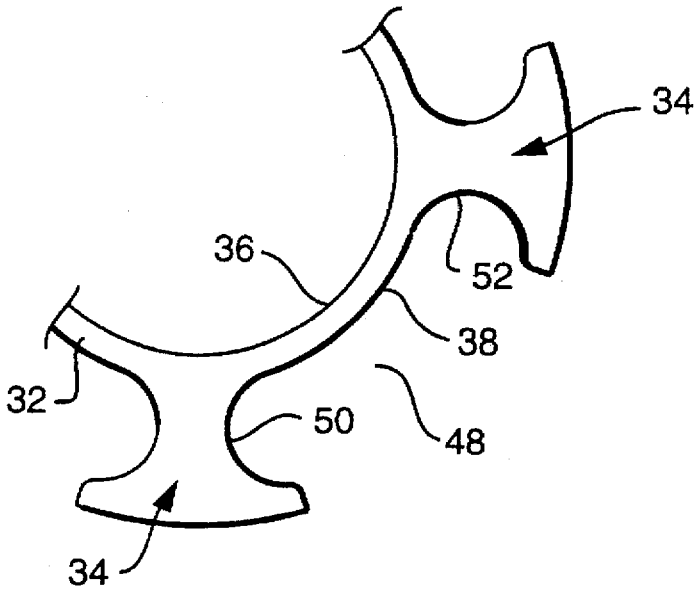
FIG. 4 is a fragmented partial view of FIG. 3, isolating a slot in the support post in accordance with the present invention.

A support post 30 in accordance with the subject invention is illustrated in FIGS. 2, 3 and 4. The support post 30 is generally comprised of an interior post 32 and a plurality of radially extending, equally spaced flanges 34. The post is designed to be vertically disposed in normal use and can be supported at its lower end by a base platform, a foot, a caster, etc. In a single-wide platform, which is preferred for the medication cart, four support posts are used together to provide corner supports for the frame assembly.

The interior post 32 is preferably tubular in shape, with a circular cross-section and interior 36 and exterior 38 concentric wall surfaces as best seen in FIGS. 2 and 3. The flanges 34 preferably extend along the entire longitudinal length of the interior post. In addition, the flanges and interior post are preferably formed by conventional extrusion techniques to form an integral structure made of, for example, aluminum. However, other comparable means, e.g., pultrusion, roll-formed steel, could be used to form the support post in accordance with the subject invention.

The flanges 34, or dovetails, are preferably spaced equidistant from each other around the periphery of the interior post 32 to create a symmetrical support post. Thus, four flanges would be spaced at 90° intervals around the post. Although using four flanges is preferred because of the versatility such an arrangement provides, the number of flanges is arbitrary and can vary without departing from the scope of the invention. With reference to FIG. 3, each flange has a first portion 40 which extends radially from the interior post 32. At the terminal end of each first portion is a transversely-disposed second portion 42. The second portions are formed with arcuate outer surfaces 44, that together outline a circumference that is concentric with the interior 36 and exterior 38 wall surfaces of the interior post 32. Referring to FIG. 2, the outer surfaces 44 of each flange are formed with a series of equally spaced circumferential grooves 46. The vertically-spaced grooves are desirably provided along the entire longitudinal length of the flanges. In one embodiment, the outside diameter of the support post, as defined by the arcuate outer surfaces 44, is 1.625" and the inside diameter is 0.875".

A slot 48 is formed between each pair of adjacent flanges 34. Because of the arcuate shapes of the exterior wall surface 38 and the flanges, the slots can be described as substantially concave T-shaped, with respect to a longitudinal axis of the support post. With reference to FIG. 4, each slot is shaped to have concave-shaped opposite end surfaces 50 and 52. The exterior wall 38 forms a convex interior surface of the slot. The contour of the end surfaces and outer wall form a slot that is simple in design but provides maximum flexibility and support. In addition, the curved single-wall design of the flanges makes extrusion easier, is readily cleanable and allows the support posts to be aesthetically integrated into the finished structure as will be discussed in detail below.

Figure 5:
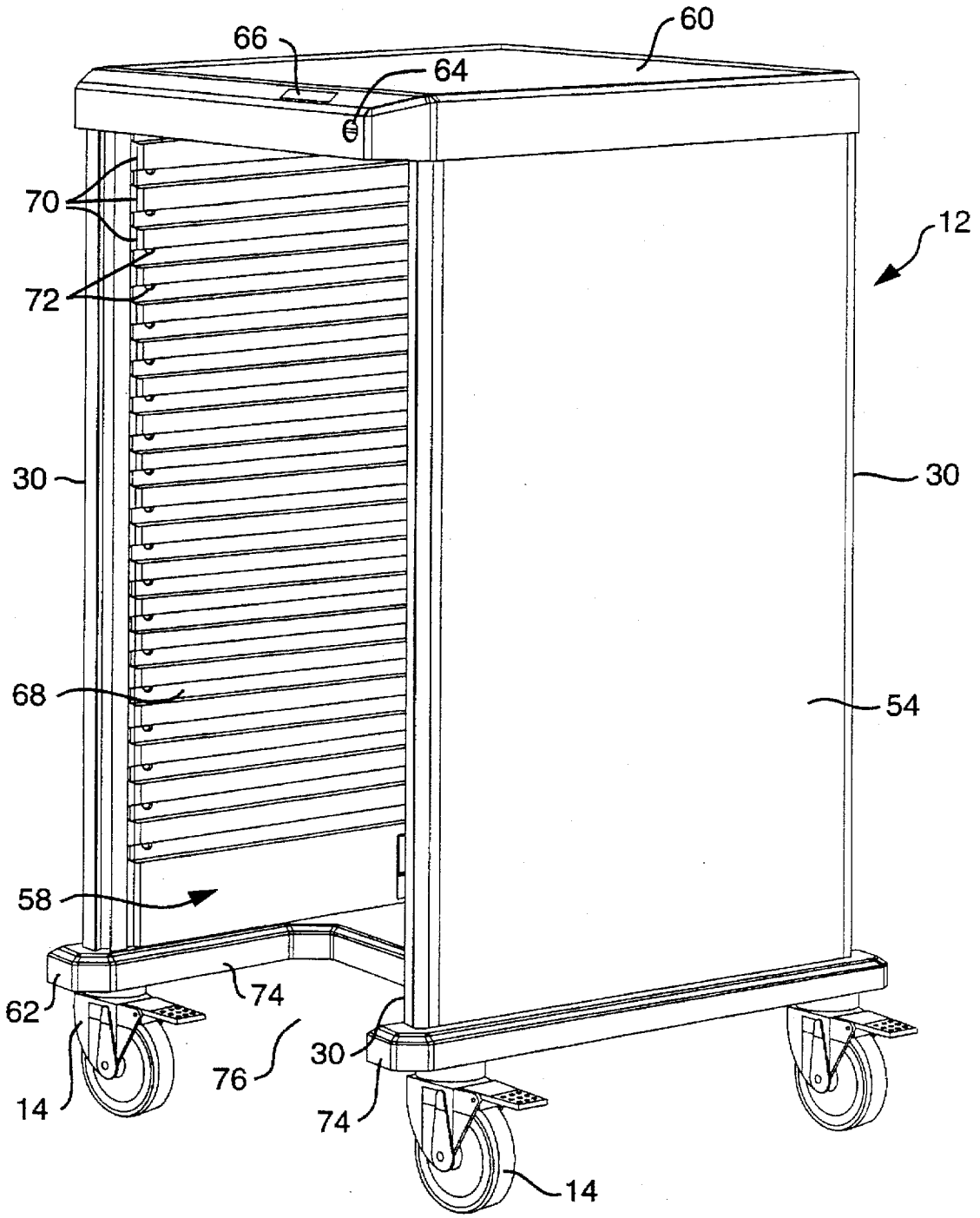
FIG. 5 is a perspective view of a frame assembly in accordance with the present invention.

The frame assembly 12 in FIG. 5 is built on a single-wide platform constructed of four support posts 30. In this embodiment, the support posts support two exterior side panels 54 and a back panel 56 (unseen in FIG. 6). In addition, interior side panels 58 are disposed side-by-side adjacent to the exterior side panels 54. Top and bottom platforms 60 and 62, respectively, complete the frame assembly. The top platform houses a mechanical locking mechanism 64 and an electronic controller 66, both used for operating a security system that will be described in detail below. The completed structure forms a 3-sided enclosed frame assembly, with the front side, or fourth side, open to receive an array of drawers, shelves, cassettes, etc., as discussed in detail below.

Each interior side panel includes a corrugated interior surface 68 with an array of corrugations 70 adapted to receive and support drawers, shelves, cassette assemblies or other accessories. The horizontal corrugations are uniformly spaced in the vertical direction. Small, semicircular openings 72 can be seen in the lateral front face of the interior side panel immediately below the end of each corrugation. The openings extend to the underside of each corrugation but cannot be seen in this view. The openings allow locking fingers, which will be positioned in each corrugations as discussed below, to move in and out of the corrugations as part of the security system that will be discussed below. Openings can also be provided along the right-hand side of the interior panel 58 for the same purpose.

The top and bottom platforms 60 and 62 are preferably formed of a metal frame fitted with a plastic cover. As shown in FIG. 5, the top platform has a substantially rectangular shape for fitting over the four support posts 30. The bottom platform 62 is preferably designed, at least in a single-wide platform, to have a "C"-shape formed to have two extending legs 74 defining an open front portion 76. By cutting out the front portion of the bottom platform, the overall appearance of the cart is enhanced, especially when drawers or other accessories are not disposed in the lower part of the cart.

Both top and bottom platforms can be secured to the support posts by using threaded plugs (unshown) that are force-fitted, for example, in opposite ends of each support post and threaded fastening means fed through the top and bottom platforms and into the plugs. In assembling the enclosed frame assembly, each support post is positioned on the base platform fitted with its cover, and a threaded bolt or other fastener is inserted through a hole in the platform from the underside and into engagement with the threaded plug. The side panels are then top loaded into the support posts. Threaded fasteners are inserted through the metal frame of the top platform and into the plugs at the top ends of the support posts. Finally, the top cover is fitted over the top platform. Of course, other comparable means for securing the platforms to the support posts could be used.

In the single-wide platform design as discussed above, the enclosed frame assembly preferably has one support post 30 positioned at each of four corners. In this design, the support posts are spaced, for example, 19.8" from center to center. Of course, the spacing of the posts is arbitrary and can be varied to construct different size and shaped structures. A "double-wide" design platform includes, in addition to four corner posts, a rear center post and, in an enclosed frame assembly, a front center post.

Figure 6:
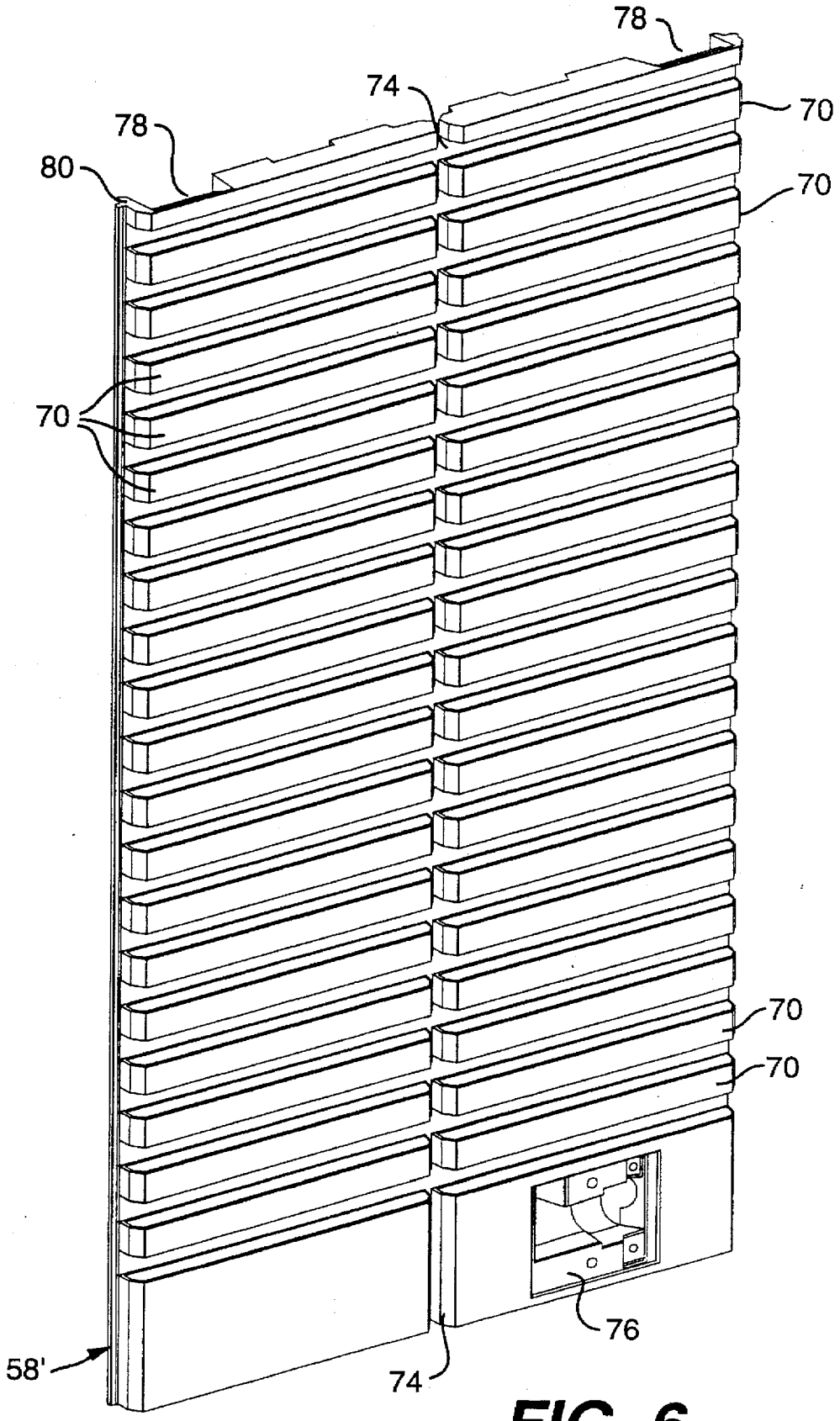
FIG. 6 is a perspective view of a modified interior side panel for use in the frame assembly in accordance with the present invention.

A slightly modified interior side panel 58' is shown in FIG. 6. The modified side panel 58' differs from the side panel 58 only in that each corrugation 70 is formed in two halves to define a dividing slot 74 that runs the vertical length of the side panel. The modified panel can be used in a two-sided enclosed structure, i.e., a dual access cart, whereby the front and back are open to receive, for example, a cassette assembly or drawers. In a dual access cart, a thin, flat panel (unshown) can be secured in the dividing slot 74 for dividing the interior of the frame assembly in half.

A recessed opening, or pocket, 76 in the lower part of the interior surface 68 and pockets 78 in the back of the interior side panel 58' (and 58) are provided to house various components of the security system. Offset lateral ends, or edges, 80 of the interior panel are received in slots 48 in the support posts as discussed below to secure the side panel.

All of the side panels can be made of a polymer material, e.g., polyethylene, and are preferably blow molded or formed by other comparable means to form a hollow, two-faced structure. The interior side panels 58 are also compression molded in part as discussed below.

Figure 7A:
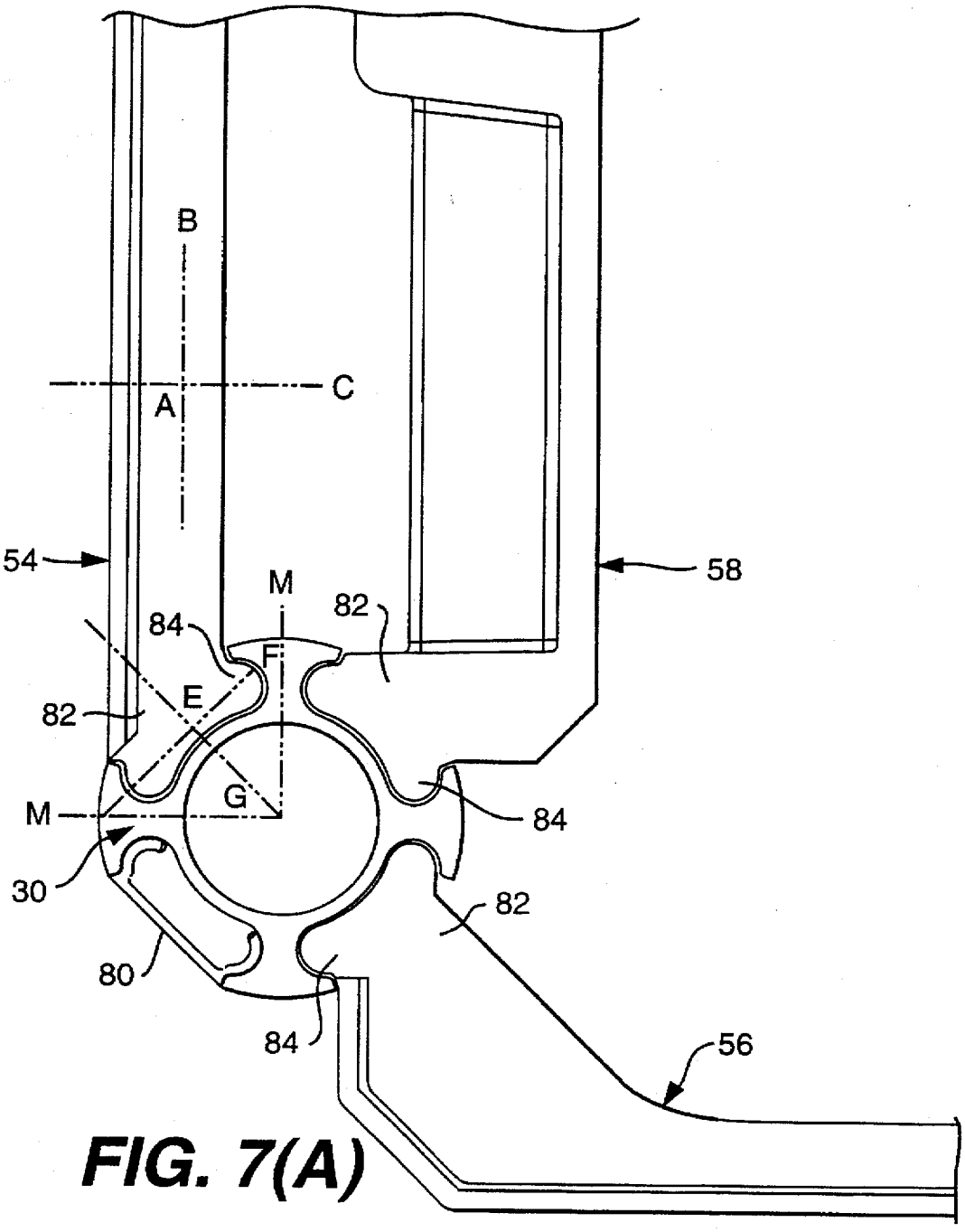
FIG. 7A is a fragmented top plan view of a support post in use in a back corner of an enclosed structure in accordance with the present invention.
Figure 7B:
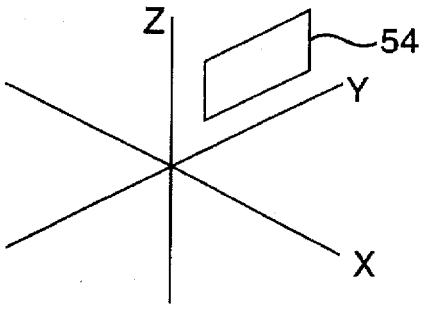
FIG. 7B is a three-axis coordinate system and a schematic view of a side panel in accordance with the present invention.
Figure 8:
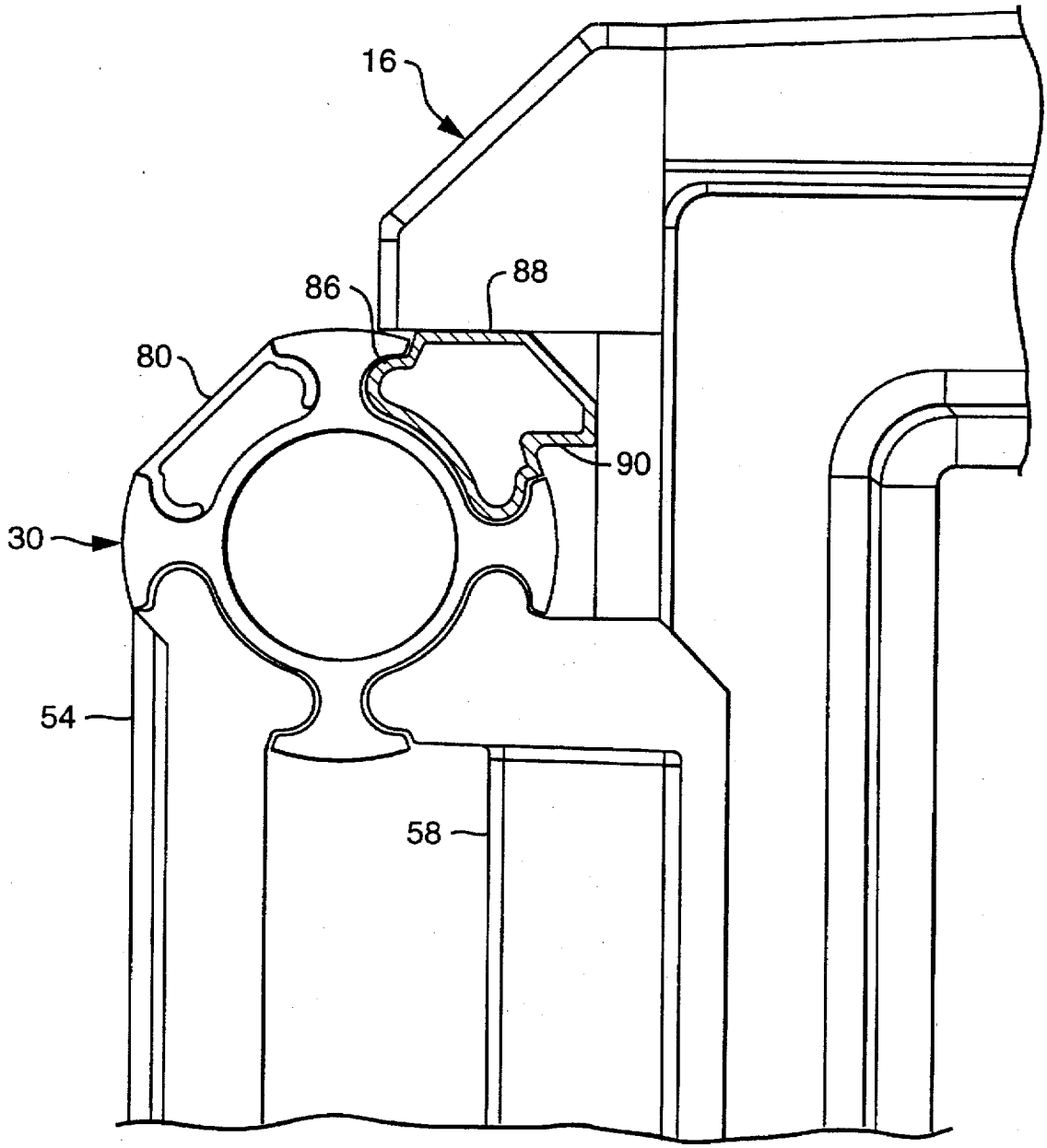
FIG. 8 fragmented top plan view of a support post in use in a front corner of the enclosed structure in accordance with the present invention.

FIGS. 7A and 8 are top views of the support posts 30 engaging side panels in accordance with the present invention. As discussed above, the side panels are top-loaded into the slots 48 of the support posts and rest on the bottom platform, or base, 62.

FIG. 7A is a partial top view of the support post 30 in use as a right rear support (with reference from the front side of the cart). Clockwise in this figure, the support post 30 secures an interior side panel 58, a back side panel 56, a blank extrusion 80 and an exterior side panel 54. The blank extrusion 80 is essentially a linear trim piece of molded plastic, preferably extending the length of the support post, that is inserted into an empty slot 48 for aesthetic purposes, i.e., to provide a finished look to the enclosed structure.

As FIG. 7A shows, each side panel is shaped to have a neck portion 82 and a head portion 84 forming each lateral end for engagement in the support post. The head portion is shaped to compliment the shape of the slots 48. In addition, each neck portion is offset from its respective panel. Using the exterior side panel 54 in FIG. 7A as an example, and using the coordinate system in FIG. 7B as a reference, the side panel has a longitudinal axis A running in the heightwise direction (in the Z-axis direction), a lateral axis B in the widthwise direction (Y-axis) and an orthogonal axis C representing its depth (X-axis). Axis C is orthogonal to both axes A and B. Likewise, the head portion 84 has its own longitudinal axis E, lateral axis F and orthogonal offset axis G. In accordance with the subject invention, the offset axis G of the head portion is transverse to the lateral axis B of the panel. In this manner, a contour fit is achieved between the panels and the support posts. As will also be appreciated, lateral axes M of the flanges 34 extend in directions either parallel with or perpendicular to the lateral axes (axis B) of the panels they secure. This arrangement allows the support posts to be visually integrated into the structure and provide a clean, aesthetically-pleasing appearance.

FIG. 8 illustrates a support post 30 in use as a right front support in an enclosed structure. In FIG. 8, the slots 48 in the support post 30 receive an exterior side panel 54, an interior side panel 58 and a blank extrusion 80 in the same manner as described above in FIG. 7A. In the remaining slot is secured a drawer-abutting extrusion 86 for abutting, e.g., a drawer 16 that is slidably received in the enclosed frame assembly. As discussed in detail below, the drawer is provided with a surface, e.g., one or more ribs, that is slidably supported on the corrugated surface 68 of the interior side panel 58. As shown in FIG. 8, the drawer-abutting extrusion 86, which is preferably a resilient plastic, includes an abutting face 88 for contacting the fully closed drawer and a locking face 90 for contacting a part of the drawer and preventing it from being accidentally pulled out.

Figure 9:
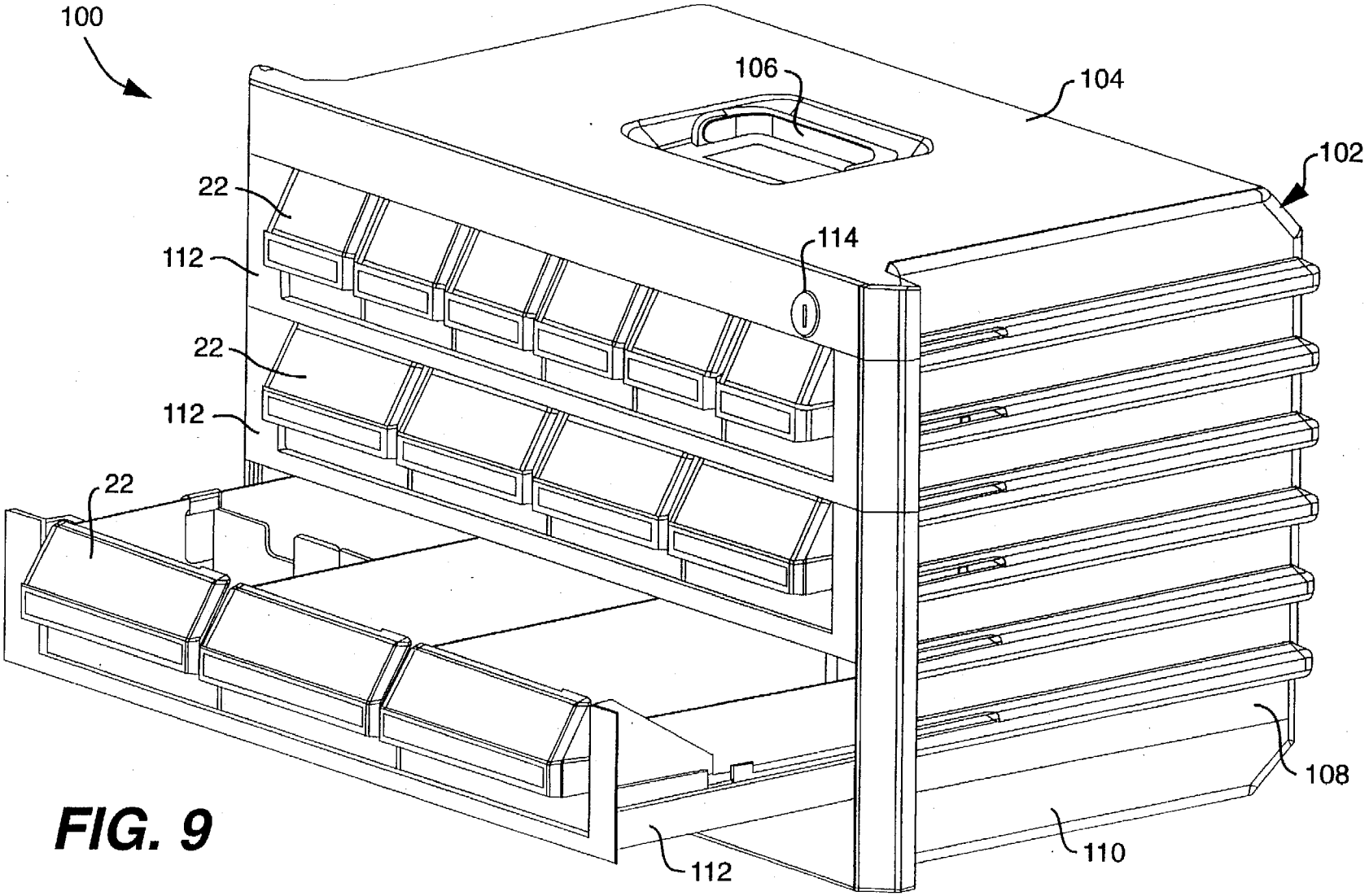
FIG. 9 is a perspective view of a multi-level cassette assembly in accordance with the present invention.
Figure 10:
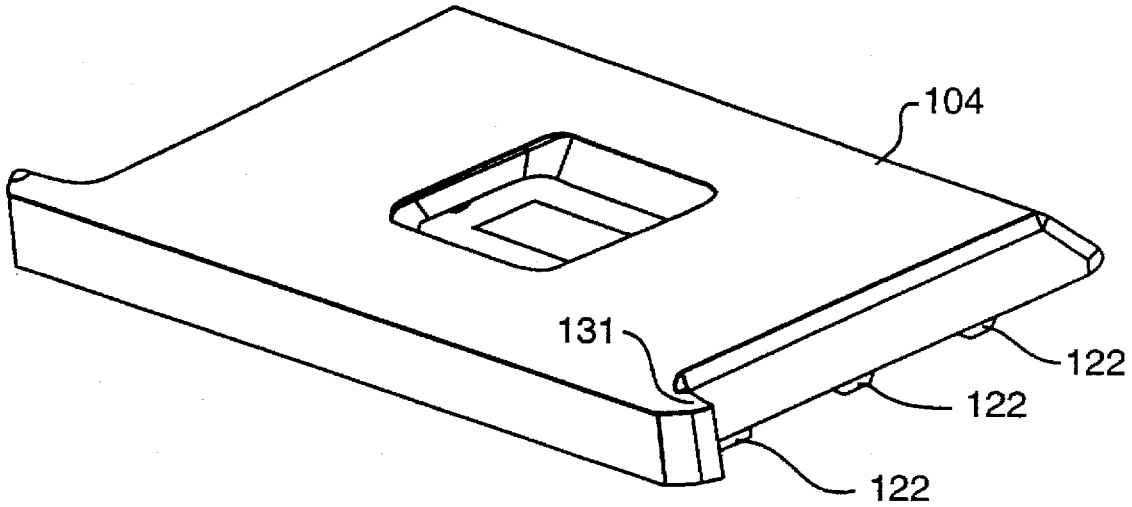
FIG. 10 is a perspective view of a top or bottom component of the cassette assembly in accordance with the present invention.

A multi-level cassette assembly 20 in accordance with the present invention is shown generally in FIG. 9. A frame 102 of the cassette assembly is formed by a top component 104, which includes a handle 106, a plurality of side panels 108, a bottom component 110 and a back panel (unshown). The bottom component can be essentially the same piece as the top component but does not include a handle. An isolated view of the top (or bottom) component 104 is provided by FIG. 10.

The multi-level cassette assembly supports a cassette tray 112 on each level, and each cassette tray contains a plurality of pull-out cassette bins 22. A lock 114, which is part of an external locking mechanism, is secured in a front face of the top assembly. While the cassette assembly in this figure provides three levels, the number of levels (which corresponds to the number of cassette trays) can of course vary without departing from the scope of the invention. The components comprising the cassette assembly are preferably made of a polymer plastic, e.g., ABS, and can be formed by conventional molding techniques.

Figure 11:
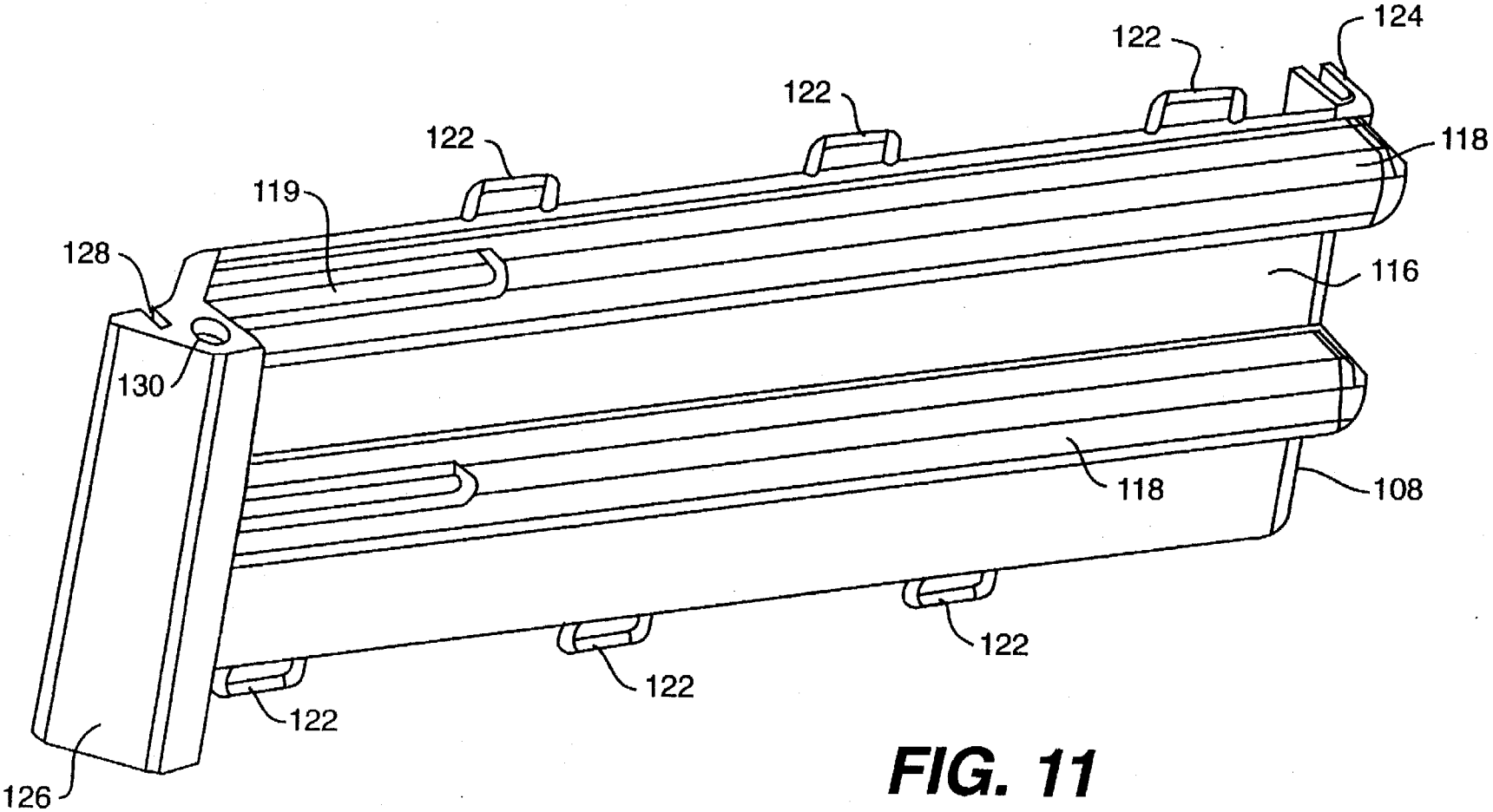
FIG. 11 is a perspective view of a right side panel of the cassette assembly in accordance with the present invention.
Figure 12:
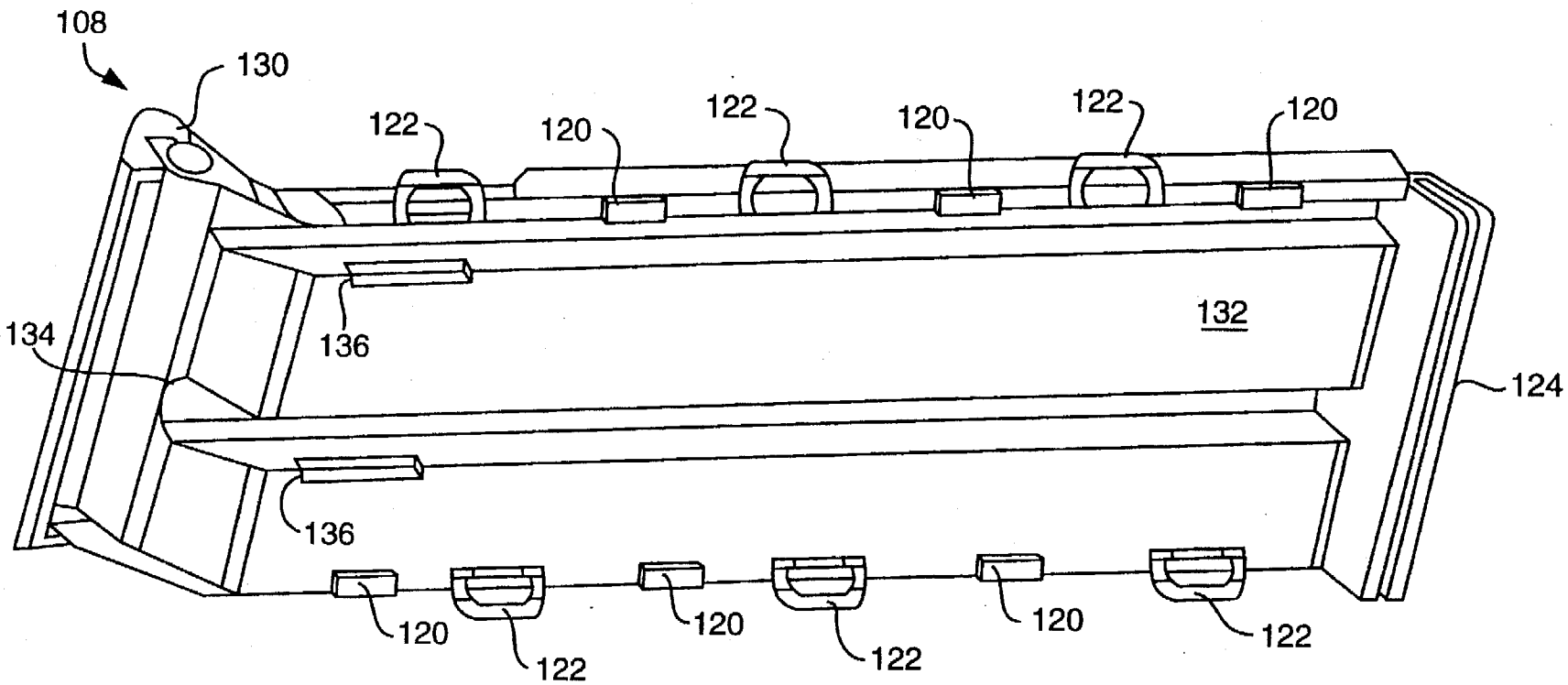
FIG. 12 is a perspective view of a left side panel of the cassette assembly in accordance with the present invention.

The side panels 108 are shown in detail in FIGS. 11 and 12, with FIG. 11 illustrating a right side panel for use on the right-hand side of the cassette assembly and FIG. 12 showing a left side panel for use on the left-hand side of the cassette assembly. A single right and left side panel are used for each level of the cassette assembly. Each side panel is preferably an integrally formed piece of molded plastic.

With reference first to FIG. 11, the side panel includes a lateral face 116 formed with two elongated ribs 118. The ribs are shaped to complement the corrugated surface of the interior side panels 58 as discussed above. At the front of each rib 118 is an open slot 119 for receiving a component of the security system which will be discussed below. The top and bottom edges of the side panel are provided with a plurality of male/female connectors 120/122 for snap-fitting the side panel to other side panels or top or bottom components when assembling the cassette assembly. The male connectors 120 are best seen in FIG. 12.

At the rear end of the side panel is formed a U-shaped panel interface 124 for receiving the flat back panel of the cassette assembly. A front edge 126 of the side panel is formed to have both an elongated slot 128 and a throughhole 130 running through it. The slot receives part of the external locking mechanism that will be described below. A hollow rod (unshown) made of, for example, aluminum is inserted through the hole and stabilizes the assembled cassette frame.

FIG. 12 best illustrates the corrugated interior surface of the side panel. Corrugations 132 form a slot 134 therebetween for receiving the cassette tray 112. Elongated recesses 136 formed in the corrugations interface with the cassette tray in a manner described below.

To assemble the frame, the side panels are snap-fitted together using the male and female connectors to provide as many levels as desired. The formed left and right sides can then be snap-fitted to the bottom component and a back panel can be fit into the panel interfaces in the side panels and into a portion of the bottom component. Hollow rods can then be loaded into the elongated holes 130 in both right and left side panels, and the external locking mechanism is positioned in the elongated slot in the right side panels. The top component can now be placed on the side walls. Screws or other fasteners are then inserted through holes 131 in the top and bottom components and into threaded ends of the hollow rods to complete the assembly.

Figure 13:
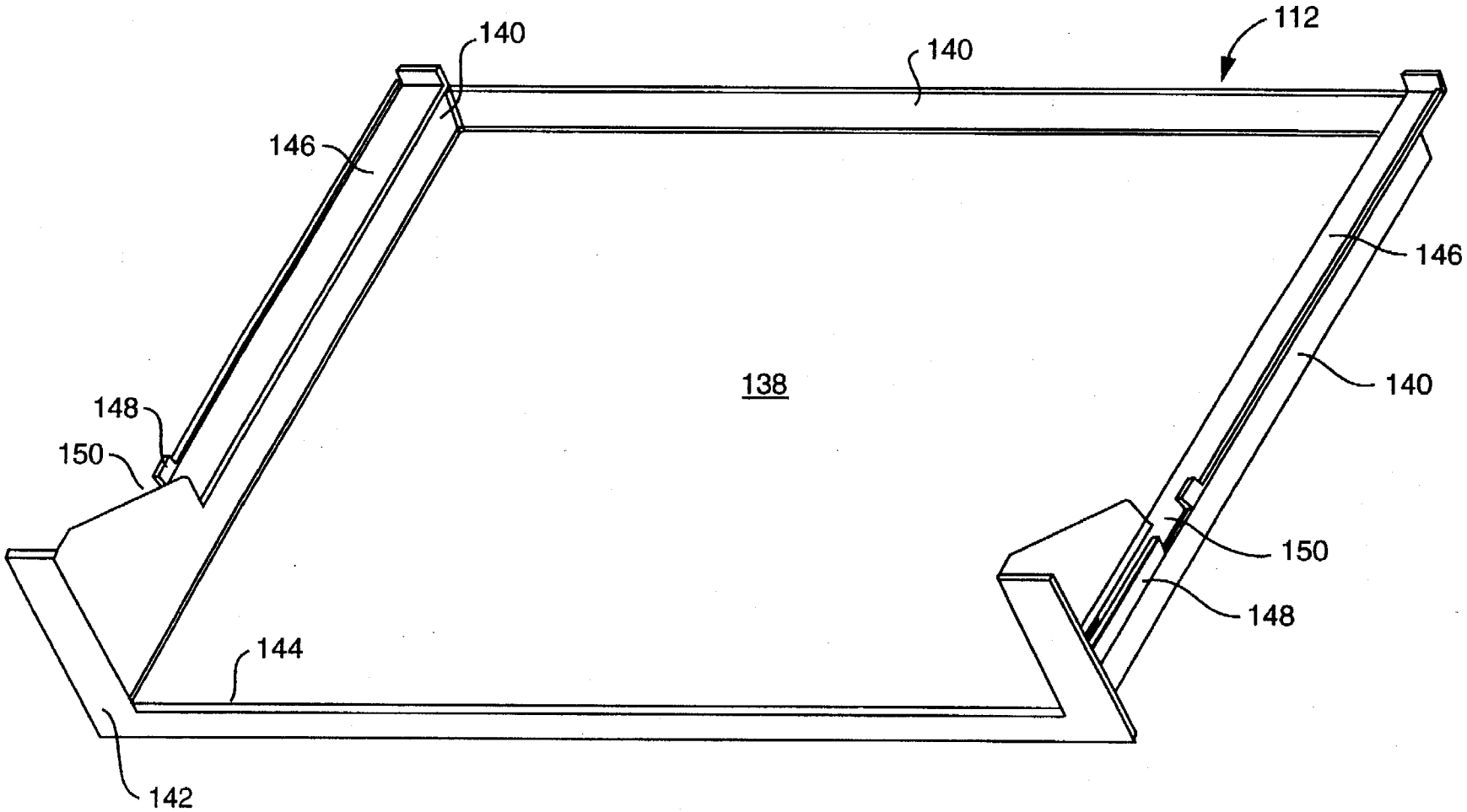
FIG. 13 is a perspective view of a cassette tray in accordance with the present invention.
Figure 14:
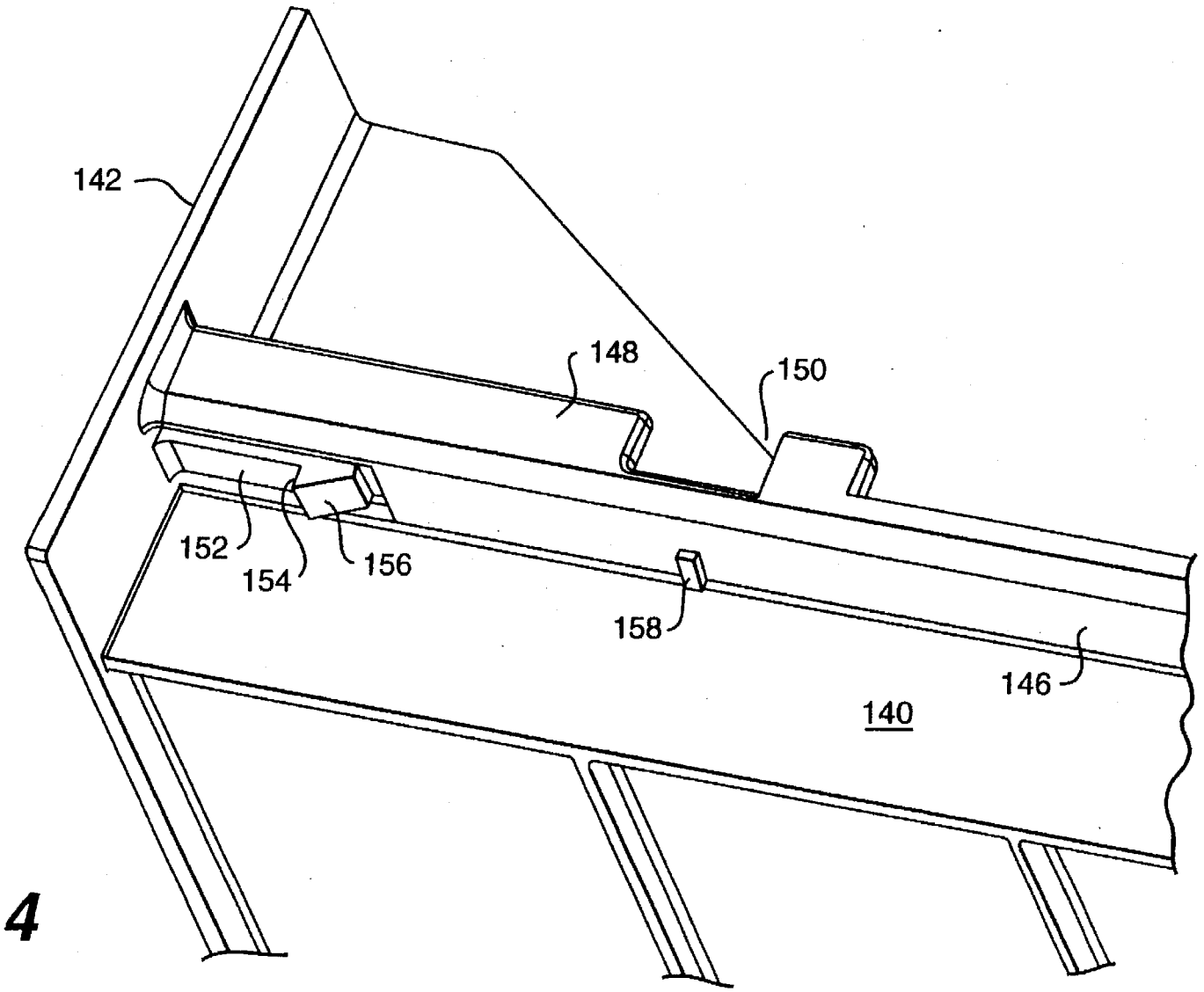
FIG. 14 is a partial perspective view of an underside of the cassette tray shown in FIG. 13.

The cassette tray 112 that is received in each level of the cassette assembly is shown in FIGS. 13 and 14. With reference to FIG. 13, the cassette tray is formed to have a flat bottom surface 138 surrounded on three sides by a vertical edge 140. At the front of the tray is a front face 142 which provides a small lip 144 at the front edge of the bottom surface 138. The edges on the left and right sides of the tray extend into horizontal ledges 146 for resting on the corrugation 132 in the side panels 108 of the frame. A channel 148 with a notched portion 150 is formed at the front part of the ledges. The notched portion is part of an internal locking assembly and will be engaged by a locking finger to secure the tray in the cassette assembly frame.

FIG. 14 shows an underside of the cassette tray and illustrates a flexible latch 152 that forms part of the external locking assembly. The latch is cantilevered from the front face and includes, at its free end, an abutting face 154 and a sloping, or angled, face 156. The sloping face allows the latch to flex upwardly when receiving a horizontal force. A small block 158 located beneath the notched portion 150 will interface with the recess 136 in the corrugation 132 and indicate a normal stop position of the cassette tray as it is withdrawn from the frame.

Figure 15:
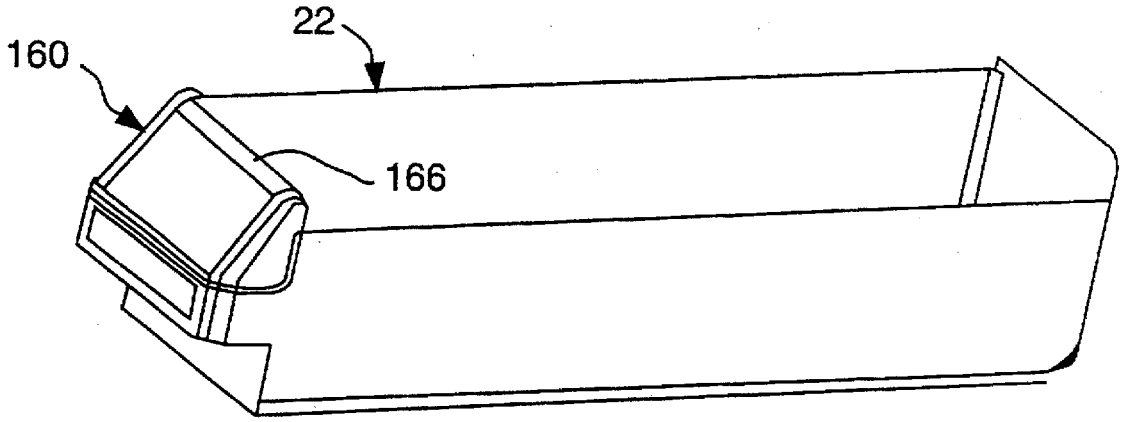
FIG. 15 is a perspective view of a cassette bin in accordance with the present invention.

The cassette tray 112 supports a plurality of bins 22 as shown in FIG. 9. The size (i.e., width) of the bins can be varied to best fit the end-user's needs. For example, FIG. 9 shows a cassette assembly with 6 bins supported on the top level, 4 bins supported on the middle level and 3 bins supported on the lower level. An individual bin 22 is illustrated in FIG. 15.

Figure 16:
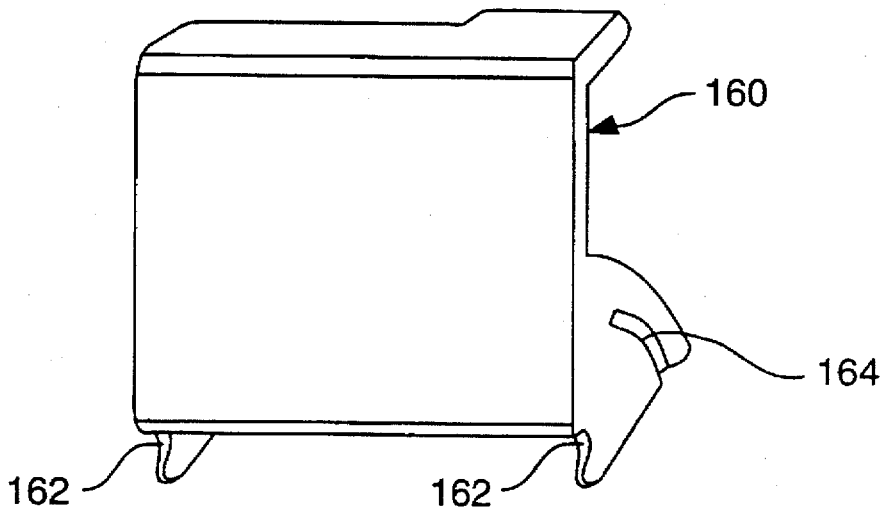
FIG. 16 is a perspective view of a label cover for the cassette bin in accordance with the present invention.

A bin label cover 160 for retaining a label on the bin 22 is shown in FIG. 16. The label cover, which is preferably formed of clear or otherwise transparent plastic, includes front notches 162 and arcuate rear grooves 164. The notches and grooves interact with small protrusions (unseen) inside the bin, and allow the label cover to pivot about the protrusions in the front notches. Identifying labels can thus be easily placed (and changed) between the label cover and a front face 166 of the bin.

Figure 17A:
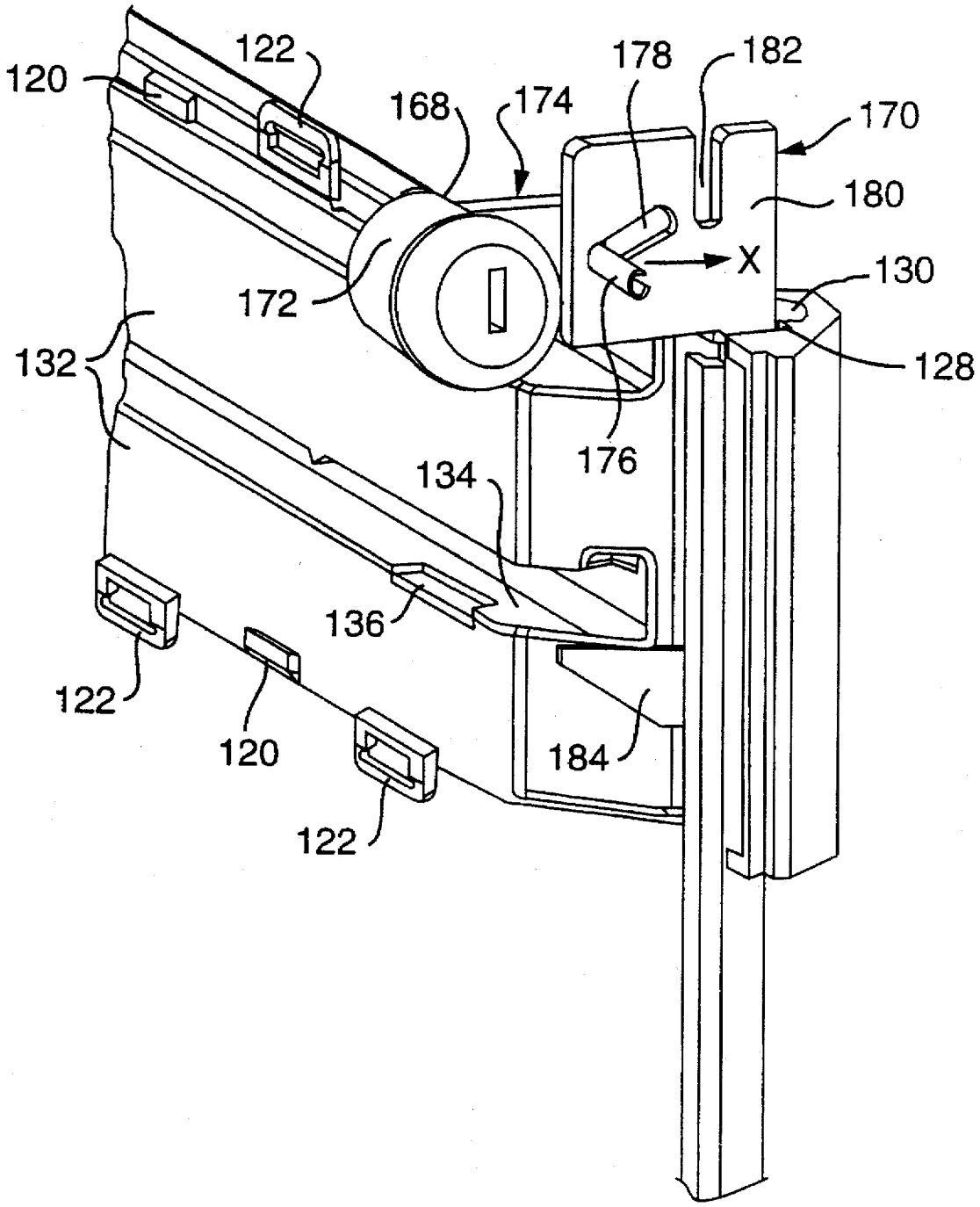
FIG. 17(A) is a partial perspective view of the right side panel and part of an external locking mechanism in accordance with the present invention.
Figure 17B:
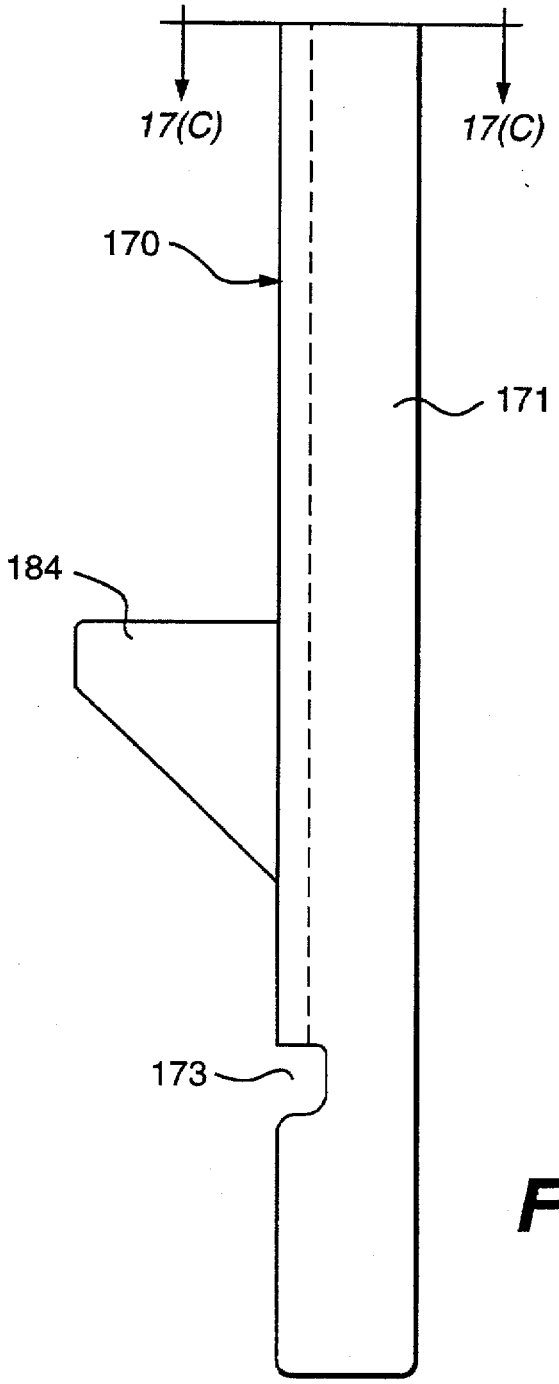
FIG. 17(B) is a partial front elevational view of a locking bar shown in FIG. 17(A) in accordance with the present invention.
Figure 17C:
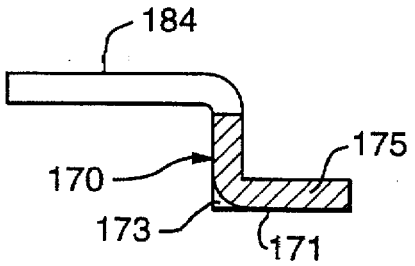
FIG. 17(C) is a cross-section of the locking bar shown in FIG. 17(B) in accordance with the present invention.

FIGS. 17(A)–17(C) show additional components of the external locking assembly. This locking assembly is designed to lock the cassette trays 112 when the cassette assembly is removed, i.e., external, from the medical cart, hence the name "external locking mechanism." An internal locking mechanism in the frame assembly secures the cassette trays when the cassette assembly is inserted in the medication cart.

With reference to FIG. 17(A), a bolt lock 168, which is mounted in the top assembly 104 as shown in FIG. 9, actuates a saw-tooth locking bar 170 to operate the external locking assembly. The bolt lock, which is conventional per se, includes a locking barrel 172 and an extended T-bolt 174 that moves in and out of the barrel when a key is inserted into the lock barrel and turned 180°. Bolt locks manufactured by the HURD LOCK Co. (H75N and H75C series), in Greeneville, Tenn., have been successfully used in the external locking assembly. Comparable assemblies besides the bolt lock could be used to actuate the locking bar without departing from the scope of the invention. A pin 176 extends from the T-bolt and engages an angled slot 178 in the flag-shaped top portion 180 of the locking bar 170. A vertical slot 182 in the top portion interfaces with the top assembly 104 to vertically guide the locking bar.

A partial front view of the locking bar 17 is shown in FIG. 17(B). The locking bar is preferably formed from metal, e.g., steel, and is shaped to include an elongated bar 171 and at least one locking tooth 184. A relief 173 is shown at the lower end for metal forming purposes (i.e., to help bend the metal). Another relief for the same purpose is provided toward the upper end of the elongated bar 171. The elongated bar is formed, e.g., bent, to have an L-shaped cross-section as evident in FIG. 17(C). A first leg 173 of the bar fits in elongated slot 128 in the side panels. Only one locking bar is normally provided in each cassette assembly and usually disposed in the right side panels. A plurality of the teeth 184 are evenly spaced along the length of the locking bar. One tooth is preferably provided for each side panel and moves, with actuation of the locking bar, in and out of a locking position. In the locking position the tooth 184 is substantially even with the lower corrugation 132 (i.e., the bottom of the slot 134).

FIG. 17(A) shows the locking bar in the up, or locked, position, whereby the tooth 184 will engage the latch 152 on the underside of the cassette tray. In this position, engagement between the tooth and the abutting face 154 of the latch will prevent the cassette tray from being withdrawn.

If the cassette tray is already withdrawn when the external locking assembly is actuated, the shape and flexibility of the latch permit the tray to be inserted into the cassette assembly frame and subsequently locked. When inserting the tray, the flexible latch will bias upwardly when the sloping face 156 slides over the tooth, thus allowing the drawer to be inserted and locked.

To unlock the cassette assembly, the bolt nut is actuated to move the T-bolt and thus the pin 176 in the direction of arrow x. This sliding movement forces the locking bar downward through a camming action between the pin and the angled slot 178. In the down position, the cassette tray is free to slide in and out of the cassette assembly frame.

The external locking assembly has been disclosed in terms of locking the cassette trays. As will be appreciated, however, locking the cassette trays effectively locks the bins and prevents access to the contents therein. By virtue of the vertical lip 144 on the cassette tray 112 and the close fit between the structure immediately above the bins, i.e., either the front face of another cassette tray or the top assembly, the individual bins cannot be withdrawn unless the cassette tray is slid out a sufficient amount, e.g., one inch, such that the bin can be lifted over the vertical lip and then slidably withdrawn. Thus, by preventing the cassette tray from being withdrawn, the bins can be securely locked.

Details of a drawer assembly for use in the medication cart are shown in FIGS. 18 through 26. In accordance with the subject invention, the drawer assembly features an open architecture type of construction which uses one standard type of drawer frame for drawers of different sizes, i.e., depths.

Figure 18:
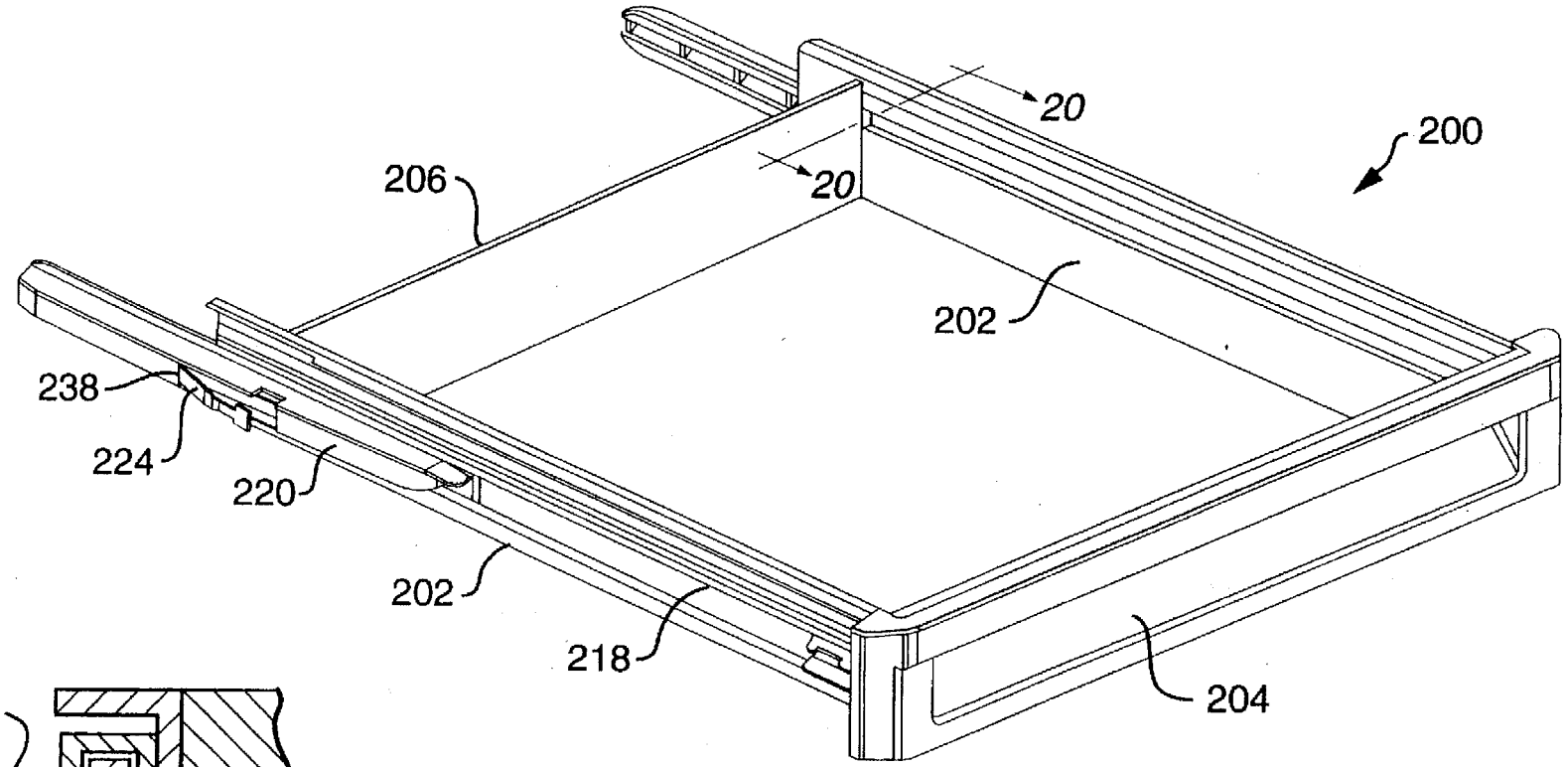
FIG. 18 is a perspective view of a drawer frame in accordance with the present invention.
Figure 19A:
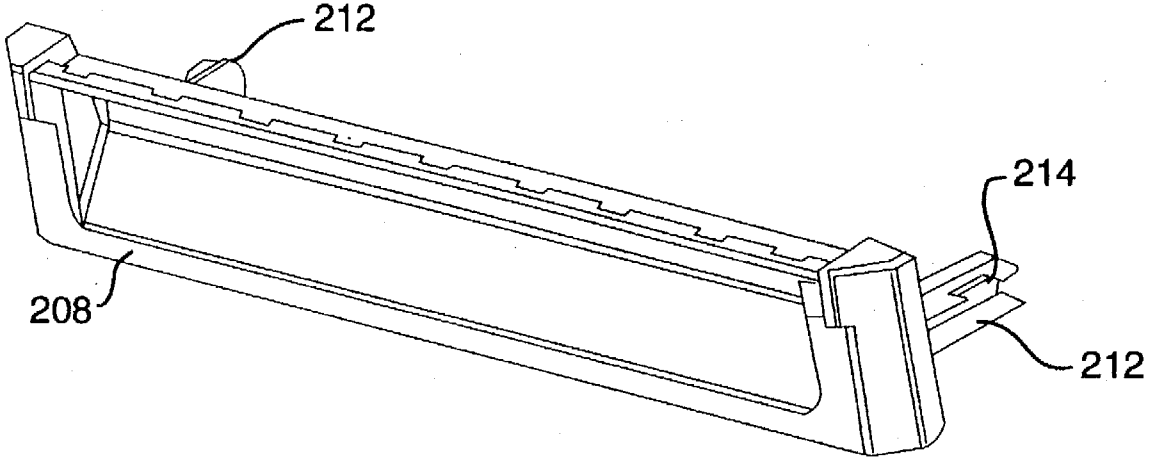
FIGS. 19(A) and 19(B) are perspective views of front panel parts of the drawer frame in accordance with the present invention.
Figure 19B:
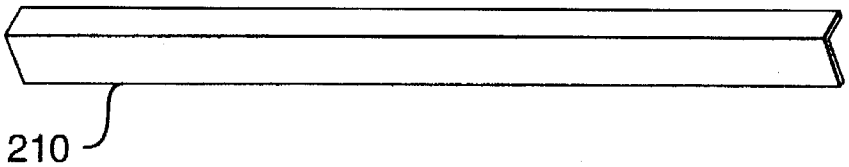

A standard drawer frame 200 is shown in FIG. 18 to include two side panels 202 fastened between a handle drawer front 204 and a rear panel 206. The handle drawer front 204 is shown in isolation in FIGS. 19(A) and 19(B). The front handle section, which is preferably molded plastic, is actually formed from two pieces for ease of production: a recessed front face 208 and a handle 210. The recessed front face 208 shown in FIG. 19(A) includes opposite arms 212 that are secured, such as by threaded fasteners, to the side panels 202 of the frame. Each arm 212 includes a notched channel 214 for receiving a locking finger as discussed in detail below. The notched channel 214 permits the drawer assembly to be securely locked in the enclosed structure. The plastic handle 210, as shown in FIG. 19B, is snap-fitted to the front face to complete the front handle section.

The side panels and rear panel are formed of, for example, aluminum, and secured to each other by common fasteners 216, such as screws. Each side panel includes a formed channel 218 on its exterior surface for slidably receiving a drawer glide 220. The drawer glide, by virtue of its elongated, rectangularly-shaped outer side, slides between the corrugations 70 in the interior side panels 58 to support the drawer assembly in the enclosed frame assembly.

Figure 20:
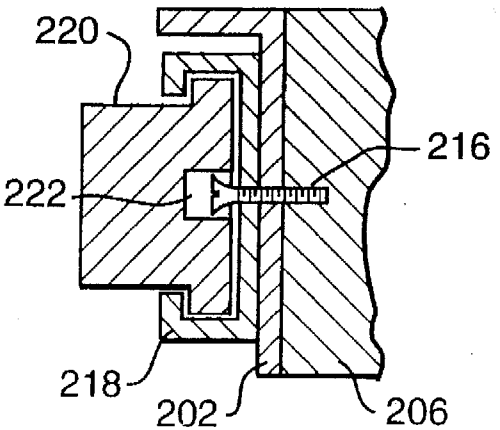
FIG. 20 is partial cross-sectional view of the drawer frame along lines 20—20 in FIG. 18 in accordance with the present invention.

As best seen in FIG. 20, which depicts a cross-section of the drawer glide 220 and the side panel, the drawer glide has a T-shaped cross-section which complements the shape of the channel 218. The drawer glide is also provided with a cut-out notch 222 in its back surface. The notch extends from a rear end of the drawer glide to an intermediate, e.g., halfway, point of the drawer glide. The notch allows the drawer glide 220 to slide over the head of the screw 216 up to the intermediate point where the notch terminates. By allowing the drawer glide to slide relative to the side panel 202, the drawer frame can be pulled further out of the enclosed frame assembly to allow better access to the contents in the drawer. The intermediate end of the notch limits the relative movement between the drawer glide and the side panel to prevent the drawer glide from sliding out of the drawer frame.

Figure 21:
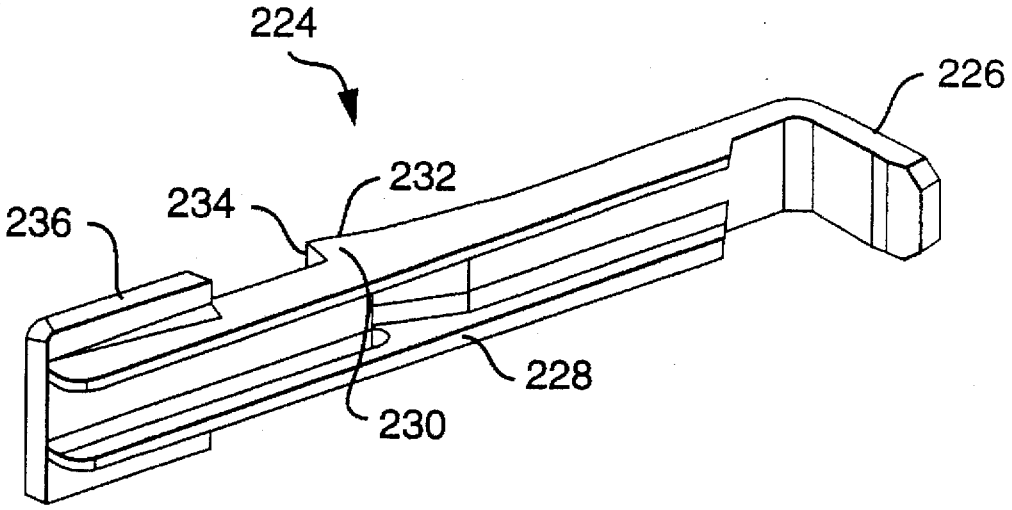
FIG. 21 is a perspective view of a drawer clip in accordance with the present invention.
Figure 22:
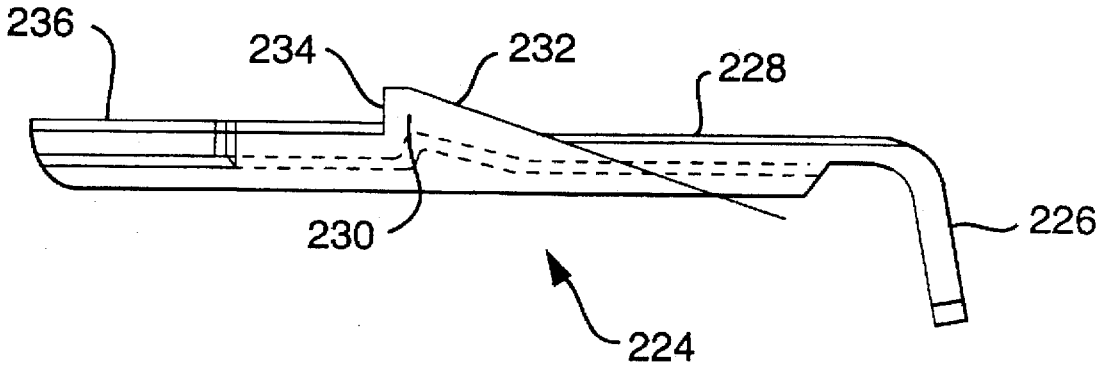
FIG. 22 is a top view of the drawer clip shown in FIG. 21 in accordance with the present invention.

A drawer clip 224 as shown in FIGS. 21 and 22 is provided in each drawer glide 220 to prevent the drawer assembly from accidentally being pulled completely out of the medication cart. With reference to these figures, the integral drawer clip 224 is molded from a non-rigid plastic, such as nylon, to have a short leg 226 and a long leg 228. The long leg is formed with a stop 230, that includes a ramped portion 232 and an abutting face 234, and a finger tab 236. The long and short legs meet to form an angle of approximately 100°, as best seen in FIG. 22, with the short leg fitting into an opening, such as slot 238, in the drawer glide.

Figure 23:
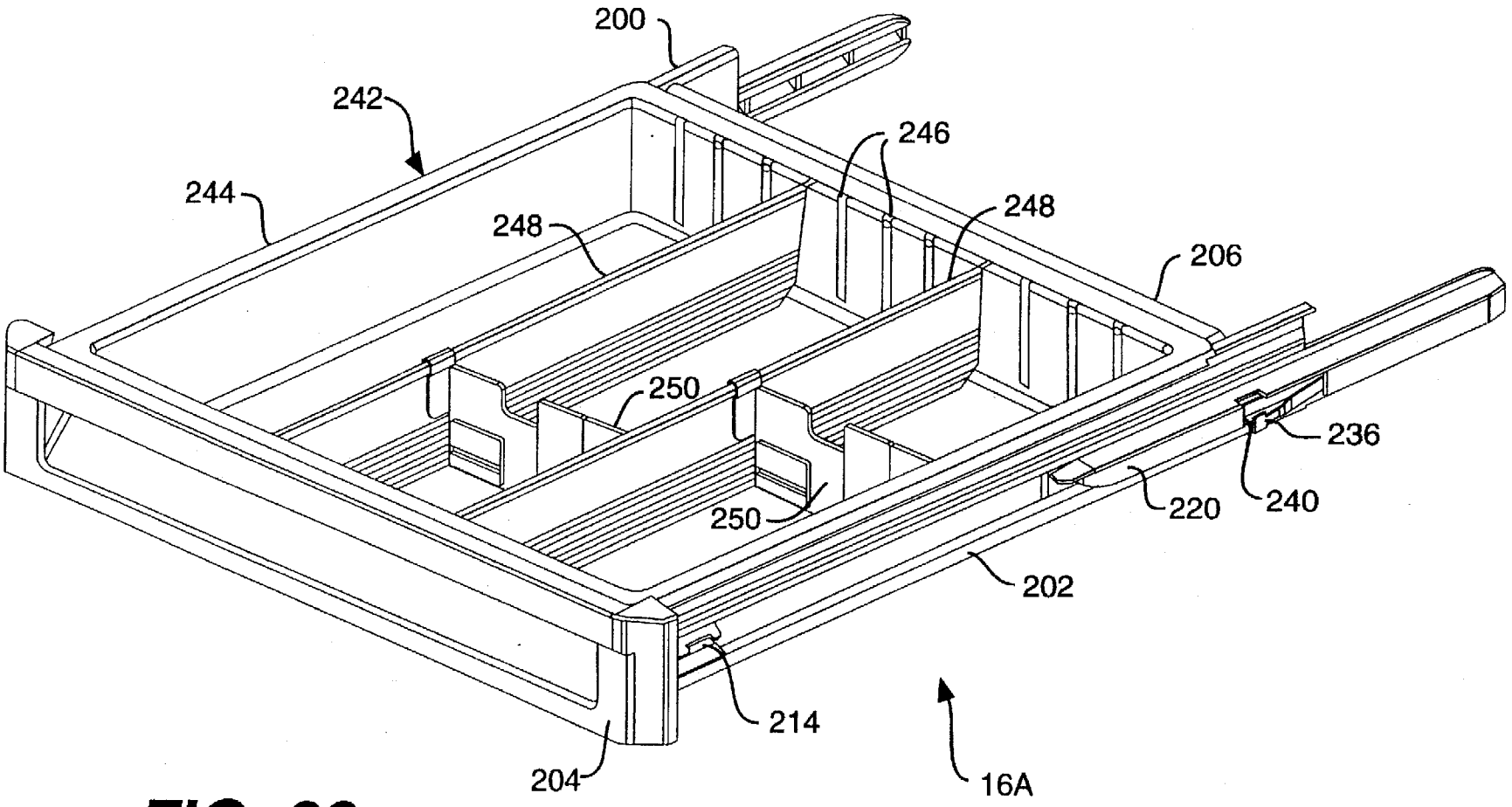
FIG. 23 is a perspective view of a single-depth drawer assembly in accordance with the present invention.
Figure 24:
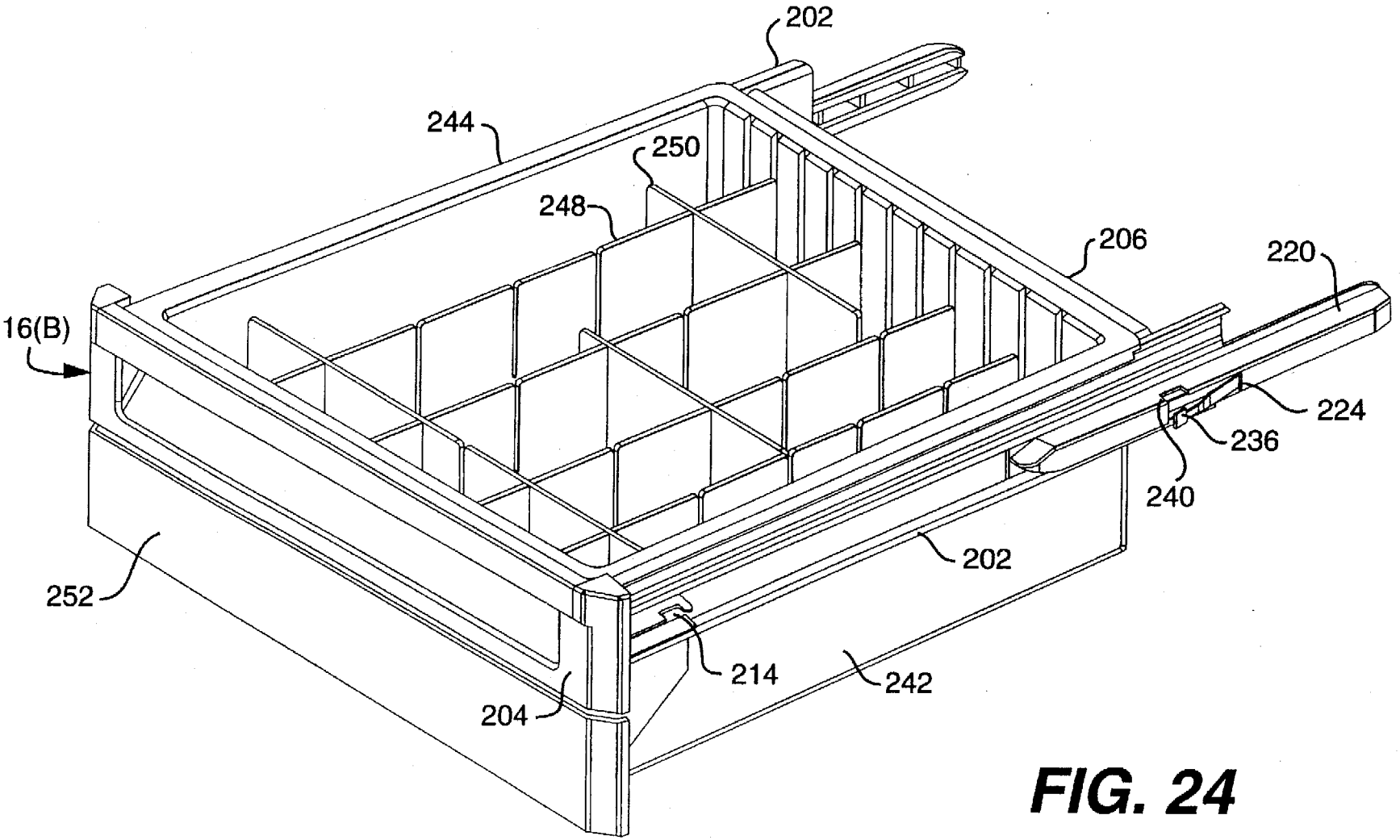
FIG. 24 perspective view of a double-depth drawer assembly in accordance with the present invention.
Figure 25:
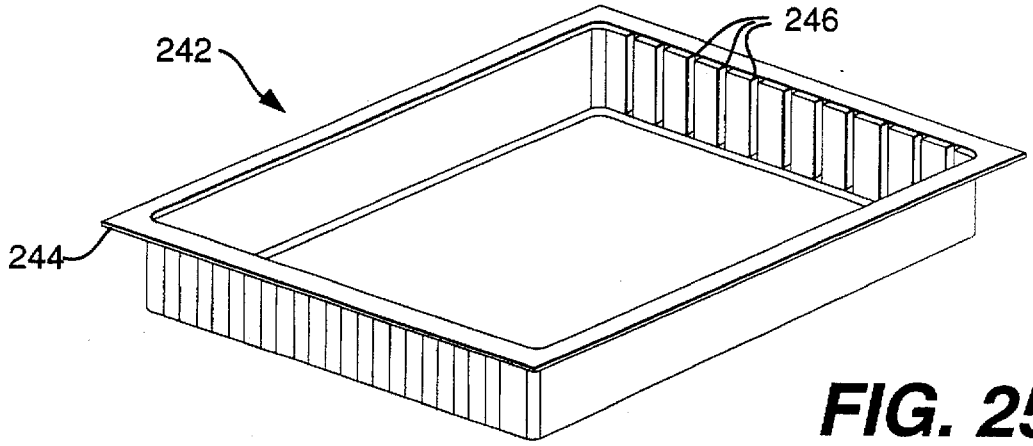
FIG. 25 is a perspective view of a drawer insert for use in the drawer assembly in accordance with the present invention.

As shown in FIGS. 23 and 24, when the drawer clip is positioned in the drawer glide 220, it is almost flush therewith, except for the stop 230, which extends outwardly a short distance, e.g., ⅛." When pulling out the drawer assembly, the drawer glides slide along the corrugated side panel until the abutting face 234 of the stop 230 abuts the locking face 90 of the drawer-abutting extrusion 86 (see FIG. 8), at which point the drawer cannot be slid out further until the finger tabs 236 on each drawer clip are depressed into a recess 240 in the drawer glide. Depressing the finger tabs withdraws the stop and allows the drawer clips to pass by the drawer-abutting extrusions. Reinserting the drawer assembly is unimpeded because contact between the ramped portion 232 of the drawer clip 224 and the drawer-abutting extrusion biases the drawer clip inwardly, making it possible to slide in the drawer.

FIGS. 23 and 24 further illustrate the open architecture type of drawer assembly. A single-depth drawer 16(A) in FIG. 23 shows a drawer insert 242, which is essentially a 4-sided bin, supported on the drawer frame 200. An isolated view of the bin 242 is provided in FIG. 25. The drawer insert includes a lip 244 for resting on the side and rear panels of the drawer frame, and can also include slots 246 for receiving optional bin dividers 248. Additional lateral dividers 250 can be positioned on the bin dividers 248 to further divide the drawer insert. One type of lateral divider is shown in FIG. 26 and is discussed below.

In accordance with the invention, the drawer insert 242 can be of any desired depth. However, when the drawer insert is deeper than the handle drawer front 204 of single-depth drawer 16(A), the standard drawer frame 200 is supplemented with one or more blank drawer fronts 252. For example, FIG. 24 shows a double-depth drawer 16(B), so-called because two-front sections a handle drawer front 204 and a blank drawer front 252, are secured together to form the front of the drawer assembly.

For simplicity, drawer inserts 243 can be provided in standard depths of, for example, 3", 6" and 9". Each drawer front is sized to cover a 3" depth of the drawer insert. Therefore, a handle drawer front would be used with a 3" deep drawer insert, a handle drawer front and a blank drawer front would be used with a 6" deep drawer insert, and so on. For drawer assemblies of 6" and 9", a gusset 254 can be secured between the blank drawer front(s) 252 and the side panels 64 on each side of the drawer frame for additional rigidity.

Figure 26:
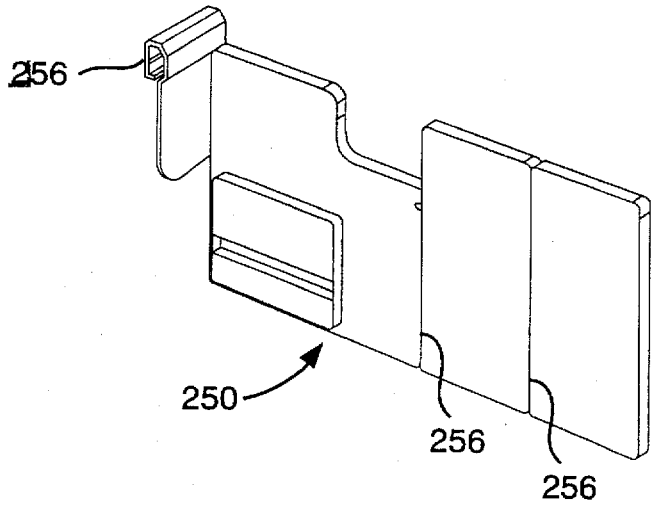
FIG. 26 is a perspective view of a lateral divider for use in the drawer insert in accordance with the present invention.

The lateral divider 250 shown in FIG. 26 includes a U-shaped cap 256 for fitting over a longitudinal divider 248 and scored sections 258 that can be snapped off where appropriate to adjust the length of the lateral divider.

Figure 27:
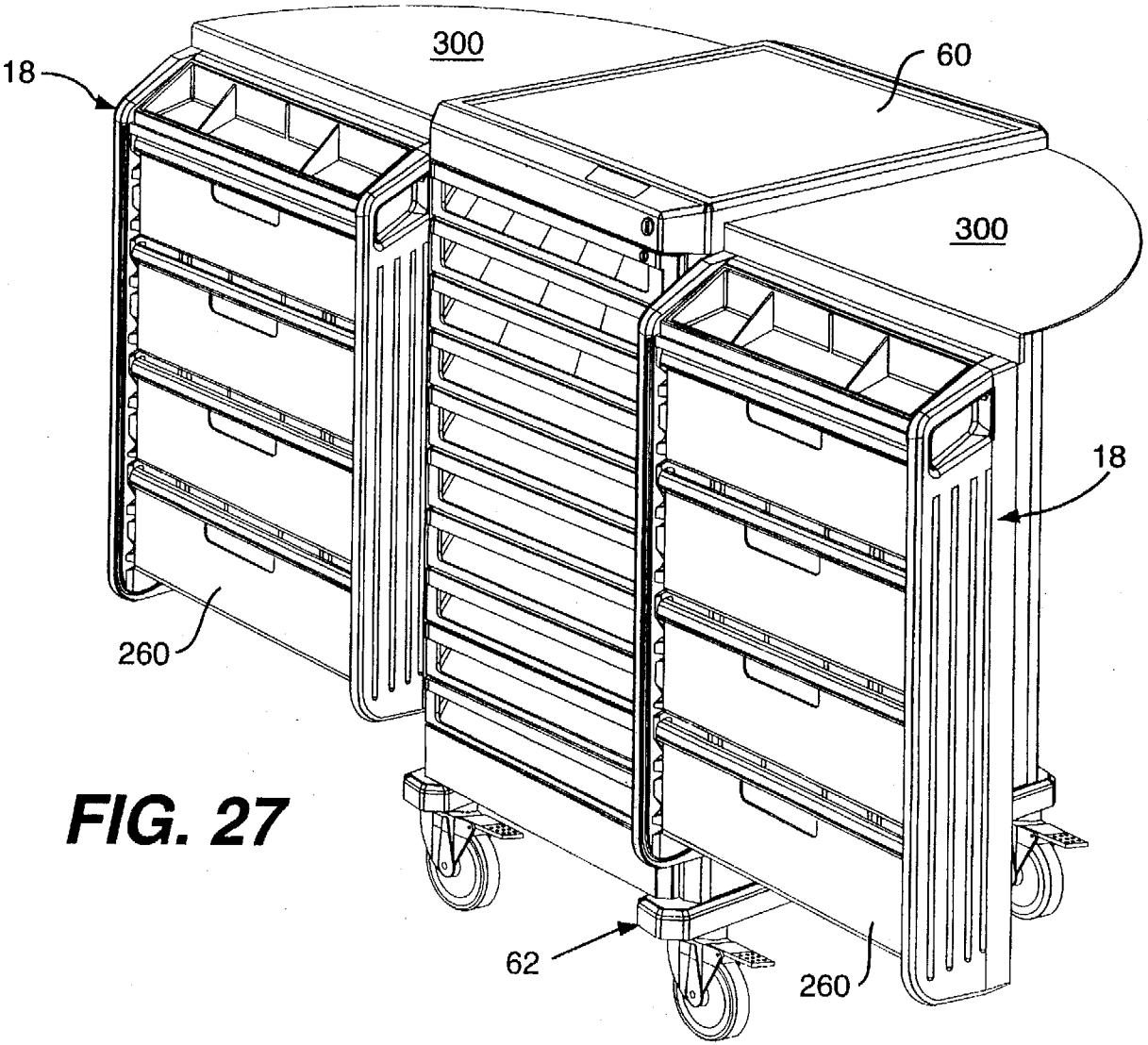
FIG. 27 is a perspective view of the medication cart with the side pods open in a swing-out position in accordance with the present invention.

The side pods 18 are preferably secured to the medication cart by a hinge, such as a conventional piano hinge, so they can swing open toward the front of the cart. In FIG. 1, the side pods 18 are closed and positioned to rest against the sides of the cart. FIG. 27 shows the hinged side pods 18 in the open position, with bins 260 in the side pods flanking the front side of the cart.

Figure 28:
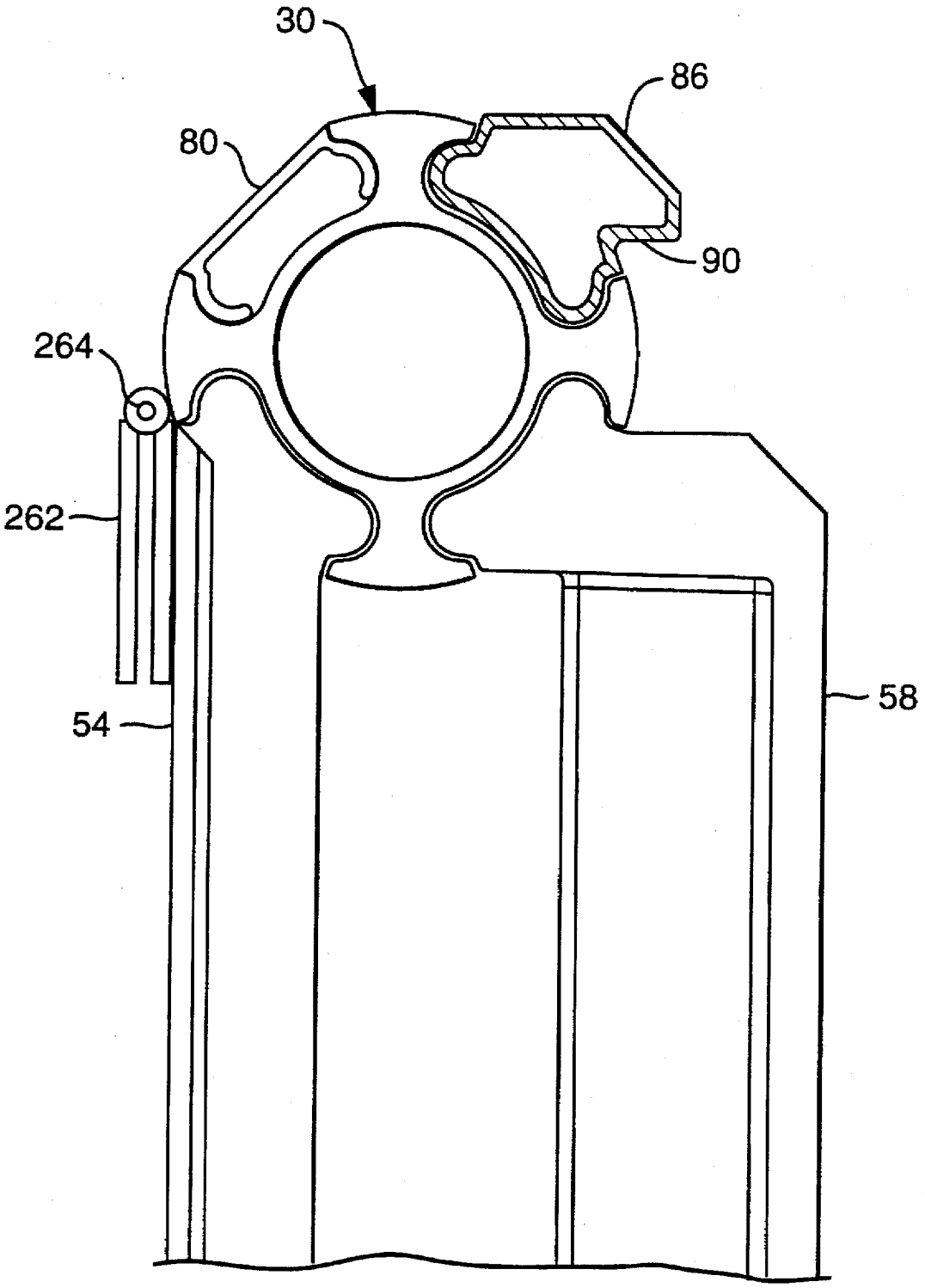
FIG. 28 is a fragmented top view of a support post in use in a front corner of the enclosed structure in accordance with the present invention.

FIG. 28 is a top view of the front right corner of the medication cart and illustrates a hinge 262 secured to the exterior side panel 54. The hinge mounts a back panel of the side pod 18 to the exterior side panel 54 and allows the side pod to pivot about hinge pin 264 to swing toward the front of the cart. Also shown in FIG. 28 is the interior side panel 58, drawer-abutting extrusion 86, blank extrusion 80 and, of course, the flanged support post 30.

Figure 29:
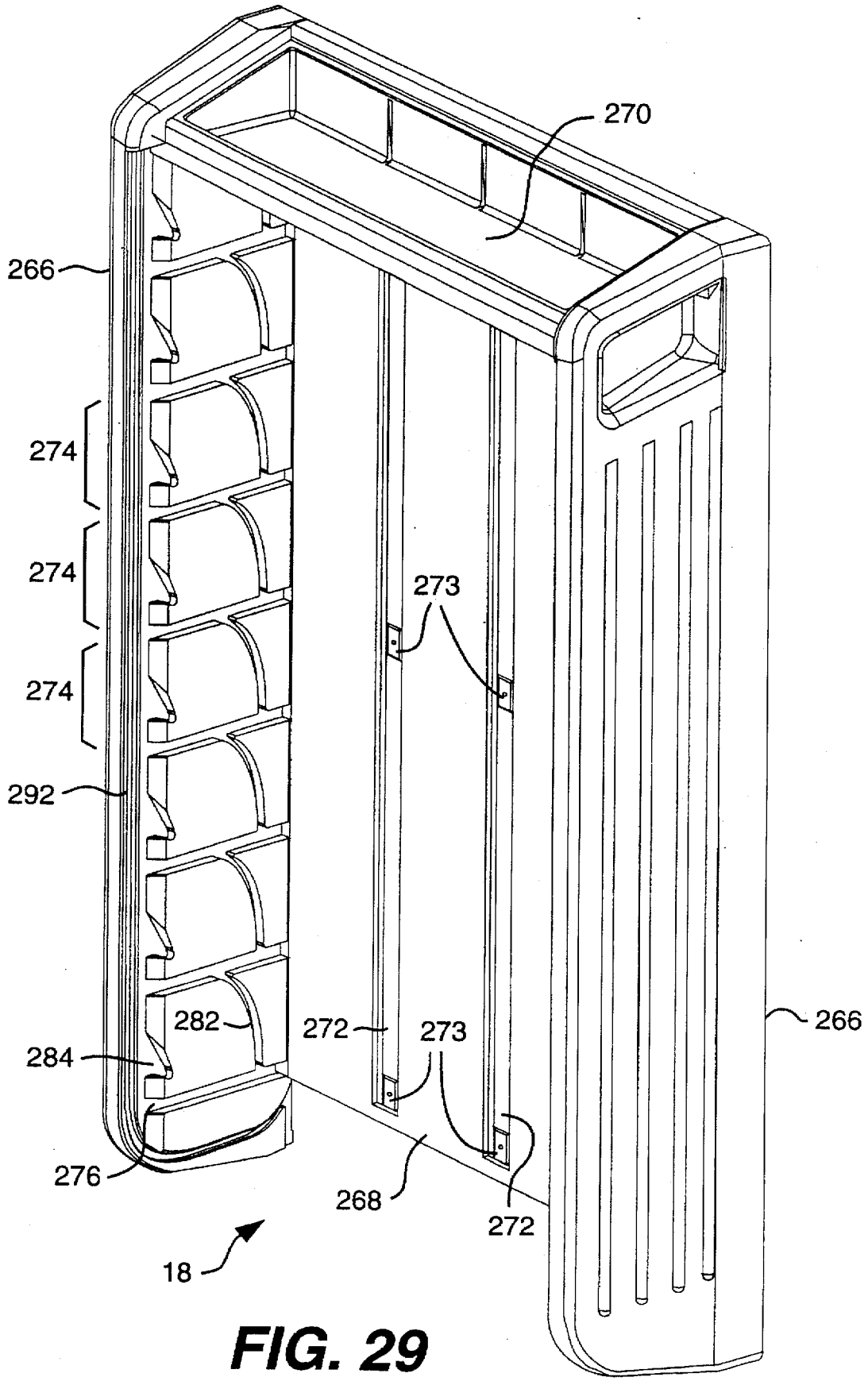
FIG. 29 a perspective view of an empty side pod in accordance with the present invention.
Figure 30:
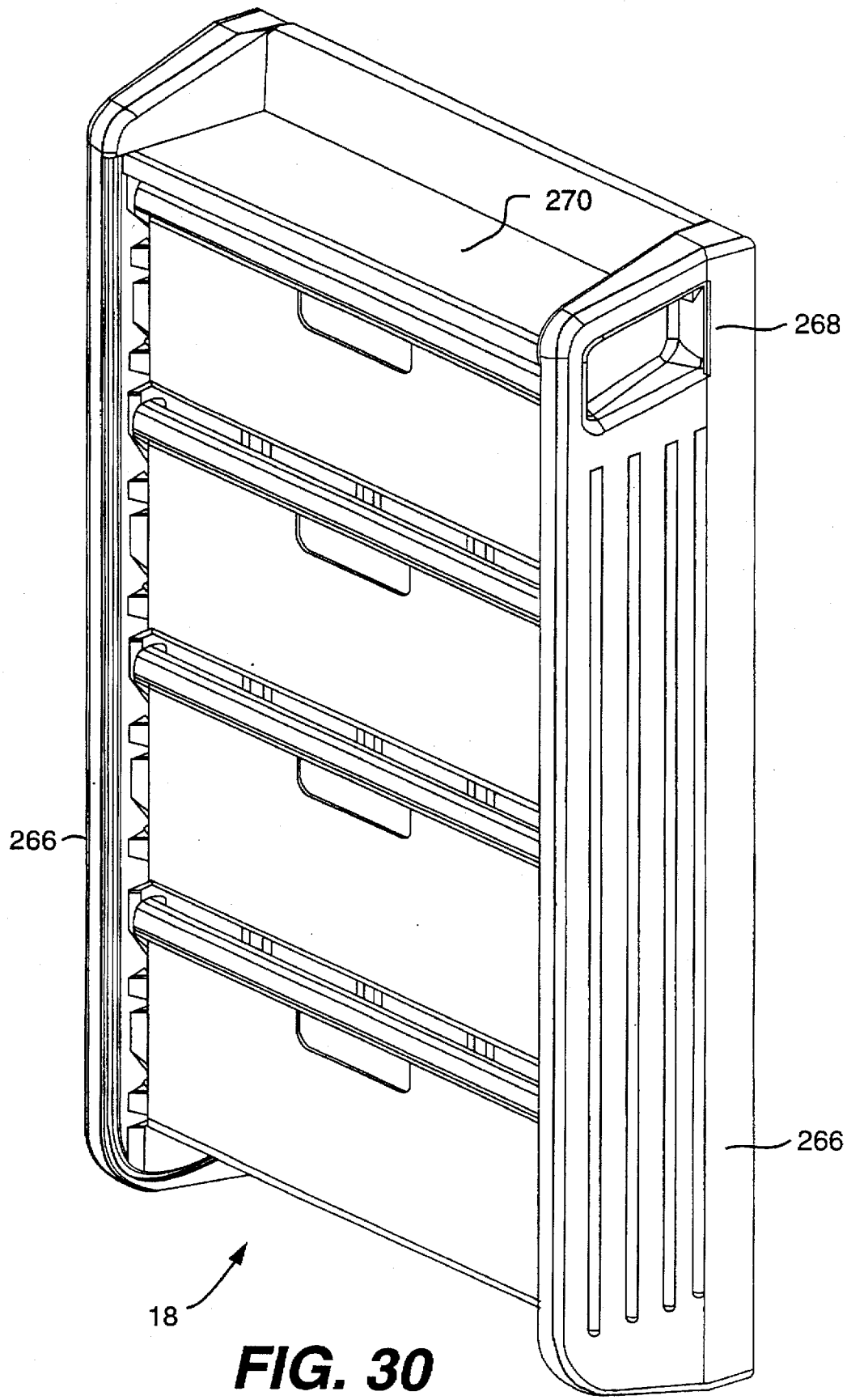
FIG. 30 is a perspective view of the side pod loaded with bins in accordance with the present invention.

As best seen in FIGS. 29 and 30, the individual side pod is formed from two side panels 266 secured to a back panel 268. A utility shelf 270 is positioned between the two side panels. The side and back panels are preferably blow molded and secured to each other by conventional fasteners. The back panel is formed to have a plurality of vertical slots 272 in its interior surface. The slots can be provided with tabs 273 for securing, for example, an unshown horizontal rail for supporting medical instruments, tools, and other accessories. As an additional feature, a vertical support (unshown), or bracket, can be key-fitted in a tab for supporting a partial-length horizontal shelf.

Figure 33:
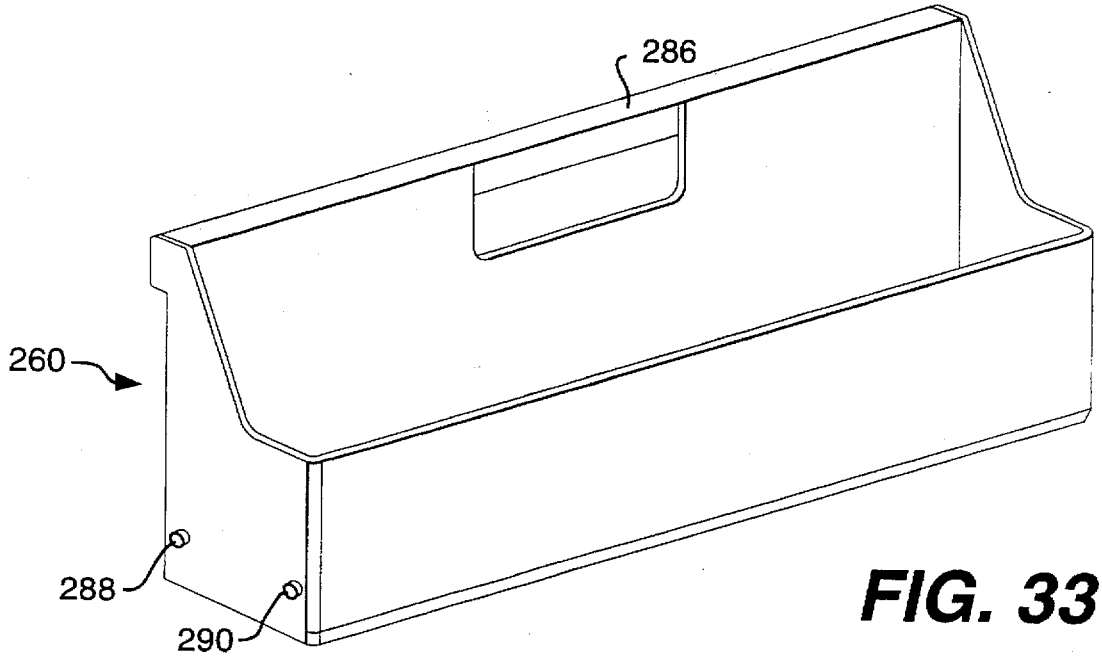
FIG. 33 is a perspective view of a bin for use in the side pods in accordance with the present invention.
Figure 31:
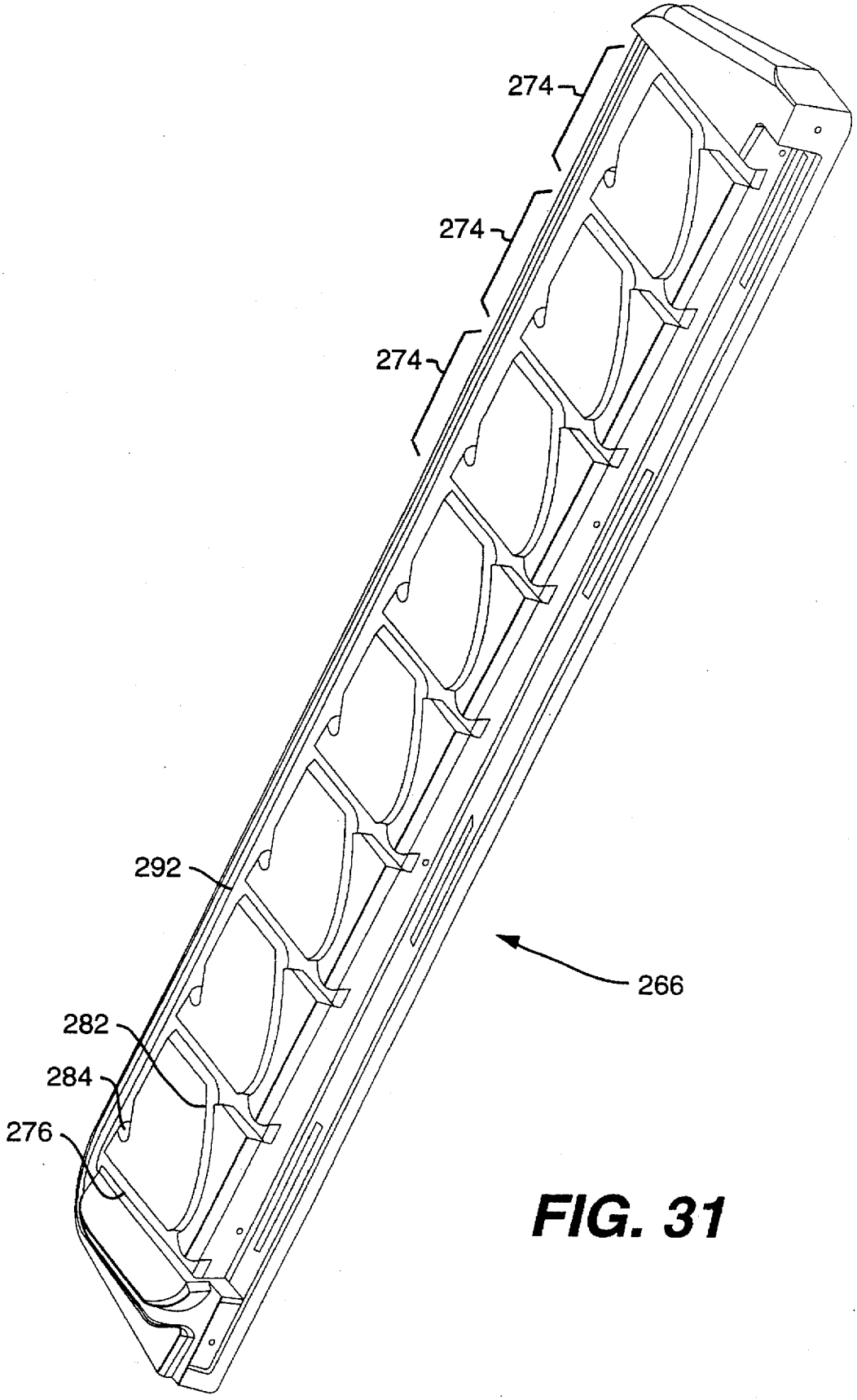
FIG. 31 is a perspective view of a molded side panel of the side pod in accordance with the present invention.
Figure 32:
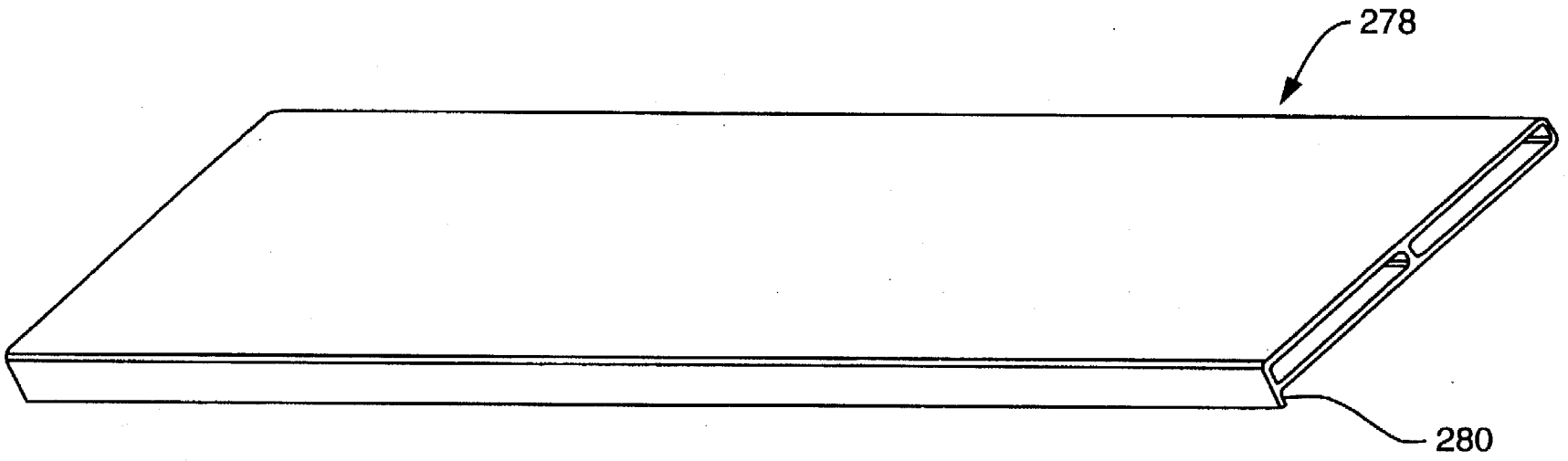
FIG. 32 is a perspective view of a shelf for use in the side pod in accordance with the present invention.

With reference to FIG. 29 and the isolated view of a side panel 266 in FIG. 31, the interior surface of the side panels 266 are formed to have a vertical array of molded, or configured, sections 274. Each molded section includes a horizontal slot 276 for supporting, as an example, a horizontal shelf 278, which is molded, or more particularly extruded, as shown in FIG. 32. The plastic shelf 278 is reversible and can be provided with a lip 280 along its front edge. In this manner, one side of the shelf provides a smooth, flat surface and the other side of the shelf uses the lip as an edge to help retain items supported on the shelf. Each molded section also includes a rear arcuate slot 282 and a front notch 284 for receiving a bin 260 of the type shown in FIG. 33.

The bin 260 includes a handle 286 and two sets of pins 288 and 290 extending from the lower lateral sides of the bin. For reference purposes, the first set of pins 288 is disposed directly below the handle and the second set of pins 290 is disposed opposite to the first set. To insert the bin in a frontward position, i.e., with the handle on the outside, the bin is tilted to place the first set of pins 288 in the notches 284 and the second set of pins 290 is guided into the arcuate slots 282. The bin can then be rotated into the cabinet to rest in an upright position. In this position, the bin can be tilted outwardly by holding the handle and rotating the bin about the first set of pins 288. The bin can also be mounted in a rearward position, i.e., with the handle on the inside of the cabinet, to provide a deep shelf. To achieve this position, the second set of pins 290 are first inserted into the notches 284 and the bin is tilted inward, with the first set of pins sliding in the arcuate slots 282.

Figure 35:
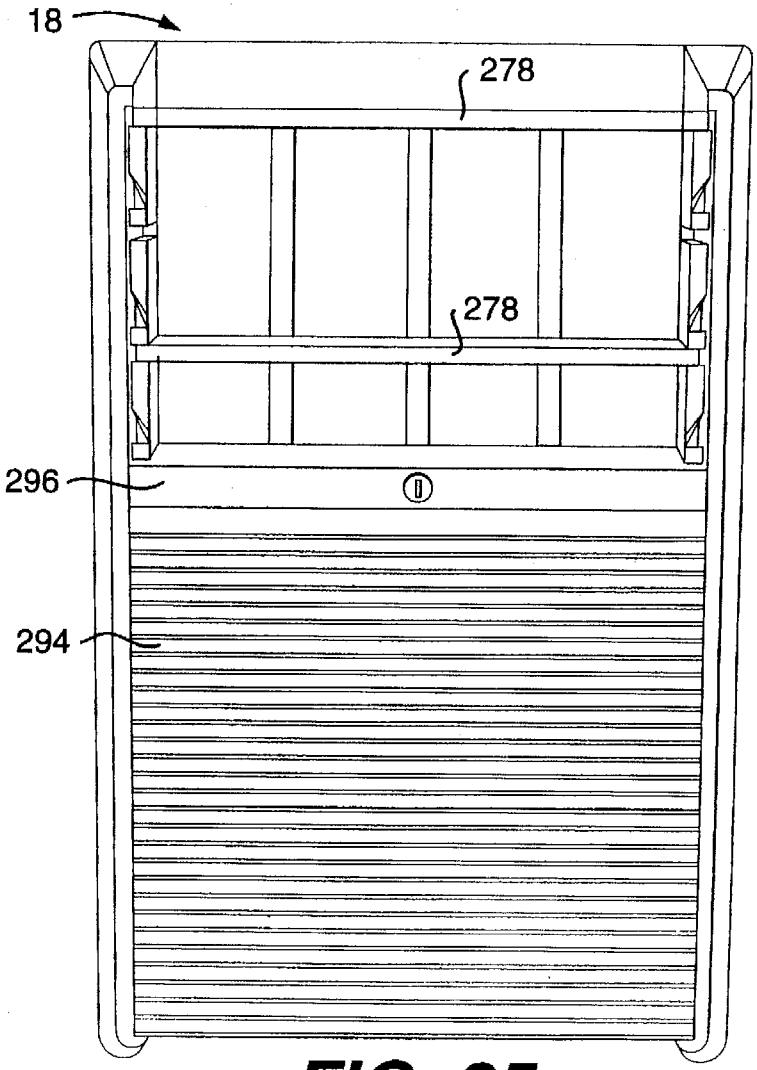
FIG. 35 is a perspective view of the side pod with a door in accordance with the present invention.
Figure 34:
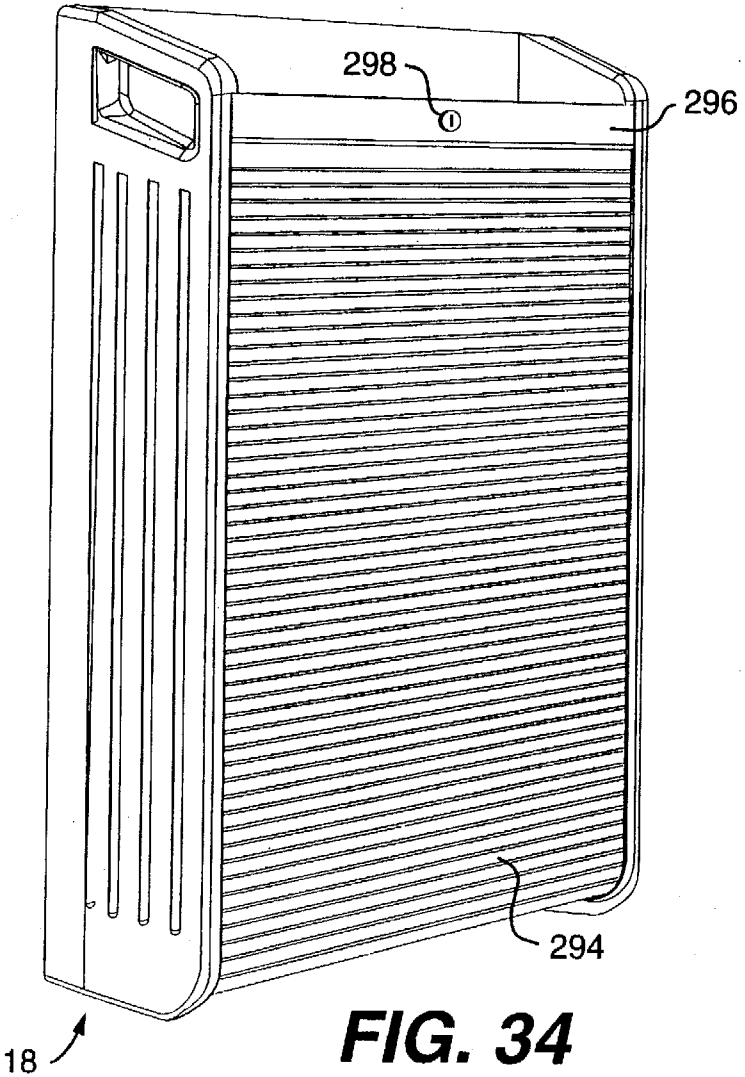
FIG. 34 is a perspective view of the side pod with a door in accordance with the present invention.

The side panels 266 also include a groove 292 running along the front inner edge for receiving a door 294, such as a tambour door, as shown in FIG. 34. The tambour door, per se, is conventional and, as known, can be formed from a plurality of parallel sections joined together such as to exhibit flexibility in one direction and rigidity in a perpendicular direction. FIG. 34 shows the door secured to a locking shelf 296 positioned in an uppermost horizontal slot 276 in the side pod. The locking shelf can be formed by modifying the shelf 278 shown in FIG. 32 to provide a slightly enlarged front edge for housing a simple manual locking mechanism 298 such as a key lock and a rotatable locking finger (unshown) for securing the tambour door. The locking shelf can be easily located in any horizontal slot in the side panels for altering the portion of the cabinet which can be secured to best fit the user's needs. For example, FIG. 35 shows the locking shelf 296 disposed at approximately the mid-portion of the side pod.

Another feature of the swing-out side pods is the provision of a swing-out work surface 300 that provides additional work space when the side pods are in the open position. As shown in FIG. 27, the work surface is substantially a flat shelf, preferably a quarter-circle in shape to maximize the work surface area, and is secured to a top portion of the back panel of each side pod. When the side pods are closed, the work surface slides under the top platform 60 of the cart and out of sight. Since both side pods are preferably equipped with swing-out work surfaces, these work surfaces are secured at slightly different vertical heights on their respective side pods so they will avoid each other when sliding under the top platform.

While the side pod is ideally suited to be swingably mounted to a medication cart as discussed above, it can also be mounted to the sides of the cart so as not to swing and, as additional non-limiting examples, mounted to a wall, a work station, or a stationary cabinet. The side pod could also be provided on its own wheeled cart or caddy.

An internal locking assembly, or security system, with both manual and electric controls can be provided in the frame assembly to lock and secure the drawers and cassette assembly. In one application, the medication cart is used to store and transport items such as drugs or other medicine, surgical tools, etc. in the drawers and cassette assembly that should be secured to prevent unauthorized use or consumption. Generally speaking, the security system features an elongated locking bar disposed in one of the interior side panels 58. The locking bar is moved up and down along its vertical axis to actuate locking fingers, housed in the corrugations, to engage and lock the individual drawers and the cassette assembly.

The security system is housed, for the most part, in the interior side panel 58. With reference back to FIG. 6, a recessed pocket 76 on the interior side panel 58 receives and secures therein an electric motor, an electronic control card and a backup battery (all unshown in this figure). The locking bar is positioned in an extended locking finger clearance pocket 78 formed in the rear side of the interior side panel. Two of these clearance pockets can be provided in the side panel, as shown in FIG. 6, to provide the option of mounting the locking bar in either side of the panel. However, only one locking bar is normally mounted in the side panel.

Figure 36:
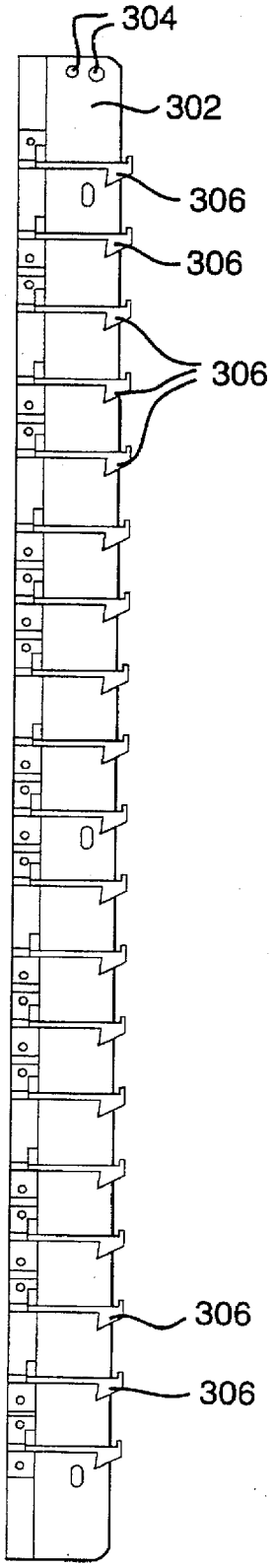
FIG. 36 and 37 are front and rear views, respectively, of a locking bar in accordance with the present invention.
Figure 37:
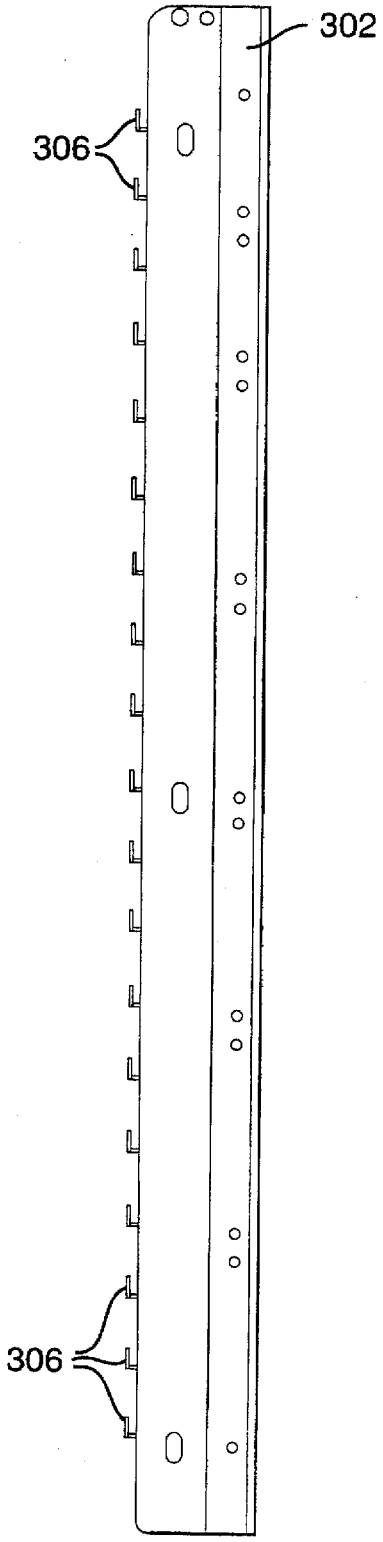

A front and rear view of the locking bar 302 is shown in FIGS. 36 and 37, respectively. The elongated locking bar is preferably formed from metal, such as 0.075" steel (14 gauge), and includes two holes 304 at the top for interfacing with the mechanical locking mechanism as described below. As best seen in FIG. 37, a plurality of locking fingers 306 are secured along the length of the locking bar. The locking fingers are evenly spaced and will be housed in corrugations 70 of the interior side panel 58 when the locking bar is properly positioned.

Figure 38:
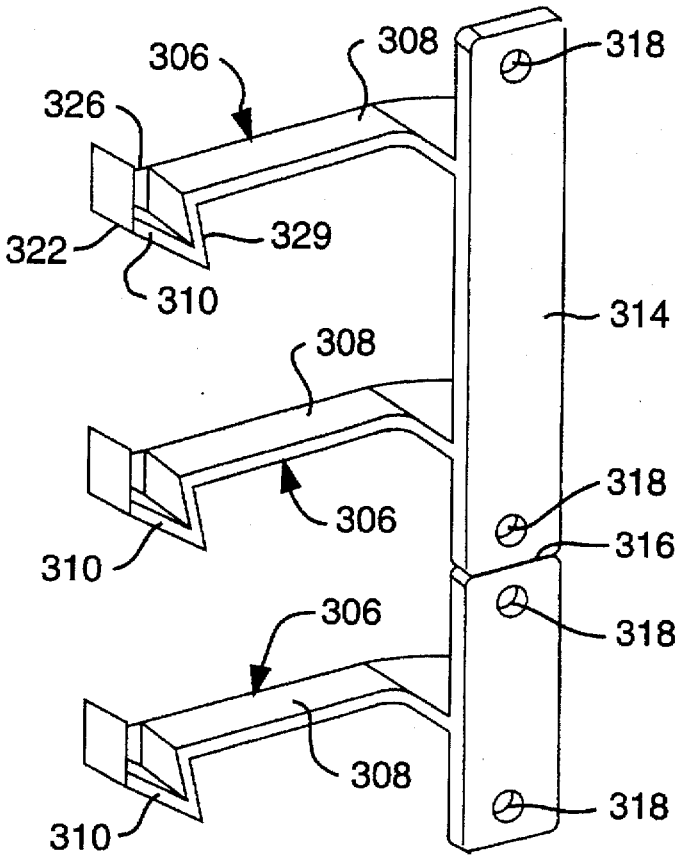
FIG. 38 is a perspective view of right side locking fingers in accordance with present invention.
Figure 39:
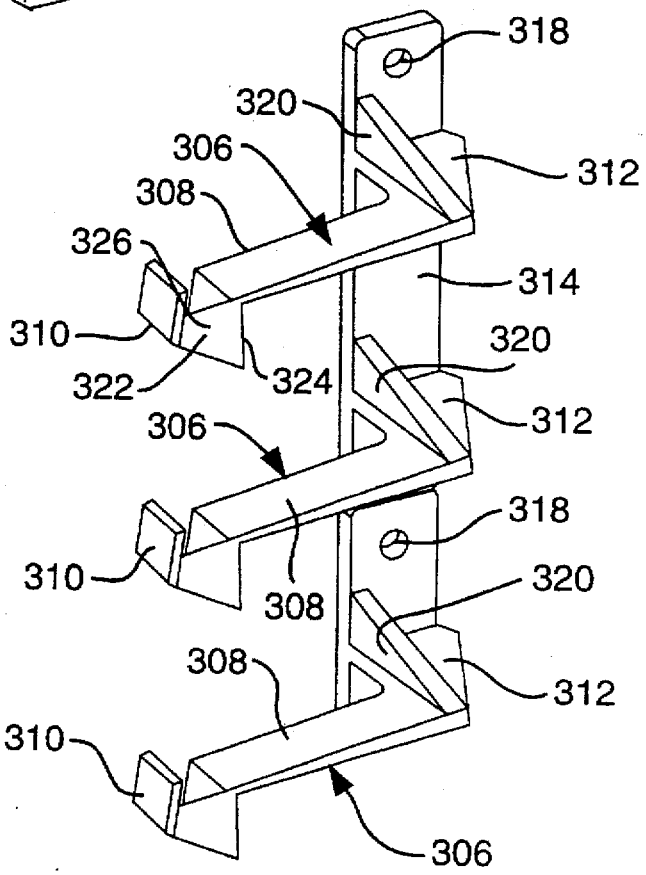
FIG. 39 is a perspective view of left side locking fingers in accordance with the present invention.

FIG. 38 illustrates a set of three "right-hand"locking fingers 306 to be secured on the locking bar 302. The right hand locking fingers will be housed in an interior side panel secured on the right side of the enclosed structure. FIG. 39 illustrates "left-hand" locking fingers for use on the left side of the enclosed structure. The fingers are preferably grouped in sets of three, or sometimes four, for ease of attachment to the locking bar. Each set of fingers is preferably an integrally formed structure made of a resilient plastic, such as nylon, to impart flexibility to the individual fingers. Each finger includes a lateral arm 308 and an angular tip 310. An extension 312 joins each arm to a common base 314. In a three-finger set, as shown in FIG. 38, the base 314 includes one scored section 316 for separating the fingers as necessary. The base 314 includes a plurality of holes 318 for receiving rivets or other fasteners for attaching the locking fingers to the locking bar. In addition, a rib 320, which is best seen in the left-hand fingers shown in FIG. 39, can also be provided as a stabilizer. The angular tip 310 includes an angled face 322 and an abutting face 324, with a front face 326 joining the angled and abutting faces.

Figure 40:
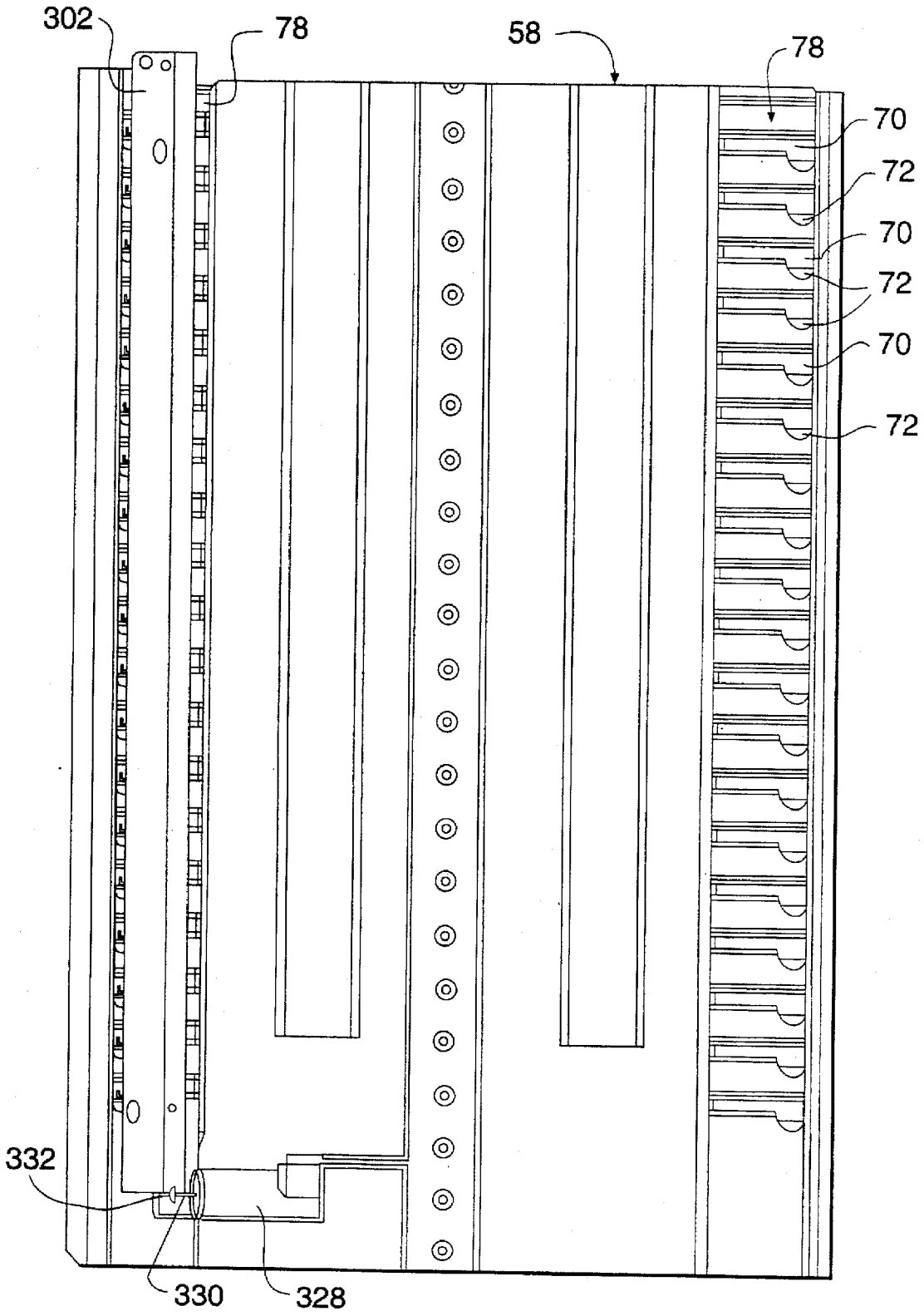
FIG. 40 is a rear elevational view of the corrugated interior panel in accordance with the present invention.
Figure 41:
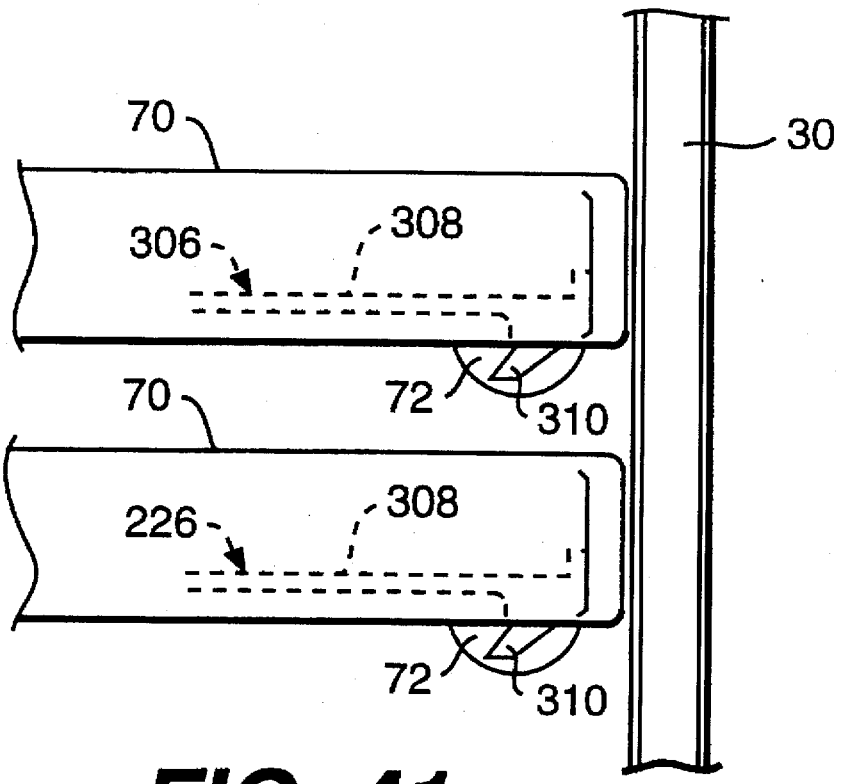
FIG. 41 is a partial front elevational view of the corrugated interior panel in accordance with the present invention.

FIG. 40 is a rear view of the interior side panel 58, showing the locking bar 302 positioned in the locking finger clearance pocket 78 in the left side (from the rear view) of the panel. As will be appreciated by those skilled in the art, the side panel in FIG. 40 can be formed by a combination of blow molding and compression molding. The middle portion of the panel is hollow as a result of the blow molding. However, a subsequent processing step, such as machining or compression molding, forms the locking finger clearance pockets 78 on the right and left sides of the panel. Part of the corrugations 70 can be seen in the locking finger clearance pockets. As seen from this view, each corrugation has an opening 72 in its underside, with the opening extending in a semicircular shape to a lateral face of the side panel immediately below the corrugation. When the locking bar is positioned in the clearance pocket, as shown in the left side of the side panel in FIG. 40, a locking finger 306 is positioned in each corrugation. A partial front view of the corrugated side panel 58 with two locking fingers 306 positioned in corrugations is shown in FIG. 41. In this figure, the locking fingers are extending through the openings 72 in the underside of the corrugations, and thus in their locked position.

Figure 42:
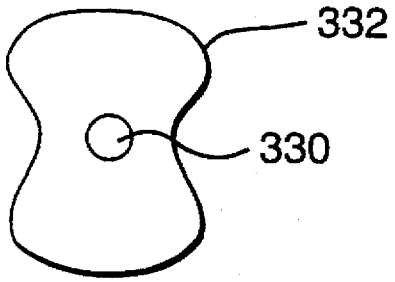
FIG. 42 is a front elevational view of a cam gear in accordance with the present invention.

With reference to FIG. 40, the lower end of the locking bar is operably engaged to an electric motor 328. The electric motor and an unshown battery operate to actuate the locking bar 302 up and down along its longitudinal axis. A rotatable shaft 330 extends from the motor and has mounted thereon a cam 332 for engaging the locking bar. A shown in FIG. 42, the cam can have a propeller-like shape so that each quarter turn of the shaft will raise or lower the locking bar.

The electronic motor and the battery are controlled by an electronic locking mechanism that will be described below in detail. When the motor is operated to actuate the locking bar, the locking fingers likewise move up or down to extend the tip 310 either in or out of its respective corrugation. When the locking bar is in the "down", or home, position, the locking finger tips 310 extend through the openings 72 and engages the notched channel 214 (see FIGS. 23 and 24) in the drawer frame. In this locked position, the notched channel is engaged by the abutting face 324 of the locking finger and the drawer cannot be withdrawn. With respect to the cassette assembly, the locking fingers in the locked position project through the slots 119 in the ribs 118 and engage the notched portion 150 of the cassette tray.

When the locking bar is raised and thus in the up, or unlocked, position, the locking finger tips 310 are retracted within the corrugations and the drawers slide freely in and out of the medication cart. Likewise, the cassette trays are free to slide in and out of the cassette assembly, and the cassette assembly itself can also be withdrawn from the medication cart.

In accordance with the subject invention, even if a drawer or a cassette tray is not fully inserted in the enclosed frame assembly, e.g., a cassette tray is open, when the locking bar is in the locked position, the drawer or cassette tray can subsequently be closed and will automatically lock. This feature is made possible by the shape and flexibility of the locking fingers. For example, when a withdrawn cassette tray is closed after the locking bar is locked, the channel 148 of the drawer frame will abut the angled face 322 of the locking fingers. The angled face permits the sliding cassette tray to impart an upward force to the locking finger, which in response will flex upwardly and allow the cassette tray to continue sliding until the notched portion 150 receives the finger tip 310. At this point, the locking finger will return to its unbiased state and lock the cassette tray.

Figure 43:
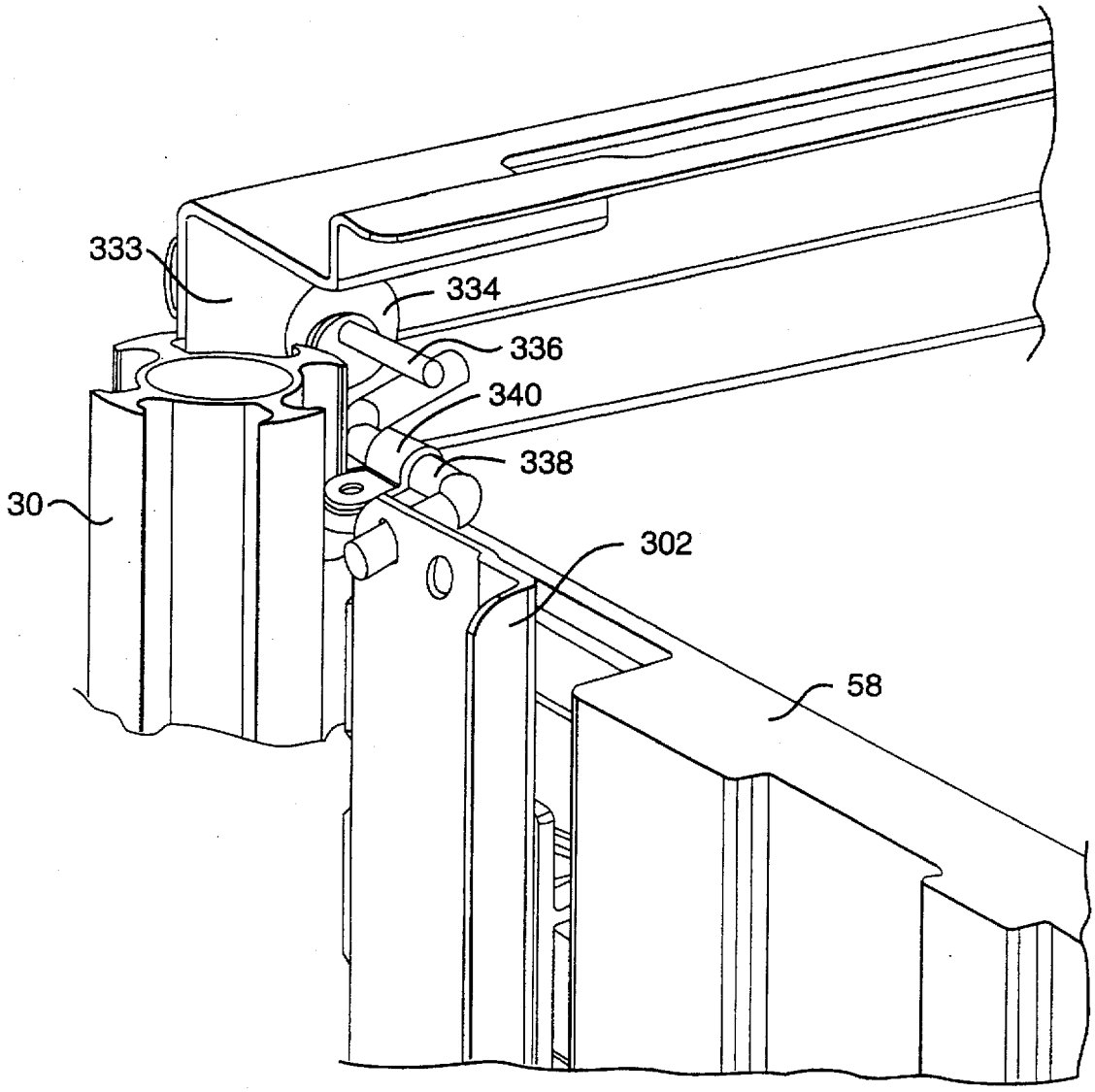
FIG. 43 is a perspective view of a front corner of the enclosed structure showing the locking bar in operable engagement with a mechanical locking mechanism in accordance with the present invention.

While the locking bar 302 can be actuated by the electric motor, it can also be actuated by operation of a mechanical locking mechanism. With reference to FIG. 43, the independent mechanical locking mechanism 333 includes a key-operated lock 334 and a pin 336 extending from the lock. An S-shaped link 338 is secured to the interior side panel 58 by a retainer clip 340. One end of the link extends through the hole 304 in the top end of the locking bar and the other (second) end of the link is in contact with the pin 336. To raise the locking bar and lift the locking fingers, thus unlocking the medication cart, a key is inserted into the lock and turned to rotate the pin in the clockwise direction. This clockwise movement lowers the second end of the link 338 and therefor raises the first end of the link to lift the locking bar.

Figure 44:
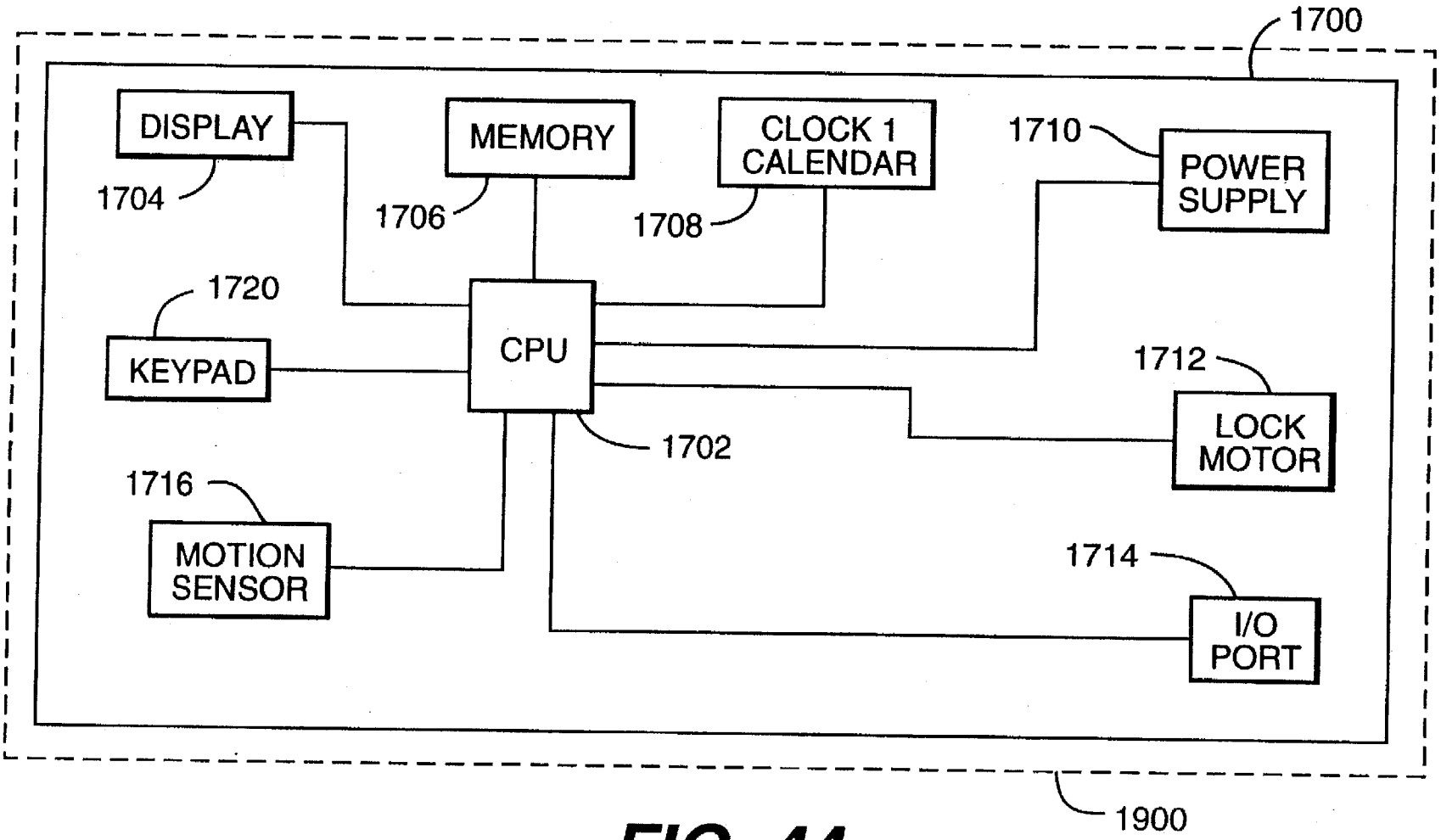
FIG. 44 a block diagram of the security system in accordance with the present invention.

The electronic locking mechanism is operated by an electronic control system. In FIG. 44, reference numeral 1900 schematically represents the cart or other enclosed structure, reference numeral 1700 represents the electronic control system for controlling the security system, reference numeral 1702 represents the central processing unit (CPU), reference numeral 1704 represents a display, reference numeral 1706 represents memory, reference numeral 1708 represents a clock and calendar, reference numeral 1710 represents a power supply, reference numeral 1712 represents a lock motor, reference numeral 1714 represents an input and output port (I/O port), reference numeral 1716 represents a motion sensor, reference numeral 1718 represents a battery warning light, and reference numeral 1720 represents a keypad. Each of the items identified above are shown in block outline because they are well known, per se, and a specific type of construction is not critical to carrying out the invention or to a disclosure of the best mode for carrying out the invention.

Figure 53:
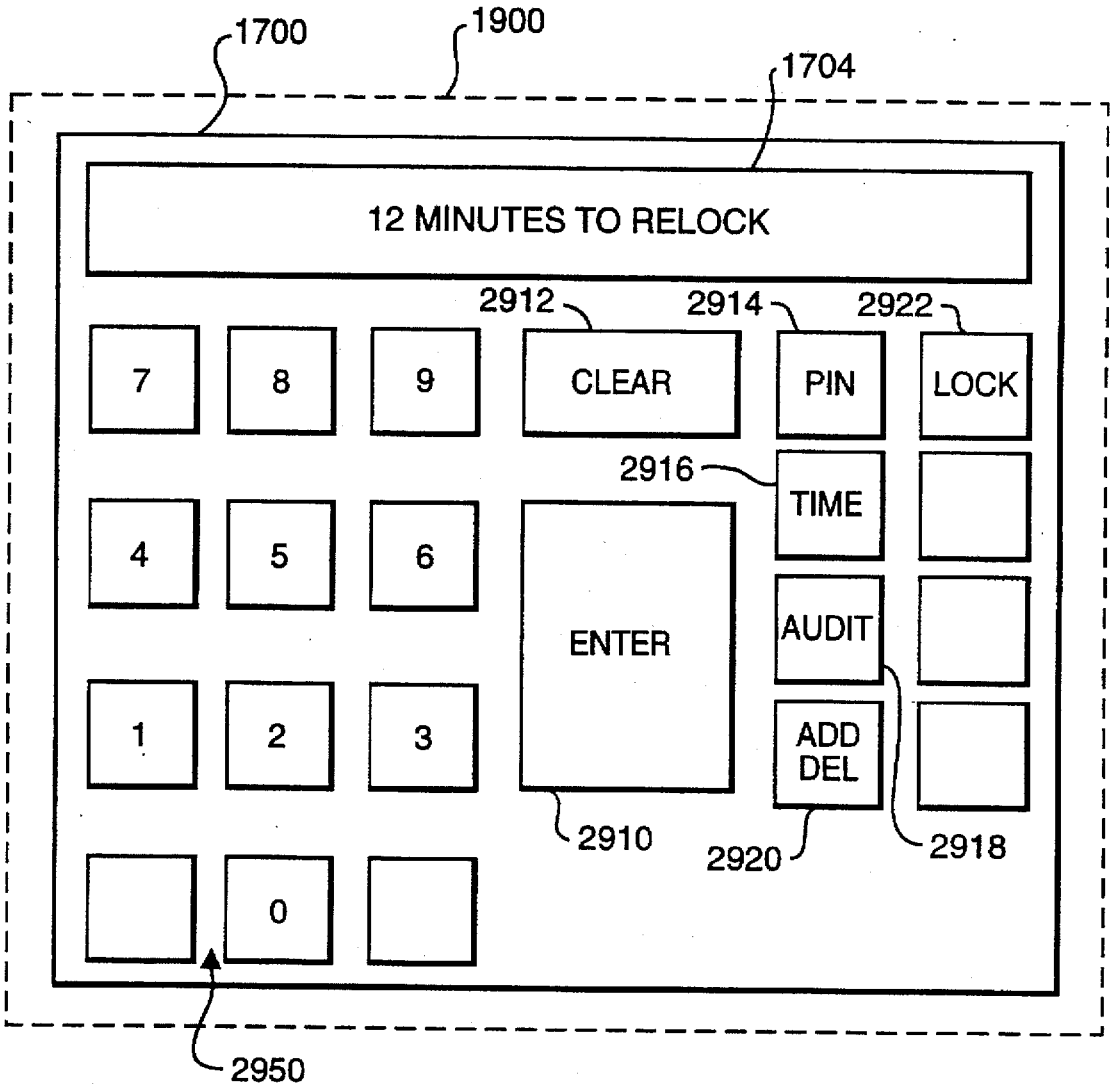
FIG. 53 is a schematic illustration of the keypad and display in accordance with the present invention.

In more detail, CPU 1702 preferably comprises a microprocessor or the like, and is connected to display 1704, memory 1706, clock/calendar 1708, power supply 1710, lock motor 1712, I/O port 1714, motion sensor 1716, and keypad 1720. Display 1704 comprises a 16 character alphanumeric LCD display or the like and includes a battery warning light, and is also shown in FIG. 53. Memory 1706 comprises non-volatile memory, RAM, ROM, and the like. Power supply 1710 preferably comprises a rechargeable nicad battery, featuring unattended fast charging with automatic kick-down to standby charging. Power supply 1710 also allows for connection for wall powered use independent from battery presence or charge level. The power supply comprises circuity (not shown) to survive accidental connection to other than a supplied wall transformer, e.g., A.C. or D.C. of less than 30 volts. Furthermore, the power supply 1710 also comprises a backup lithium cell, preferably with a life expectancy of over five years. The lock motor 1712 is protected from peak turn on current by an active current limiting circuit (not shown). I/O port 1714 comprises a standard port for interconnection with a personal computer. Motion sensor 1716 is optional and could comprise, for example, a circuit using a limit switch that detects if the lock bar has reached an expected position. Keypad 1720 (FIGS. 44 and 53) preferably comprises a membrane touchpad with ENTER key 2910, CLEAR key 2912, 0 through 9 keys generally shown as 2950, and other operation keys including a LOCK key 2922, PIN key 2914, TIME key 2916, AUDIT key 2918, and ADD/DEL key 2920. The battery warning light on the display 1704 is illuminated by CPU 1702 if the battery power is below a predetermined level.

Figure 45:
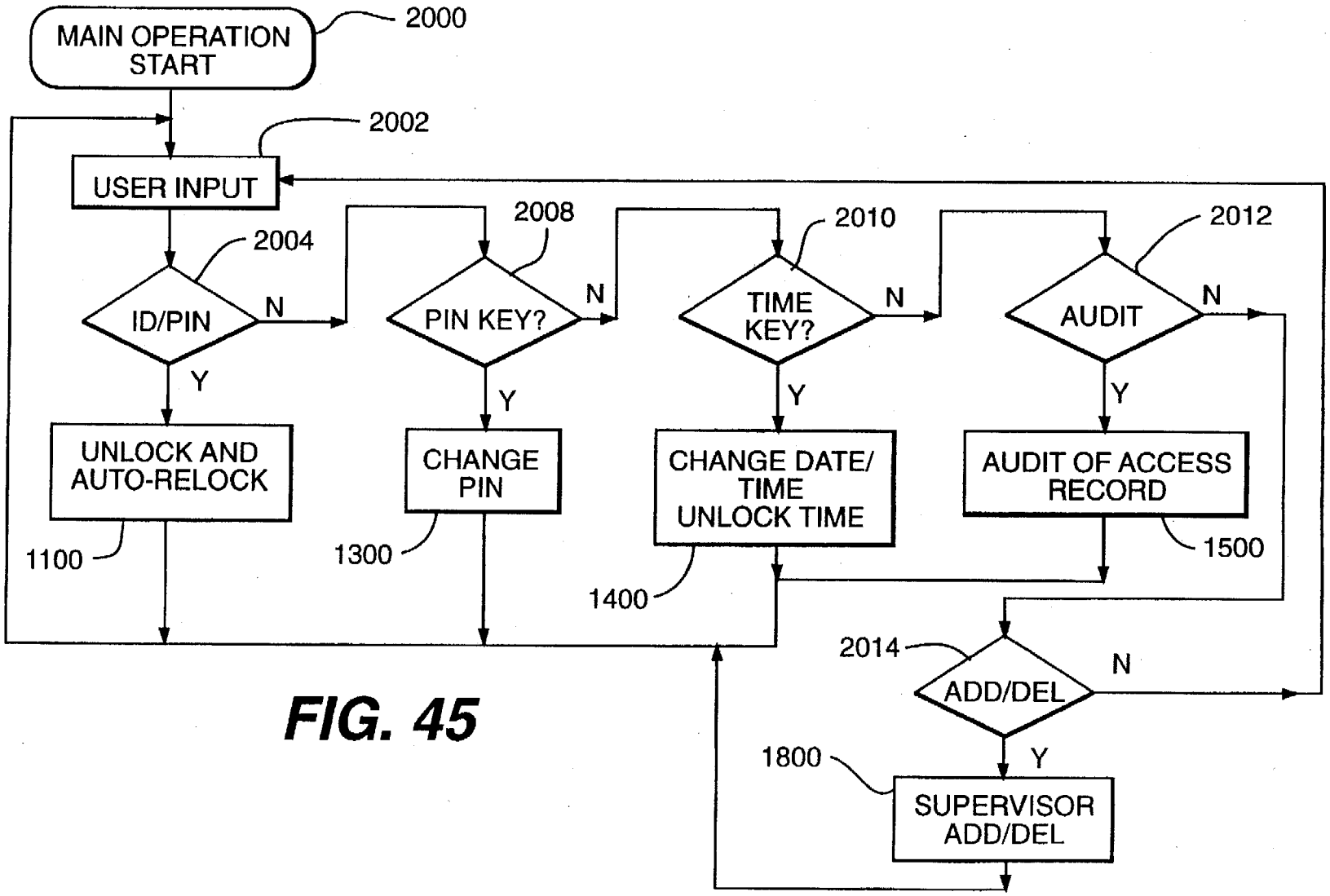
FIG. 45 is a flowchart of the operation of the security system in accordance with the present invention.

A control program for the electronic control is stored in memory 1706, and preferably in non-volatile memory. The control program serves to perform locking, unlocking, and various supervisory functions in response to user input from keypad 1720. FIG. 45 depicts a flowchart representing the main operation of the control program. When left unattended, the system enters into a sleeping, or stand-by, mode to conserve power. User input, as in step 2002 in FIG. 45, awakens the system, which then performs functions in accordance with the keys pressed.

Figure 47:
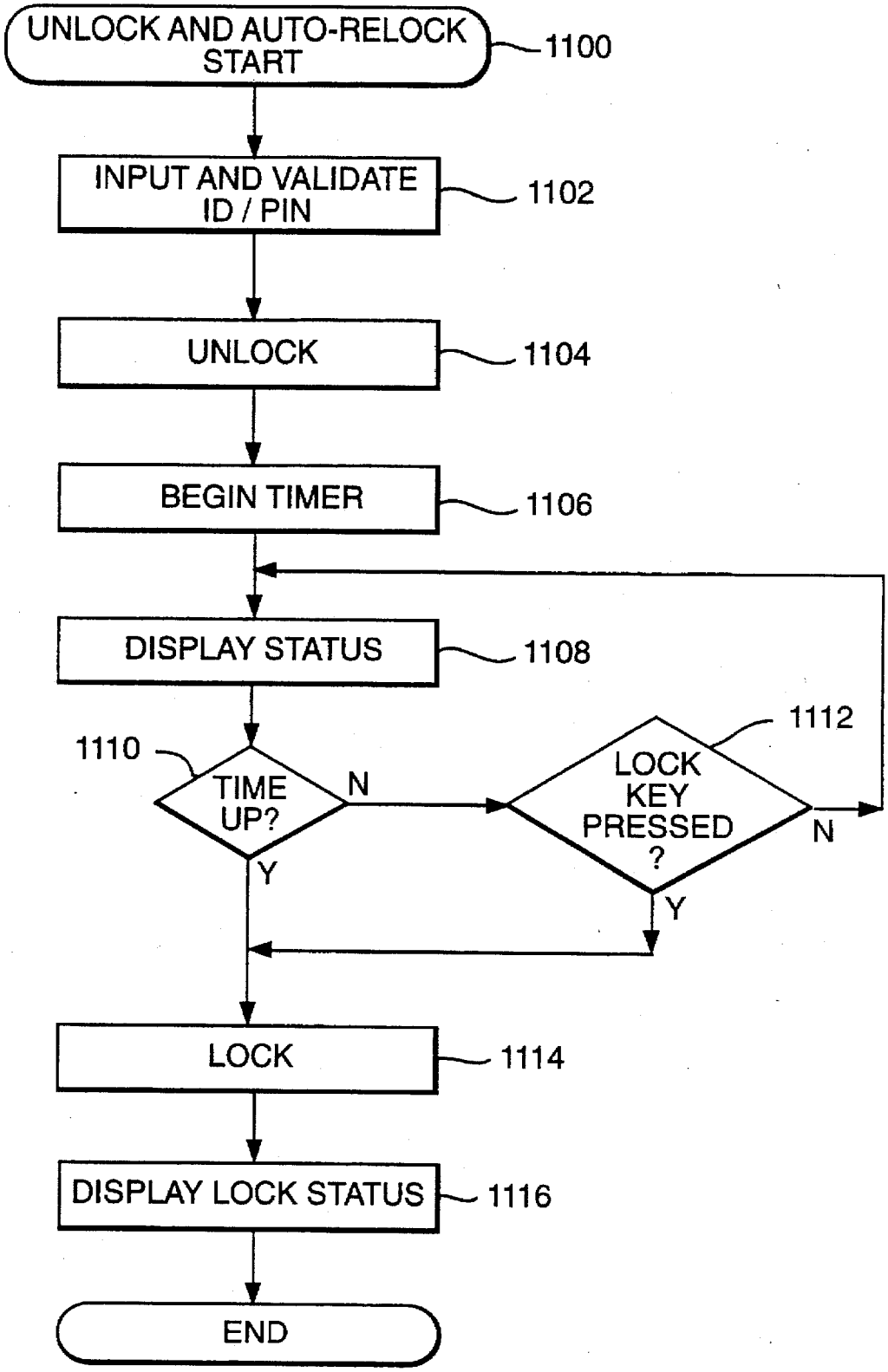
FIG. 47 is a flowchart of the unlock and auto-relock routine in accordance with the present invention.

If the user presses the 0–9 keys on keypad 1720, the control program branches in step 2004 (FIG. 45) to an unlock and auto-relock routine 1100. Turning to FIG. 47, in step 1102, the program inputs the ID and PIN from keypad 1720.

Figure 46:
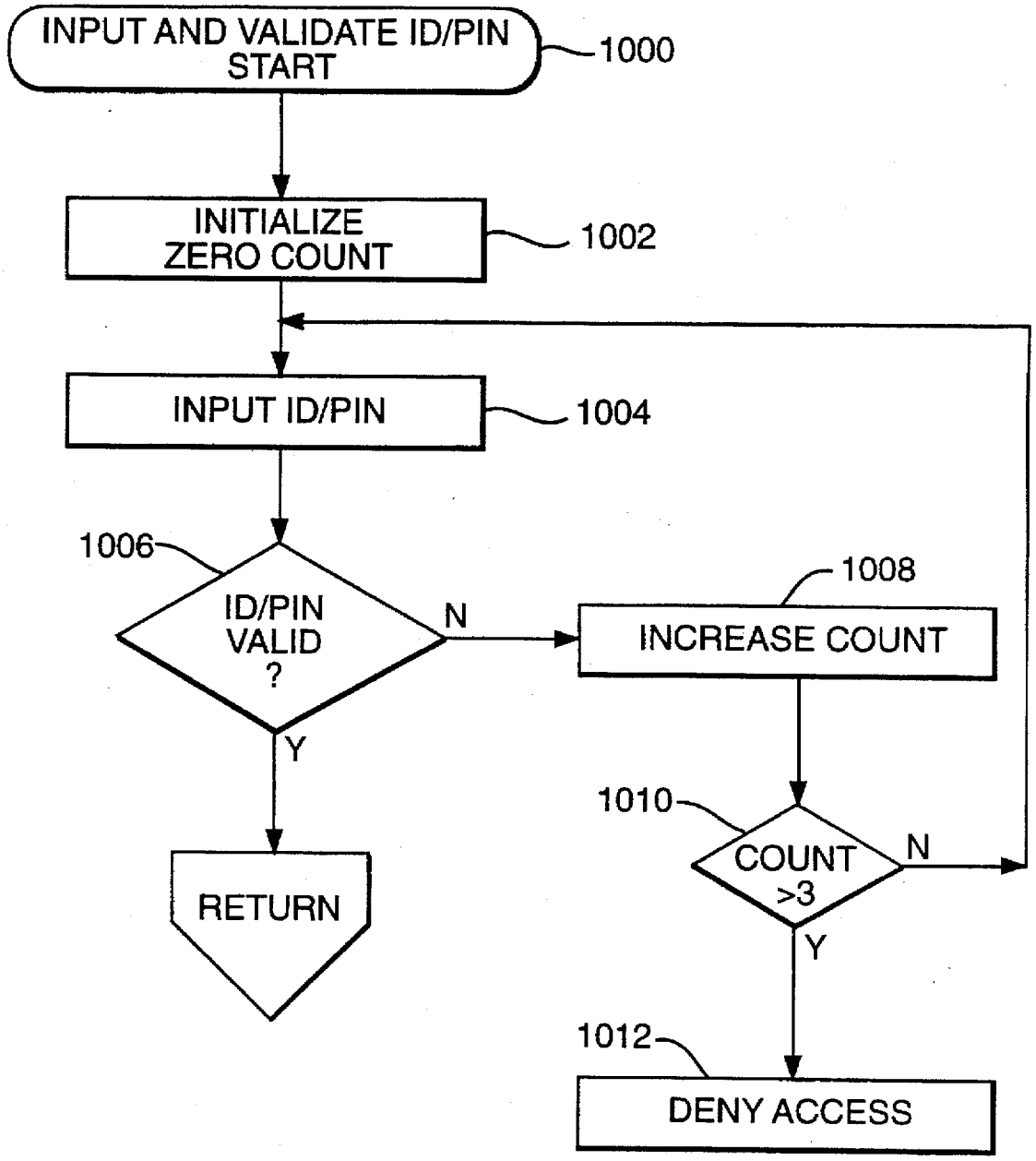
FIG. 46 is a flowchart of a routine for input and validation of the ID/PIN in accordance with the present invention.

Step 1102 is shown in more detail in FIG. 46. FIG. 46 depicts a routine for inputting and validating the ID/PIN. Step 1002 sets a count variable to zero. The program inputs the ID and PIN in step 1004. The ID comprises a two digit number (00–99), and the PIN comprises a four digit number (0000–9999). Together, the ID and PIN comprise a user code. Of course, these choices are exemplary and could be changed to allow any specified number of digits for each of the ID and PIN. In any case, if the ID and PIN are found to be valid in step 1006, then the routine returns. If the ID and PIN are not found to be valid in step 1006, then control branches to step 1008, where the count variable is increased. If the count variable is found to be greater than three in step 1010, then access is denied in step 1012. In step 1012, the security system will remain locked for a supervisory-selectable number of minutes (LOCKOUT TIME). However, if the count variable is found to be less than or equal to three in step 1010, then the routine returns to step 1004 to allow the user to enter the ID and PIN again.

Assuming that the user has entered a valid ID/PIN, the FIG. 46 routine for inputting and validating the ID/PIN returns to the FIG. 47 unlock and auto-relock routine, as discussed above. The unlock and auto-relock routine in FIG. 47 continues processing with step 1104. In step 1104, the CPU 1702 controls the lock motor 1712 to unlock the cart. In step 1106, the control program begins a timing operation. To inform the user of the remaining time, the CPU 1702 controls the display 1704 to display a status message. The status message preferably includes an alternating display of "XX MIN TO RELOCK" and "BATTERY E(**)F", wherein XX represents the number of minutes until auto-relock, and the latter display represents the amount of charge remaining on the battery (hereinafter referred to as the "battery charge message"). Step 1100 checks to see if the time is up, i.e., if the time has reached an AUTO-RELOCK TIME. This time can be changed by a user's supervisor for security purposes. If time is not up in step 1110, then in step 1112, it is checked whether the LOCK key has been pressed. If not, then the program returns to display status step 1108. Once time is up in step 1110, or if the lock key has been pressed in step 1112, then CPU 1702** controls lock motor 1712 in step 1114 to lock the cart. When the cart has been locked, CPU 1702 controls display 1704 to display a lock status display, preferably for about 15 seconds, after which the display is shut off. The lock status display preferably comprises an alternating "LOCKED" message and the above-described battery charge message.

If the optional motion sensor 1716 is included in the electronic control system, then the control program being executed by CPU 1702 uses the motion sensor 1716 to determine if the locking operation was successful. Specifically, in step 1114, after the CPU 1702 has controlled lock motor 1712 to lock the cart, the CPU receives signals from motion sensor 1716 representative of a state of the limit switch. If the limit switch (not shown) remains open for 12 seconds, for example, the motor is turned off, and then step 1116 displays an "UNLOCK ERROR" rather than the above-discussed lock status display. Such unlock errors are stored in memory 1706, preferably in non-volatile memory. The motion sensor operates in the same manner to determine if an unlocking operation was successful, i.e., if the limit switch does not change states after 12 seconds, the motor is turned off and an error signal is displayed and stored in memory 1706.

While the cart is unlocked, and the unlock and auto-relock routine in FIG. 47 is operating, the other functions of the main operation of the control program (FIG. 45) are available on an interrupt basis. Specifically, while the unlock and auto-relock routine in FIG. 47 is passing through the steps 1108, 1110, and 1112, if the user presses any of the function keys (e.g., ADD/DEL, TIME, etc.), that respective routine (e.g., ADD/DEL, TIME, etc.) will be performed. Thereafter, the flow returns to the unlock and auto-relock routine and the timer (step 1106) is reset to begin counting down again from the maximum, predetermined auto-relock time.

Figure 48:
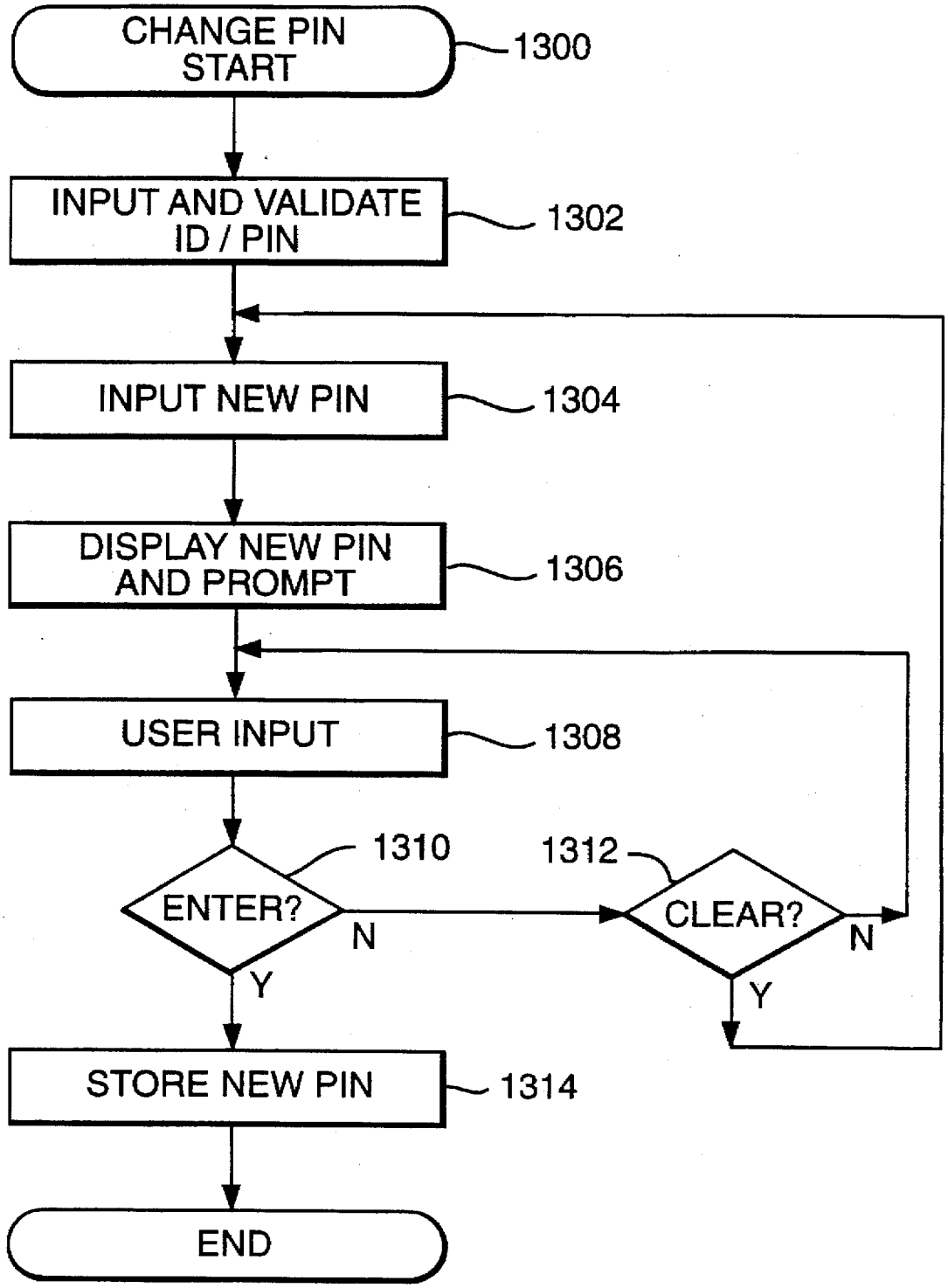
FIG. 48 is a flowchart of the change PIN routine in accordance with the present invention.

To unlock the cart, the user must enter a PIN, as described above; however, the user may wish to change his or her PIN for security purposes. Also, the supervisor may wish to change a user's PIN. FIG. 48 shows a "change PIN" routine 1300. This routine would be selected, as shown in FIG. 45, if the PIN key is pressed (step 2008). Returning to FIG. 48, in step 1302, the user (or supervisor) enters the user code (ID/PIN). Step 1302 follows the procedure of FIG. 46, as described above. Assuming that a valid ID/PIN has been entered, in step 1304 the prompt "NEW PIN" is displayed on display 1704, and the user may input a new PIN via keypad 1720. The new PIN is displayed in step 1306, by an alternating display between "NEW PIN: ####" and "ENTER OR CLEAR." User input is accepted in step 1308 (during which time the alternating display continues). In step 1310, if the ENTER key has been pressed, then the new PIN is stored in step 1314. If in step 1310, the ENTER key has not been pressed, then it is determined in step 1312 if the CLEAR key has been pressed. If so, the routine returns to step 1304 to input a new PIN (although not shown, if the user presses the CLEAR key twice, the routine ends). If the user has not pressed CLEAR (step 1312), then the user has pressed neither CLEAR nor ENTER, therefore the routine returns to step 1308.

Figure 49:
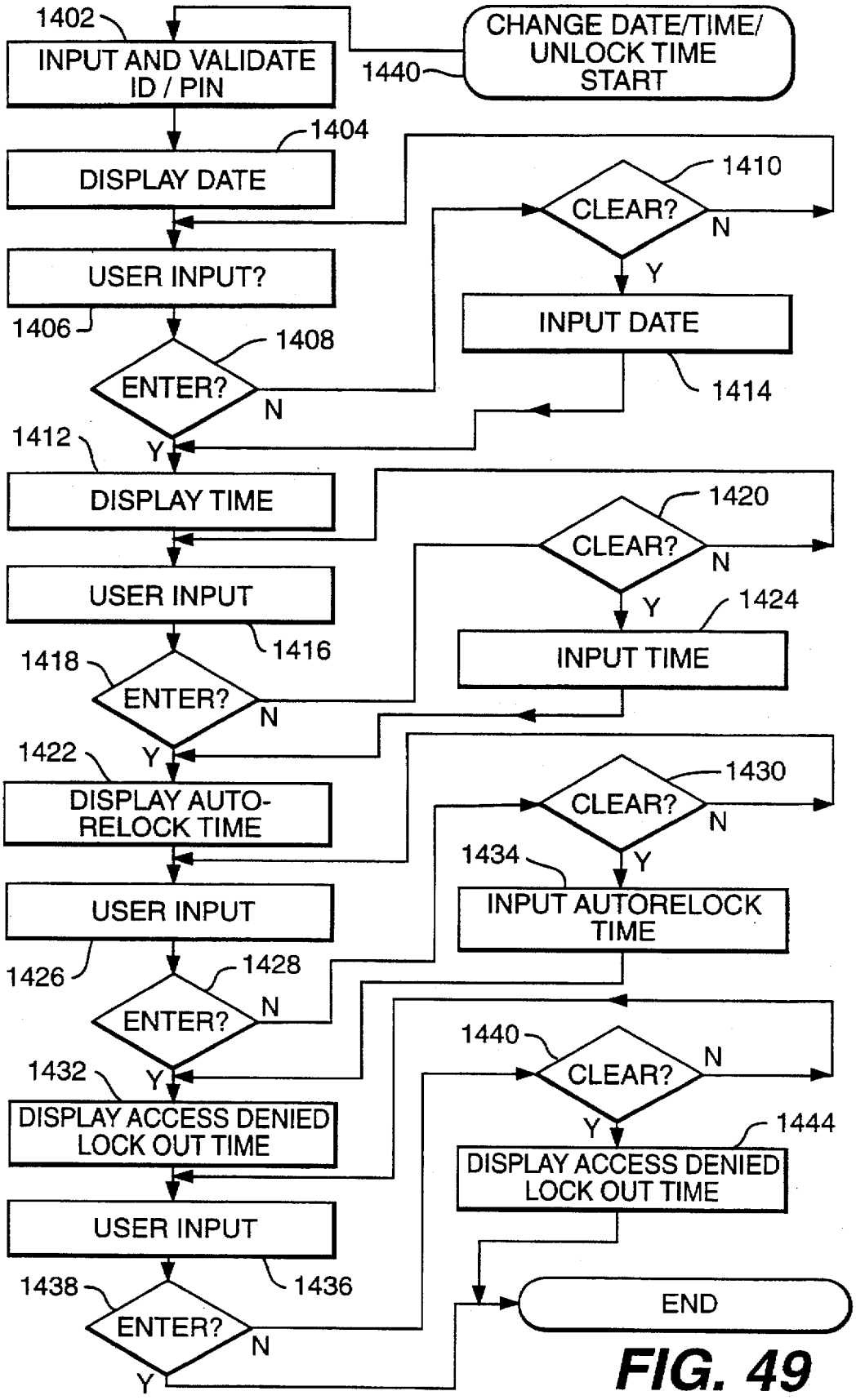
FIG. 49 is a flowchart of the change date/time/unlock time routine in accordance with the present invention.

Returning to FIG. 45, if the PIN key has not been selected in step 2008, then step 2010 determines if the TIME key has been selected. If so, then the change date/time/unlock time routine of step 1400 is selected. FIG. 49 depicts this routine in detail. First, a valid ID/PIN is input in step 1402. The current date is displayed in step 1404, e.g., by an alternating display of "DATE-##/##/##" and "ENTER OR CLEAR", which display continues during user input in step 1406. If ENTER has been pressed (step 1408), then the date is presumed to be correct, and the routine continues with step 1412. If ENTER has not been pressed (step 1408), then the CLEAR key is checked in step 1410. If the CLEAR key has not been pressed, the routine returns to step 1406. If the CLEAR key has been pressed, then flow passes to step 1414, wherein the user may enter the date.

Figure 50:
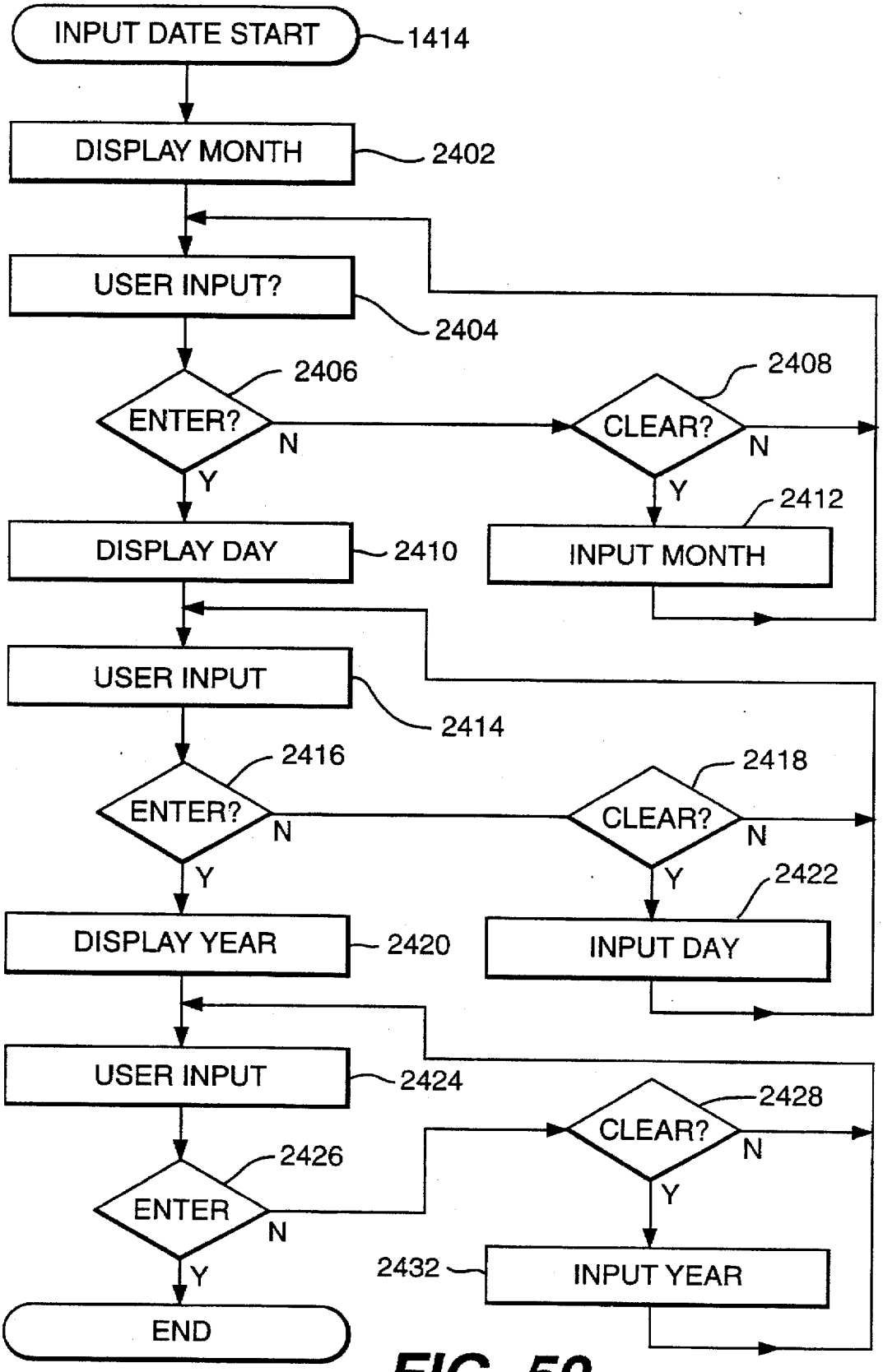
FIG. 50 is a flowchart of the input date routine in accordance with the present invention.

Step 1414 is shown in more detail in FIG. 50. In step 2402, the month is displayed, e.g., by an alternating display of "MONTH: ##(01–12)" and "ENTER OR CLEAR", which display continues during user input step 2404. If neither ENTER nor CLEAR (steps 2406 and 2408) have been pressed, then flow returns to step 2404. If CLEAR has been pressed (steps 2406, 2408), then the month is input in step 2412, and flow returns to step 2404. If ENTER has been pressed (step 2406), then flow continues with step 2410.

In step 2410, the day is displayed, e.g., by an alternating display of "DAY: ##(01–31)" and "ENTER OR CLEAR", which display continues during user input step 2414. If neither ENTER nor CLEAR (steps 2416 and 2418) have been pressed, then flow returns to step 2414. If CLEAR has been pressed (steps 2416, 2418), then the day is input in step 2422, and flow returns to step 2414. If ENTER has been pressed (step 2416), then flow continues with step 2420.

In step 2420, the year is displayed, e.g., by an alternating display of "YEAR: ##(00–99)" and "ENTER OR CLEAR", which display continues during user input step 2424. If neither ENTER nor CLEAR (steps 2426 and 2428) have been pressed, then flow returns to step 2424. If CLEAR has been pressed (steps 2426, 2428), then the year is input in step 2432, and flow returns to step 2424. If ENTER has been pressed (step 2426), then the flow ends.

After routine 1414 (FIG. 50) ends, flow returns to step 1412 in FIG. 49. In step 1412, an alternating display of "TIME: ##:##" and "ENTER OR CLEAR" begins, and continues during user input step 1416. If neither ENTER nor CLEAR are pressed (steps 1418, 1420), flow returns to step 1416. If CLEAR is pressed (steps 1418, 1420), then the time is input in step 1424. If ENTER is pressed (step 1418), or the time has been input in step 1424, then flow continues with step 1422. Although not depicted herein, input time step 1424 is similar in function to input date step 1414, with the difference being that HOURS (00–24) and MINUTES (00–59) are input.

In step 1422, an alternating display of "RELOCK: ##MIN" and "ENTER OR CLEAR" begins, and continues during user input step 1426. If neither ENTER nor CLEAR are pressed (steps 1428, 1430), flow returns to step 1426. If CLEAR is pressed (steps 1428, 1430), then the AUTO-RELOCK TIME is input in step 1434. If ENTER is pressed (step 1428), or the auto-relock time has been input in step 1434, then flow continues with step 1432. Although not depicted herein, input auto-relock time step 1434 is similar in function to input date step 1414, with the difference being that AUTO-RELOCK TIME (01-99 minutes) is input. As described above, once the cart has been unlocked for an amount of time equal to the AUTO-RELOCK TIME (see FIG. 47, step 1100), then the cart is automatically locked.

In step 1432, an alternating display of "LOCKOUT: ##MIN" and "ENTER OR CLEAR" begins, and continues during user input step 1436. If neither ENTER nor CLEAR are pressed (steps 1438, 1440), flow returns to step 1436. If CLEAR is pressed (steps 1438, 1440), then the LOCKOUT TIME is input in step 1444. If ENTER is pressed (step 1438), or the lockout time has been input in step 1444, then flow of the routine ends. Although not depicted herein, input lockout time step 1444 is similar in function to input date step 1414, with the difference being that LOCKOUT TIME (01–99 minutes) is input. As described above, if invalid ID/PINs are thrice entered, then the system enters an access denied/lockout state (FIG. 46, step 1012), and stays in that state for a period of time equal to the LOCKOUT TIME.

Figure 51:
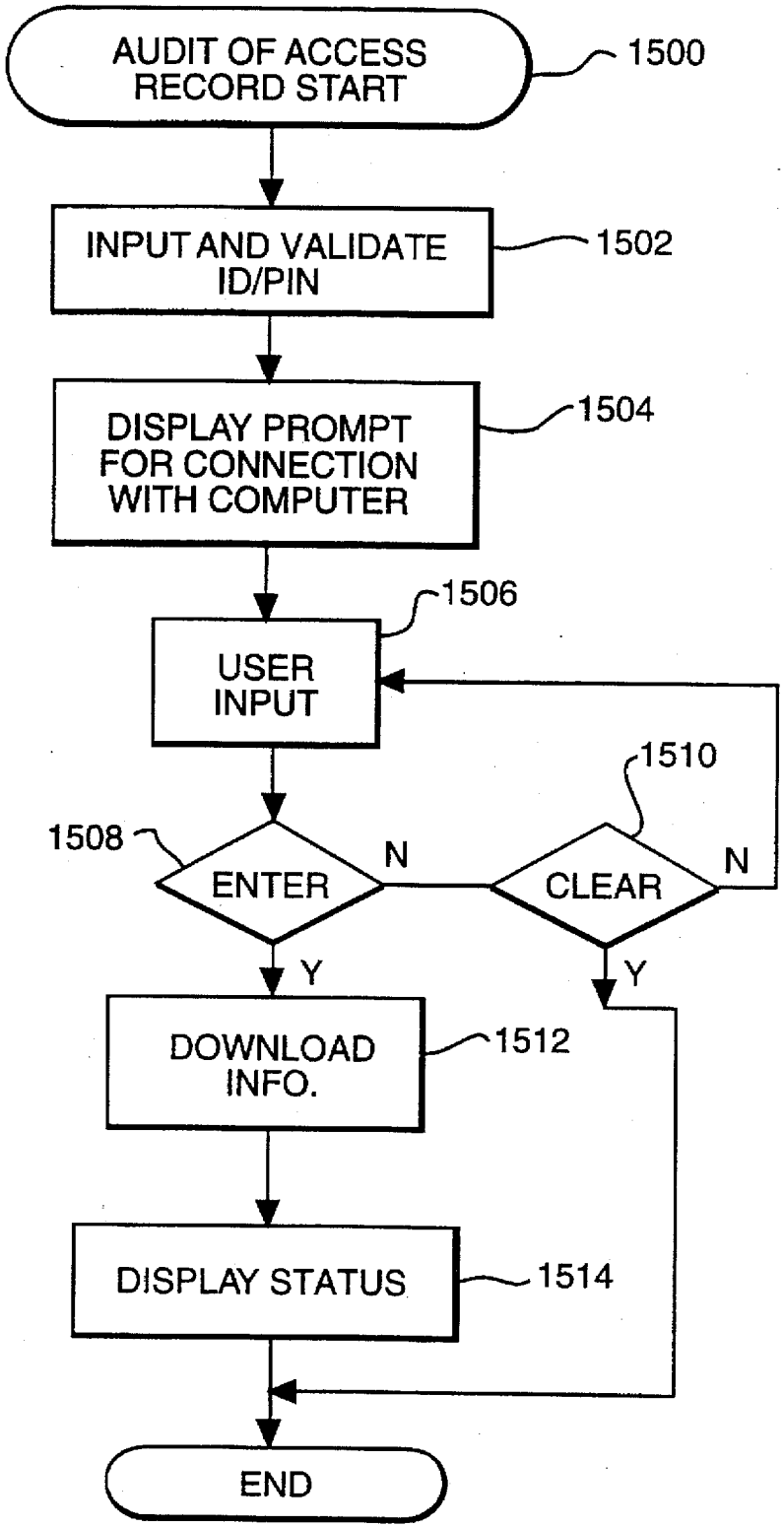
FIG. 51 is a flowchart of the audit of access record routine in accordance with the present invention.

Returning now to FIG. 45, if the TIME key has not been pressed (step 2010), then the selection of the AUDIT key is checked in step 2012. Each time a user unlocks the cart, an access record is stored in non-volatile memory in memory 1706. The last 500 access records, for example, are retained in revolving fashion (i.e., the oldest records are deleted to make way for newer records). Each cart also has stored within it a unique cart identifier. Unlock errors are also stored in memory 1706. All of this information may be downloaded to a computer using the audit function (FIG. 45, step 1500). The procedure is shown in more detail in FIG. 51. In step 1502, the ID/PIN is input in the manner of FIG. 46. An alternating display of "CONNECT COMPUTER" and "ENTER OR CLEAR" begins in step 1504, and continues during input step 1506. After user input from keypad 1720 during step 1506, step 1508 checks to see if ENTER was selected. Presumably, the user will have connected the computer to I/O port 1714 before pressing ENTER. If the user instead presses CLEAR (steps 1508, 1510), then the routine branches to step 1514, where the battery charge message is displayed; thereafter, the routine ends. If neither ENTER (step 1508) nor CLEAR (step 1510) are pressed, then flow returns to step 1506. If enter has been pressed (step 1508), then flow advances to step 1512, wherein the information is downloaded. During step 1512, "DOWNLOADING INFO" is displayed, and then "DOWNLOADING DONE" when the process is completed. When the transaction is complete, the battery charge message is displayed, for about 15 seconds, in step 1514. In addition to access information, other information such as a list of user names, IDs, and PINs may be downloaded to the computer.

Figure 52:
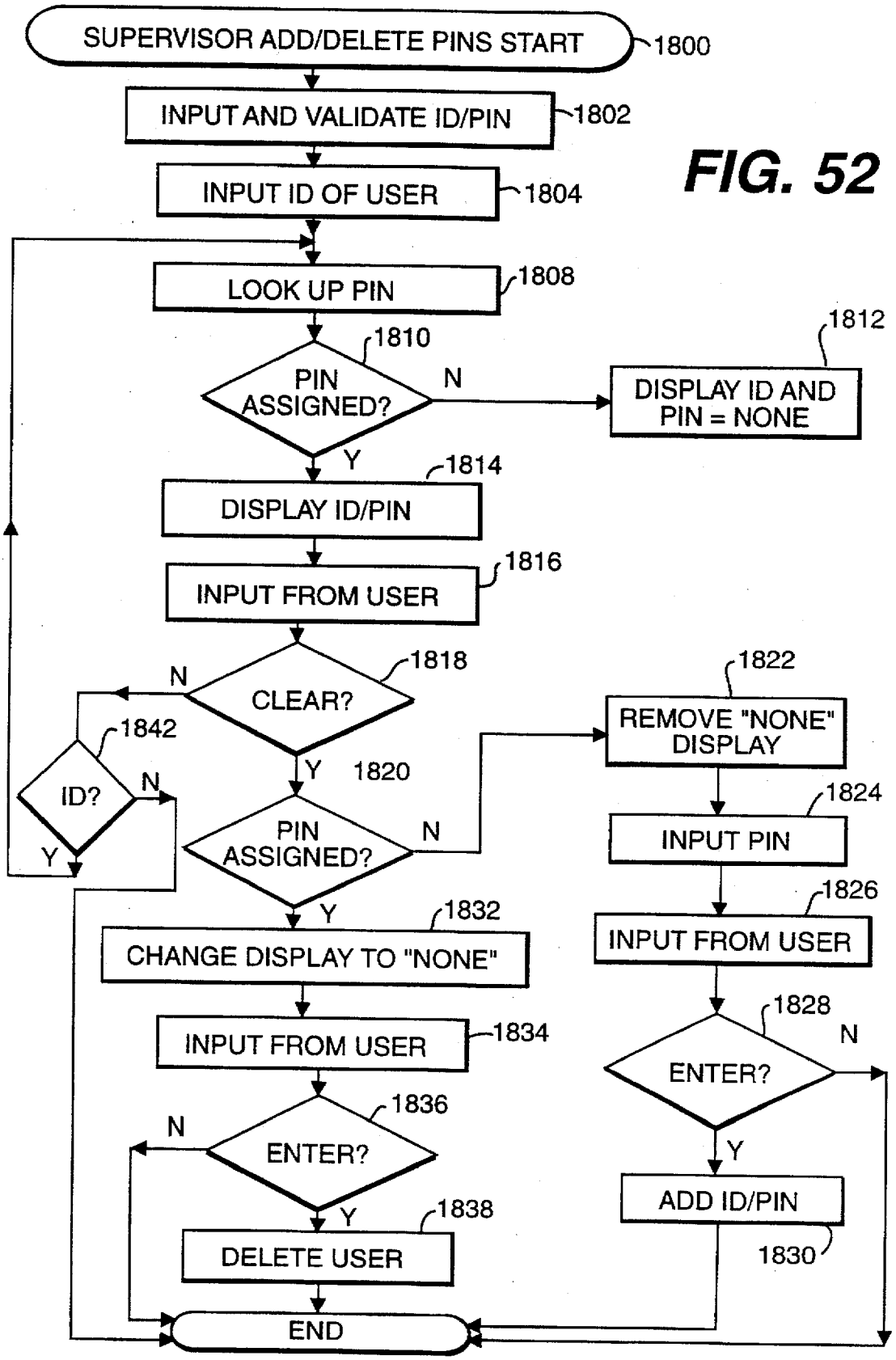
FIG. 52 is a flowchart of the supervisor add/delete PIN routine in accordance with present invention.

In addition to the AUDIT function, a supervisor may also wish to add or delete users. If the AUDIT key is not pressed (FIG. 45, step 2012), flow advances to step 2014, wherein it is determined if the ADD/DEL key has been selected. If not, then flow returns to step 2002. If "YES," then the supervisor add/delete routine, step 1800, is performed. FIG. 52 depicts this routine in more detail. In step 1802, the ID/PIN is input and validated as in FIG. 46. In step 1804, the alternating prompt "ENTER ID OF USER" and "ENTER OR CLEAR" is displayed, while user input is accepted. The CPU 1702 looks up the PIN corresponding to the input ID from memory 1706 in step 1808. If no PIN has been assigned to the input ID (step 1810), then an alternating display of "ID: ##, PIN: NONE" and "CLEAR TO CHG PIN" appears (step 1812). If, on the other hand, a PIN has been assigned to the input ID (step 1810), then an alternating display of "ID: ##, PIN: ####" and "CLEAR TO CHG PIN" appears (step 1814). After either step 1812 or 1814, the flow branches to step 1816. User input is accepted in step 1816. If CLEAR is not pressed (step 1818), but the user has begun to enter another ID (step 1842), then flow returns to step 1808. By means of this procedure, the supervisor can "scroll through" user IDs and PINs by pressing numbers without hitting enter. If neither CLEAR nor an ID is entered (step 1842), then flow ends, and a battery charge message is displayed (not shown in FIG. 61).

On the other hand, if the user has pressed CLEAR, then either the add user routine or delete user routine is chosen. Consider first the delete user routine. Assume, for sake of discussion, that the screen depicts an ID/PIN combination, e.g., "ID: 05, PIN: 1234". Where there is such an assigned PIN (step 1820), the display will now be changed to "NONE" (step 1832). If the user inputs ENTER in step 1834, then flow branches as in step 1836 to step 1838 to delete that user. If the user does not input ENTER in step 1834 (but instead presses CLEAR or another key), then the routine ends (step 1836 branches to end) and a battery charge message is displayed.

Consider next the add user routine. In this case, assume, for sake of discussion that the screen depicts an ID/PIN combination, e.g., "ID: 56, PIN: NONE". Because no PIN is assigned (step 1820), now step 1822 will remove the "NONE" display, and the user may input a new PIN in step 1824. If the user next inputs ENTER in step 1826, then step 1828 branches the flow to step 1830 to add the new ID/PIN. Thereafter, the routine ends and displays a battery charge message. If the user does not input ENTER in step 1826, then step 1828 branches the flow to end the routine, and a battery charge message is displayed.

Note that the foregoing supervisor add/delete PINs routine, when a user is added, entails entry of user IDs and initial PINs; of course, users can change their own PINs as described above in the change PIN routine. If the supervisor needs a list of the user names, IDs, and PINs, the same may be obtained from the computer audit program.

While the aforementioned computer audit program allows downloading of information from the security system 1700 to a computer, the system also allows programming and control of the electronic control system from an external computer. As in the downloading, I/O port 1714 is used as an interface. The date, time, supervisor PIN, user PINs, lockout time, auto-relock time, and any other controllable parameters may be programmed in an external computer, and then uploaded to the electronic control system through I/O port 1714.

In any mode of operation of the control program (including, for example, unlock and auto-relock routine 1100, change PIN routine 1300, change date/time/unlock time routine 1400, audit for access record routine 1500, supervisor add/delete PINs routine 1800, and input and validate ID/PIN routine 1000), if the control program is awaiting user input, and a predetermined amount of time elapses without any input, then the control program exits the mode of operation or routine in question and returns to the main operation (step 2000 in FIG. 45). This improves security, for example, by automatically exiting from the supervisor add/delete PINs routine, if the electronic control system is left unattended in the middle of that routine.

Thus, what has been described is a medication cart that includes a cassette assembly and uses flanged support posts as part of its frame assembly. The cassette assembly includes its own external locking assembly for securing its contents when disposed outside of the medication cart. The cassette assembly is also constructed to be used with an internal locking assembly of the medication cart.

Although specific embodiments of the present invention have been described above in detail, it will be understood that this description is merely for purposes of illustration. Various modifications of and equivalent structures corresponding to the disclosed aspects of the preferred embodiment in addition to those described above may be made by those skilled in the art without departing from the spirit of the present invention which is defined in the following claims, the scope of which is to be accorded the broadest interpretation so as to encompass such modifications and equivalent structures.

What is claimed is:

1. A cassette assembly, comprising:

frame means for Supporting at least one cassette tray, said frame means including side panels with corrugated interior surfaces and ribbed outer surfaces;

at least one cassette tray slidably supported in said frame means;

at least one bin received in said cassette tray;

internal locking means for, individually securing said frame means and said cassette tray in an enclosed structure; and external locking means for securing said bin within said frame means.

2. A cassette assembly according to claim 1, wherein said internal locking means includes an opening in said ribbed outer surfaces and engagable means on said cassette tray engagable through the opening.

3. A cassette assembly according to claim 2, wherein said engagable means forms a notched portion on a lateral side of said cassette tray.

4. A cassette assembly according to claim 3, wherein said internal locking means further includes a front lip on said cassette tray, wherein said bin must be lifted over said lip when being withdrawn.

5. A cassette assembly according to claim 3, wherein the notched portion is formed in a channel on said lateral side of said cassette tray.

6. A cassette assembly according to claim 1, wherein said external locking means includes a locking rod slidably disposed in said frame means and actuating means in operable engagement with said locking rod and also disposed in said frame means, said locking rod engaging said cassette tray in a locked position to prevent it from being withdrawn from said frame means.

7. A cassette assembly according to claim 6, wherein said locking rod includes a tooth and said cassette tray includes a latch for engaging said tooth.

8. A cassette assembly according to claim 7, wherein said latch includes an abutting face for abutting said tooth and an angled face for sliding over said tooth and biasing said latch.

9. A cassette assembly according to claim 1, further comprising a stabilizing rod disposed in said frame means.

10. A cassette assembly according to claim 1, further comprising a label cover rotatably secured to said bin.

11. A cassette assembly according to claim 1, wherein said frame means further includes a back panel secured between said side panel and sandwiched between top and bottom components.

12. A cassette assembly for use in an enclosed structure having a corfugered interior and a security system, said cassette assembly comprising;

a cassette frame for supporting at least one cassette tray, said cassette frame having ribbed exterior surfaces for interfacing with the corrugated interior of the enclosed structure;

at least one cassette tray supported an said cassette frame;

at least one bin received in said cassette tray;

internal locking means, operable with the security system, for individually securing said cassette frame and said tray in the enclosed structure; and external locking means for securing said bin in said cassette frame.

13. A cassette assembly according to claim 12, wherein said cassette frame includes a plurality of side panels and a back panel secured together and sandwiched between top and bottom components, with each side panel having an interior surface formed with corrugations defining a slot and said ribbed exterior surface.

14. A cassette assembly according to claim 12, wherein said internal locking means includes an opening in said ribbed exterior surfaces, and engagable means on said cassette tray engagable through the opening.

15. A cassette assembly according to claim 14, wherein said engagable means forms a notched portion on a lateral side of said cassette tray.

16. A cassette assembly according to claim 15, wherein said internal locking means further includes a front lip on said cassette tray, wherein said bins must be lifted over said lip when being withdrawn.

17. A cassette assembly according to claim 15, wherein the notched portion is formed in a channel on said lateral side of said cassette tray.

18. A cassette assembly according to claim 12, wherein said external locking means includes a locking rod slidably mounted in said cassette frame; and actuation means for actuating said locking rod to engage said cassette tray.

19. A cassette assembly according to claim 18, wherein said cassette tray includes a latch for engaging said locking rod.

20. A cassette assembly according to claim 19, wherein said locking rod includes a tooth and said latch includes an abutting face for abutting said tooth and an angled face for sliding over said tooth, with said latch being biased when said angled face slides over said tooth.

21. A cart, comprising:

an enclosed structure comprised of a plurality of support posts, at least two side walls supported between said support posts, each side wall have a corrugated interior surface, a bottom platform supporting said support posts and said side walls and a top platform fitting over said support posts and said side walls;

locking means for securing said enclosed structure; and a cassette assembly removably supported in said enclosed structure, said cassette assembly comprising:

frame means for supporting at least one cassette tray, said frame means including side panels with corrugated interior surfaces and ribbed outer surfaces, with said ribbed outer surfaces engaging with said corrugated interior surface of said side walls;

at least one cassette tray supported in said frame means;

at least one bin received in said cassette tray;

internal locking means, operably engaged by said locking means, for individually securing said frame means and said cassette tray in said enclosed structure; and external locking means for securing said bin within said frame means.

22. A cart according to claim 21, wherein said internal locking means includes an opening in said ribbed outer surfaces and engagable means on said cassette tray engagable through the opening.

23. A cart according to claim 22, wherein said engagable means forms a notched portion on a lateral side of said cassette tray.

24. A cart according to claim 23, wherein said internal locking means further includes a front lip on said cassette tray, wherein said bins must be lifted over said lip when being withdrawn.

25. A cart according to claim 23, wherein the notched portion is formed in a channel on said lateral side of said cassette tray.

26. A cart according to claim 23, wherein said locking means includes a locking finger actuable within the opening in said ribbed outer surface of said internal locking means in a locked position and out of the opening in an unlocked position.

27. A cart according to claim 26, wherein said lacking finger disposed in the locked position engages the notched portion on said cassette tray.

28. A cart according to claim 27, wherein said locking finger includes a flat face for abutting said cassette tray and an angled face for allowing said cassette tray to slide relative thereto.

29. A cart according to claim 21, wherein said external locking means includes a locking rod slidably disposed in said frame means and actuating means in operable engagement with said locking rod and also disposed in said frame means, said locking rod engaging said cassette tray in a locked position to prevent it from being withdrawn from said frame means.

30. A cart according to claim 29, wherein said locking rod includes a tooth and said cassette tray includes a latch for engaging said tooth.

31. A cart according to claim 30, wherein said latch includes an abutting face for abutting said tooth and an angled face for sliding over said tooth biasing said latch.

32. A cart according to claim 21, further comprising a stabilizing rod-and-secured in said frame means.

33. A cart according to claim 21, wherein each said support post includes:

an elongated tubular post; and a plurality of spaced flanges extending radially from said post and running in a longitudinal direction along said post, each said flange having a first portion extending radially from said post and a second portion extending from a terminal end of said first portion.

34. A cart according to claim 21, further comprising control means for controlling said locking means.

35. A cart according to claim 34, wherein said control means comprises:

input means for inputting information;

storing means for storing access information; and access control means for controlling said locking means in accordance with (i) the information input by said input means and iii) the access information stored in said storing means.

36. A cart according to claim 35, wherein said input means comprises means for inputting a user code, wherein said storing means comprises user code storing means for storing valid user codes, and wherein said access control means comprises (a) means for comparing a user code input by said input means with valid user codes stored in said user code storing means and for producing a comparison result and (b) means for controlling the locking mechanism in accordance with the comparison result.

37. A cart according to claim 36, wherein said input means comprises a keypad, and wherein said user code storing means comprises a non-volatile memory.

38. A cart according to claim 34, wherein said control means further comprises:

timing means for measuring elapsed time; and time control means for controlling said locking means in accordance with the elapsed time measured by said timing means.

39. A cart according to claim 38, wherein said time control means comprises means for locking the locking mechanism in accordance with the elapsed time measured by said timing means.

40. A cart according to claim 39, wherein said time locking means comprises means for locking the locking mechanism in accordance with said timing means measuring an elapsed time greater than a predetermined time.

41. A cart according to claim 21, wherein each support post includes:

an elongated post; and means for defining at least one groove extending in the longitudinal direction of said elongated post.

42. A cassette assembly, comprising:

frame means for supporting at least one cassette tray;

a cassette tray slidably supported in said frame means;

at least one bin received in said cassette tray;

internal locking means, interfacing with an external security system, for individually locking said frame means and said cassette tray; and external locking means for locking said bin in said frame means.

43. A cassette assembly, comprising:

frame means for supporting at least one cassette tray, said frame means including side panels with corrugated interior surfaces and ribbed outer surfaces;

at least one cassette tray slidably supported in said frame means;

at least one bin received in said cassette tray;

internal locking means for securing said cassette frame in an enclosed structure, said internal locking means including an opening in at least one of said ribbed outer surfaces for receiving a security system; and external locking means for securing said bin within said frame means.

44. A cassette assembly according to claim 43, wherein said internal locking means includes engagable means on said cassette tray engagable through the opening in said ribbed outer surface.

45. A cassette assembly according to claim 44, wherein said engagable means forms a notched portion on a lateral side of said cassette tray.

46. A cassette assembly according to claim 45, wherein said internal locking means further includes a front lip on said cassette tray, wherein said bin must be lifted over said lip when being withdrawn.

47. A cassette assembly according to claim 45, wherein the notched portion is formed in a channel on said lateral side of said cassette tray.

48. A cassette assembly according to claim 43, wherein said external locking means includes a locking rod slidably disposed in said frame means and actuating means in operable engagement with said locking rod and also disposed in said frame means, said locking rod engaging said cassette tray in a locked position to prevent it from being withdrawn from said frame means.

49. A cassette assembly according to claim 48, wherein said locking rod includes a tooth and said cassette tray includes a latch for engaging said tooth.

50. A cassette assembly according to claim 49, wherein said latch includes an abutting face for abutting said tooth and an angled face for sliding over said tooth and biasing said latch.

51. A cassette assembly for use in an enclosed structure having a corrugated interior and a security system, said cassette assembly comprising:

a cassette frame for supporting at least one cassette tray, said cassette frame having ribbed exterior surfaces for interfacing with the corrugated interior of the enclosed structure;

at least one cassette tray supported in said cassette frame;

at least one bin received in said cassette tray;

internal locking means for securing said cassette frame in the enclosed structure, said internal locking means including an opening in at least one of said ribbed exterior surfaces for receiving the security system; and external locking means for securing said bin in said cassette frame.

52. A cassette assembly according to claim 51, wherein said internal locking means includes engagable means on said cassette tray engagable through the opening in said ribbed exterior surface.

53. A cassette assembly according to claim 52, wherein said engagable means forms a notched portion on a lateral side of said cassette tray.

54. A cassette assembly according to claim 53, wherein said internal locking means further includes a front lip on said cassette tray, wherein said bin must be lifted over said lip when being withdrawn.

55. A cassette assembly according to claim 53, wherein the notched portion is formed in a channel on said lateral side of said cassette tray.

56. A cassette assembly according to claim 51, wherein said external locking means includes a locking rod slidably mounted in said cassette frame; and actuation means for actuating said locking rod to engage said cassette tray.

57. A cassette assembly according to claim 56, wherein said cassette tray includes a latch for engaging said locking rod.

58. A cassette assembly according to claim 57, wherein said locking rod includes a tooth and said latch includes an abutting face for abutting said tooth and an angled face for sliding over said tooth, with said latch being biased when said angled face slides over said tooth.

59. A cart, comprising:

an enclosed structure comprised of a plurality of support posts, at least two side walls supported between said support posts, each side wall have a corrugated interior surface, a bottom platform supporting said support posts and said side walls and a top platform fitting over said support posts and said side walls;

locking means for securing said enclosed structure; and a cassette assembly removably supported in said enclosed structure, said cassette assembly comprising:

frame means for supporting at least one cassette tray, said frame means including side panels with a corrugated interior and ribbed outer surfaces, with said ribbed outer surfaces engaging with said corrugated interior surface of said side walls;

at least one cassette tray supported in said frame means;

at least one bin received in said cassette tray;

internal locking means for securing said cassette frame in said enclosed structure, said internal locking means including an opening in at least one of said ribbed outer surfaces for receiving said locking means; and external locking means for securing said bins within said frame means.

60. A cart according to claim 59, wherein said internal locking means includes engagable means on said cassette tray engagable through the opening in said ribbed outer surface.

61. A cart according to claim 60, wherein said engagable means forms a notched portion on a lateral side of said cassette tray.

62. A cart according to claim 61, wherein the notched portion is formed in a channel on said lateral side of said cassette tray.

63. A cart according to claim 61, wherein said internal locking means further includes a front lip on said cassette tray, wherein said bin must be lifted over said lip when being withdrawn.

64. A cart according to claim 61, wherein said locking means includes a locking finger actuable within the opening in said ribbed outer surface of said internal locking means in a locked position and out of the opening in an unlocked position.

65. A cart according to claim 64, wherein said locking finger in the locked position engages the notched portion on said cassette tray.

66. A cart according to claim 65, wherein said locking finger includes a flat face for abutting said cassette tray and an angled face for allowing said cassette tray to slide relative thereto.

67. A cart according to claim 59, wherein said external locking means includes a locking rod slidably disposed in said frame means and actuating means in operable engagement with said locking rod and also disposed in said frame means, said locking rod engaging said cassette tray in a locked position to prevent it from being withdrawn from said frame means.

68. A cart according to claim 58, wherein said locking rod includes a tooth and said cassette tray includes a latch for engaging said tooth.

69. A cart according to claim 68, wherein said latch includes an abutting face for abutting said tooth and an angled face for sliding over said tooth and biasing said latch.

70. A cassette assembly, comprising:

frame means for supporting at least one cassette tray;

a cassette tray slidably supported in said frame means;

at least one bin received in said cassette tray;

internal locking means securing said cassette frame in an enclosed structure, said internal locking means including an opening in said frame means for receiving an external security system; and external locking means for locking said bin in said frame means.

* * * * *

UNITED STATES PATENT AND TRADEMARK OFFICE

CERTIFICATE OF CORRECTION

PATENT NO. : 5,673,983

DATED : October 7, 1997

INVENTOR(S) : Carlson et al.

It is certified that error appears in the above-identified patent and that said Letters Patent is hereby corrected as shown below:

Onthe title page item

[56] REFERENCES CITED:

U.S. PATENT DOCUMENTS, "Romic" should read --Romick--.

COLUMN 21:

Line 2, "Supporting" should read --supporting--.
Line 47, "panel" should read --panels--.
Line 50, "corfugered" should read --corrugated--.
Line 56, "an" should read --in--.

COLUMN 23:

Line 4, "lacking" should read --locking--.
Line 22, "tooth" should read --tooth and--.
Line 24, "rod-and-secured" should read --rod secured--.

COLUMN 26:

Line 37, "claim 58," should read --claim 67,--.

Signed and Sealed this

Twenty-second Day of September, 1998

*Attest:*

Bruce Lehman

BRUCE LEHMAN

*Attesting Officer*

*Commissioner of Patents and Trademarks*